US012351965B2

(12) United States Patent
Lee et al.

(10) Patent No.: US 12,351,965 B2
(45) Date of Patent: Jul. 8, 2025

(54) LAUNDRY TREATING APPARATUS

(71) Applicant: LG ELECTRONICS INC., Seoul (KR)

(72) Inventors: Yunhi Lee, Seoul (KR); Jaehyun Kim, Seoul (KR); Hyunsun Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 237 days.

(21) Appl. No.: 17/827,109

(22) Filed: May 27, 2022

(65) Prior Publication Data

US 2022/0380967 A1 Dec. 1, 2022

(30) Foreign Application Priority Data

May 28, 2021 (KR) ..... 10-2021-0069528
Jun. 1, 2021 (KR) ..... 10-2021-0071149
Aug. 23, 2021 (KR) ..... 10-2021-0110915
Sep. 28, 2021 (KR) ..... 10-2021-0127678

(51) Int. Cl.
*D06F 29/00* (2006.01)
*D06F 33/32* (2020.01)
(Continued)

(52) U.S. Cl.
CPC ..... *D06F 29/005* (2013.01); *D06F 33/32* (2020.02); *D06F 39/04* (2013.01); *D06F 58/206* (2013.01);
(Continued)

(58) Field of Classification Search
CPC ..... D06F 29/005; D06F 33/32; D06F 39/04; D06F 58/10; D06F 58/206; D06F 58/26; D06F 58/38; D06F 73/02; D06F 2103/32; D06F 2103/50; D06F 2105/20; D06F 2105/26
See application file for complete search history.

(56) References Cited

U.S. PATENT DOCUMENTS 7,320,234 B2 1/2008 Hershey et al.
9,359,714 B2 * 6/2016 Contarini ..... D06F 58/203
(Continued)

FOREIGN PATENT DOCUMENTS

CN 101349001 A 1/2009
CN 105316890 A 2/2016
(Continued)

OTHER PUBLICATIONS

Electronic translation of WO 2019/154266 A1 to Li et al. (Year: 2019).*
Electronic translation of KR 101467494 B1 to Park. (Year: 2014).*

*Primary Examiner* — Joseph L. Perrin
(74) *Attorney, Agent, or Firm* — Birch, Stewart, Kolasch & Birch, LLP

(57) ABSTRACT

A laundry treating apparatus includes a dryer disposed in an indoor space; a washing machine vertically disposed with respect to the dryer; a refresher disposed on one side of the dryer and the washing machine; and a heating device heating air supplied to at least one of the dryer, the washing machine, and the refresher. The heating device includes a plurality of compressors, and controls a number of compressors to be operated and an RPM of the operated compressors, according to a cycle status of the dryer, the washing machine, and the refresher.

16 Claims, 27 Drawing Sheets

(51) Int. Cl.

| | |
|---|---|
| ***D06F 39/04*** | (2006.01) |
| ***D06F 58/10*** | (2006.01) |
| ***D06F 58/20*** | (2006.01) |
| ***D06F 58/26*** | (2006.01) |
| ***D06F 58/38*** | (2020.01) |
| ***D06F 73/02*** | (2006.01) |
| *D06F 103/32* | (2020.01) |
| *D06F 103/50* | (2020.01) |
| *D06F 105/20* | (2020.01) |
| *D06F 105/26* | (2020.01) |

(52) U.S. Cl.

CPC ..... *D06F 58/26* (2013.01); *D06F 58/38* (2020.02); *D06F 73/02* (2013.01); *D06F 58/10* (2013.01); *D06F 2103/32* (2020.02); *D06F 2103/50* (2020.02); *D06F 2105/20* (2020.02); *D06F 2105/26* (2020.02)

(56) References Cited

U.S. PATENT DOCUMENTS

| | | | | |
|---|---|---|---|---|
| 9,372,031 | B2 * | 6/2016 | Contarini | F26B 21/086 |
| 9,435,069 | B2 * | 9/2016 | Contarini | D06F 58/206 |
| 2002/0017117 | A1 | 2/2002 | Sunshine et al. | |
| 2004/0194339 | A1 | 10/2004 | Johnson et al. | |
| 2006/0112585 | A1 | 6/2006 | Choi et al. | |
| 2006/0137210 | A1 | 6/2006 | Lee et al. | |
| 2006/0156765 | A1 | 7/2006 | Sunshine et al. | |
| 2007/0151301 | A1 | 7/2007 | Kendall et al. | |
| 2007/0169519 | A1 | 7/2007 | Hershey et al. | |
| 2008/0229515 | A1 | 9/2008 | Hong et al. | |
| 2009/0126421 | A1 | 5/2009 | Kim et al. | |
| 2011/0185511 | A1 | 8/2011 | Ryoo et al. | |
| 2014/0026433 | A1 | 1/2014 | Bison et al. | |
| 2016/0186374 | A1 | 6/2016 | Ryoo et al. | |
| 2018/0340288 | A1 | 11/2018 | Kim et al. | |
| 2020/0240065 | A1 | 7/2020 | Underly et al. | |
| 2021/0148029 | A1 | 5/2021 | Lv et al. | |

FOREIGN PATENT DOCUMENTS

| | | | | | |
|---|---|---|---|---|---|
| CN | 105734936 | A | | 7/2016 | |
| CN | 209652609 | U | | 11/2019 | |
| CN | 209686107 | U | | 11/2019 | |
| DE | 10 2006 015 840 | A1 | | 10/2007 | |
| DE | 10 2008 006 111 | A1 | | 7/2009 | |
| DE | 10 2008 064 737 | B3 | | 8/2016 | |
| EP | 1 029 961 | A2 | | 8/2000 | |
| EP | 2 147 999 | A1 | | 1/2010 | |
| EP | 3 940 134 | A1 | | 1/2022 | |
| JP | 2008-307151 | A | | 12/2008 | |
| KR | 10-2006-0060211 | A | | 6/2006 | |
| KR | 10-0587360 | B1 | | 6/2006 | |
| KR | 10-2006-0111128 | A | | 10/2006 | |
| KR | 10-0658842 | B1 | | 12/2006 | |
| KR | 10-0839519 | B1 | | 6/2008 | |
| KR | 10-2008-0100964 | A | | 11/2008 | |
| KR | 10-2010-0025981 | A | | 3/2010 | |
| KR | 101467494 | B1 | * | 12/2014 | D06F 58/10 |
| KR | 10-2019-0127439 | A | | 11/2019 | |
| KR | 10-2019-0131259 | A | | 11/2019 | |
| KR | 10-2120993 | B1 | | 6/2020 | |
| KR | 10-2020-0109194 | A | | 9/2020 | |
| KR | 10-2200698 | B1 | | 1/2021 | |
| KR | 10-2254903 | B1 | | 5/2021 | |
| WO | WO 2007/148894 | A2 | | 12/2007 | |
| WO | WO 2011/149320 | A2 | | 12/2011 | |
| WO | 2013/014145 | A1 | | 1/2013 | |
| WO | WO 2014/017004 | A1 | | 1/2014 | |
| WO | WO 2017/119673 | A1 | | 7/2017 | |
| WO | WO 2019/141063 | A1 | | 7/2019 | |
| WO | WO 2019/154266 | A1 | | 8/2019 | |
| WO | WO 2021/083006 | A1 | | 5/2021 | |

* cited by examiner

FIG. 18

| CATEGORY | SPECIFICATIONS OF APPLIED COMPRESSOR | | |
|---|---|---|---|
| | TYPE | CAPACITY(cc) | OPERATION RANGE (rpm) |
| DRYER | DUAL ROTARY COMPRESSOR | 10.2 | 1,200 ~ 7,800 |
| WASHING MACHINE | SINGLE HORIZONTAL ROTARY COMPRESSOR | 7.2 | 1,200 ~ 5,400 |
| REFRESHER | DUAL ROTARY COMPRESSOR | 9.2 | 1,200 ~ 5,400 |
| | --- or --- | | |
| | RECIPROCATING COMPRESSOR | 8.2 | 1,200 ~ 4,500 |

FIG. 19

| CATEGORY | SPECIFICATIONS OF APPLIED COMPRESSOR | | |
|---|---|---|---|
| | TYPE | CAPACITY(cc) | OPERATION RANGE (rpm) |
| INTEGRATED STRUCTURE -SEQUENTIAL OPERATION (APPLYING ONE COMPRESSOR) | DUAL ROTARY COMPRESSOR | 10.2 | 1,200 ~ 7,800 |
| INTEGRATED STRUCTURE -OPERATION WITH MINIMUM POWER CONSUMPTION (APPLYING TWO COMPRESSORS) | DUAL ROTARY COMPRESSOR + RECIPROCATING COMPRESSOR (DISCHARGE, INTAKE) | 6.6 | 1,200 ~ 5,400 |
| | | 4.0 | 1,200 ~ 4,500 |

FIG. 20

| CATEGORY | SPECIFICATIONS OF APPLIED COMPRESSOR | | |
|---|---|---|---|
| | TYPE | CAPACITY(cc) | OPERATION RANGE(rpm) |
| INTEGRATED STRUCTURE -INTEGRATED OPERATION OF TWO UNITS (APPLYING ONE COMPRESSOR) | DUAL ROTARY COMPRESSOR 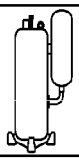 | 18.0 ~ 20.0 | 1,200 ~ 5,400 |
| -INTEGRATED OPERATION OF TWO UNITS -MINIMUM POWER (APPLYING TWO COMPRESSORS) | DUAL ROTARY COMPRESSOR 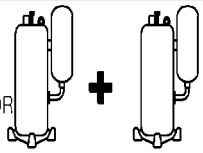 | 10.2 + 9.2 | 1,200 ~ 5,400 |
| | DUAL ROTARY COMPRESSOR 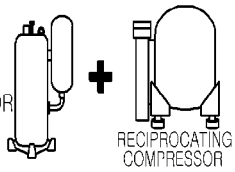 RECIPROCATING COMPRESSOR | 10.2 + 8.2 | 1,200 ~ 5,400 (Dual Rotary) 1,200 ~ 4,500 (RECIPROCATING ) |

FIG. 21

| CATEGORY | SPECIFICATIONS OF APPLIED COMPRESSOR | | |
|---|---|---|---|
| | TYPE | CAPACITY(cc) | OPERATION RANGE(rpm) |
| INTEGRATED STRUCTURE -NTEGRATED OPERATION (APPLYING ONE COMPRESSOR) | DUAL ROTARY COMPRESSOR 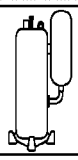 | 25.0 ~ 27.0 | 1,200 ~ 5,400 |
| INTEGRATED OPERATION -MINIMUM POWER CONSUMPTION (APPLYING TWO COMPRESSORS) | DUAL ROTARY COMPRESSOR 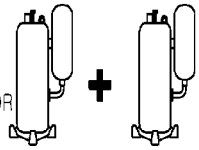 | 17.4 + 9.2 | 1,200 ~ 5,400 |
| | DUAL ROTARY COMPRESSOR 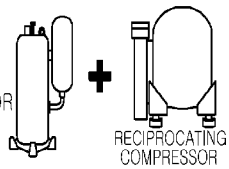 RECIPROCATING COMPRESSOR | 17.4 + 8.2 | 1,200 ~ 5,400 (Dual Rotary) 1,200 ~ 4,500 (RECIPROCATING ) |

LAUNDRY TREATING APPARATUS

CROSS-REFERENCE TO RELATED APPLICATION

This application claims the benefit of Korean Patent Application No. 10-2021-0069528, filed on May 28, 2021 in the Republic of Korea, Korean Patent Application No. 10-2021-0071149, filed on Jun. 1, 2021 in the Republic of Korea, Korean Patent Application No. 10-2021-0110915, filed on Aug. 23, 2021 in the Republic of Korea, and Korean Patent Application No. 10-2021-0127678, filed on Sep. 28, 2021 in the Republic of Korea, which are hereby incorporated by reference in their entirety for all purposes as if fully set forth herein.

BACKGROUND OF THE INVENTION

1. Field of the Invention

The present disclosure relates to a laundry treating apparatus, and more particularly to a laundry treating apparatus including a plurality of laundry treating machines.

2. Description of the Background Art

Laundry treating machines, such as washing machines, dryers, and refreshers, are installed in different spaces, such as a kitchen, a utility room, and an outdoor space, according to usage in a residential space.

Korean Laid-Open Patent Publication No. 10-2020-0109194 discloses a washing machine. The washing machine washes laundry by supplying water and detergent into a tub and a drum and by rotating the drum in which the laundry is placed. In the washing machine, water from an external water source is supplied into the tub or the drum, and a pump is used to circulate the water in the tub to the drum or to discharge the water in the tub to the outside. The washing machine is generally installed in the kitchen or the utility room for the supply and discharge of water.

The washing machine separately includes a heater for heating air, a blower fan, and a steam generator, to dry or sterilize the laundry.

Korean Patent No. 10-2120993 discloses a dryer. The dryer may dry the laundry, placed in the drum, by heating air using a heating means and a blower fan and by supplying the heated air into the drum. The dryer is generally disposed adjacent to the washing machine, so as to dry the washed laundry and to allow a user to easily load the laundry containing moisture into the dryer.

By using the steam generator for generating steam and spraying the steam into the drum, the dryer may sterilize the laundry or may relieve wrinkles from the laundry. Water may be supplied into the dryer for generating the steam, and water not changed into steam may be reused or may be discharged to the outside. Further, in order to deodorize the dried laundry, the dryer may further have a deodorization function for filtering the circulated air.

Korean Patent No. 10-2254903 discloses a refresher. The refresher may perform functions, such as drying, deodorizing, de-wrinkling, de-static and/or sterilization (hereinafter referred to as "refreshing").

The refresher is used for treating clothes, such as suits and coats, which are frequently used by a user after washing. Generally, the user hangs the clothes, such as suits and coats, in a wardrobe. Accordingly, the refresher may be installed adjacent to the wardrobe, or may be installed instead of the wardrobe, in a dressing room, a living room, or a bedroom. Further, not only for the clothes or garments, the refresher may also be used for all washable items, such as shoes, socks, gloves, hats, scarves, etc., which are worn by users, as well as dolls, towels, blankets, etc., which are frequently used by users.

However, the existing laundry treating machines, which are installed in different spaces, have a problem in that users need to move the laundry items, which are sorted by the user, to the respective laundry treating machines performing corresponding laundry treating processes, thereby requiring a longer workflow, and making the laundry treating processes uncomfortable.

In addition, as the refresher is installed in a different place from the washing machine and the dryer, it is cumbersome for users to move the washed wet clothes or the dried clothes to the place where the refresher is installed.

Furthermore, each of the existing laundry treating machines for treating the laundry using hot air and steam separately requires water supply equipment, drainage equipment, an air heater, a steam generator, a pump, a blower fan, an air passage, a steam passage, etc., thereby causing a problem in that a space for receiving clothes is reduced. In addition, each of the machines includes the heater, the steam generator, etc., causing a problem in that costs and energy consumption of the entire system may increase.

Further, the existing laundry treating machines for treating the laundry by using hot air and steam are inefficient in that the laundry treating machines perform operations without considering cycles of other machines.

SUMMARY OF THE INVENTION

It is an object of the present disclosure to solve the above and other problems.

It is another object of the present disclosure to provide a laundry treating apparatus including a plurality of laundry treating machines.

It is yet another object of the present disclosure to provide a laundry treating apparatus including a washing machine, a dryer, and a refresher.

It is still another object of the present disclosure to provide a laundry treating apparatus capable of performing washing, drying, and refreshing of the laundry in the same space.

It is still another object of the present disclosure to provide a laundry treating apparatus capable of minimizing a user's workflow required for laundry treatment.

It is still another object of the present disclosure to provide a laundry treating apparatus capable of treating laundry which may not be subjected to high temperature drying in a space where washing and drying are performed.

It is still another object of the present disclosure to provide a laundry treating apparatus with improved workability in washing, drying, and refreshing of the laundry.

It is still another object of the present disclosure to provide a laundry treating apparatus capable of supplying hot air to the plurality of laundry treating machines using a single heating device.

It is still another object of the present disclosure to provide a laundry treating apparatus capable of supplying steam to the plurality of laundry treating machines using a single heating device.

It is still another object of the present disclosure to provide a laundry treating apparatus including a heating device that is operated based on a cycle status of at least one laundry treating machine.

It is still another object of the present disclosure to provide a laundry treating apparatus capable of minimizing the effect of a cycle status of any one laundry treating machine on the supply of hot air to another laundry treating machine.

It is still another object of the present disclosure to provide a laundry treating apparatus capable of supplying hot air suitable for operating conditions and loads of the respective laundry treating machines.

It is still another object of the present disclosure to provide a laundry treating apparatus capable of operating to efficiently supply hot air.

It is still another object of the present disclosure to provide a laundry treating apparatus capable of performing operation optimized for the operating conditions and loads of the respective laundry treating machines.

The objects of the present disclosure are not limited to the aforementioned objects and other objects not described herein will be clearly understood by those skilled in the art from the following description.

In order to achieve the above objects, a laundry treating apparatus according to the present disclosure includes a plurality of laundry treating machines. Further, the laundry treating apparatus may include a heating device for heating air supplied to the plurality of laundry treating machines.

Accordingly, the laundry treating apparatus according to the present disclosure may provide multi-purpose laundry treating machines in the same space, and may heat the air supplied to the plurality of laundry treating machines by using a single heating device.

In order to achieve the above objects, the laundry treating apparatus according to the present disclosure may minimize the effect of a cycle status of each laundry treating machine on another laundry treating machine.

In order to achieve the above objects, the laundry treating apparatus according to the present disclosure may include a heating device that is operated based on a cycle status of any one laundry treating machine. The heating device may be disposed in one of the laundry treating machines or may be disposed at an upper portion or a lower portion of the laundry treating machine.

The laundry treating machines may include: a dryer including a first cabinet, and a first drum rotatably mounted in the first cabinet and receiving laundry; a washing machine including a second cabinet, a tub disposed in the second cabinet, and a second drum rotatably mounted in the tub and receiving laundry; and a laundry care device including a third cabinet and having an inner space for receiving laundry.

The laundry care device may be a refresher.

The first to third cabinets may be formed independently of each other and may be connected to be integrally formed with each other, or two of the cabinets may be integrally formed with each other to be connected to another cabinet, or the three cabinets may be integrally formed with each other as a single body from the start.

Relative arrangement positions of the plurality of laundry treating machines included in the laundry treating apparatus may be changed.

In the laundry treating apparatus according to an embodiment of the present disclosure, the dryer and the washing machine may be vertically arranged, and the refresher may be disposed at least on one side of the dryer and the washing machine which are vertically arranged.

In this arrangement, vibrations and noise caused by the operation of the washing machine or the dryer may be absorbed and reduced by the refresher coupled to the lateral side thereof, and a relatively low level of vibrations and noise caused by the operation of the refresher may also be absorbed by the washing machine and the dryer, such that the refresher may be maintained in a silent state.

In accordance with an aspect of the present disclosure, the above and other objects can be accomplished by providing a laundry treating apparatus including: a dryer disposed in an indoor space; a washing machine vertically disposed with respect to the dryer; a refresher disposed on one side of the dryer and the washing machine; and a heating device heating air supplied to at least one of the dryer, the washing machine, and the refresher, wherein the heating device includes a plurality of compressors, and controls a number of compressors to be operated and an RPM of the operated compressors, according to a cycle status of the dryer, the washing machine, and the refresher.

The plurality of compressors may have different capacities.

The plurality of compressors may have different capacities and use different compression methods.

A total capacity of the plurality of compressors may be greater than a sum of loads of heated air required for cycles of the dryer, the washing machine, and the refresher, wherein among the plurality of compressors, a compressor may have a minimum capacity which may be greater than a minimum load value among the loads of the heated air required for the cycles of the dryer, the washing machine, and the refresher.

Among the dryer, the washing machine, and the refresher, in response to there being one laundry treating machine that requires the heated air, one compressor may be operated; and among the dryer, the washing machine, and the refresher, in response to there being two or more laundry treating machines that require the heated air, two compressors may be operated.

In response to a temperature condition of the heated air, which is required for the cycles of the dryer, the washing machine, and the refresher, being a first value, one compressor may be operated; and in response to a temperature condition of the heated air, which is required for the cycles of the dryer, the washing machine, and the refresher, being a second value that is greater than the first value, two compressors may be operated.

The number of compressors to be operated may vary according to a type of laundry treating machine that requires the heated air among the dryer, the washing machine, and the refresher.

The cycle status may include one or more of a type of a cycle performed by each laundry treating machine, a type of loaded laundry, and a temperature condition.

At least one of RPMs of the plurality of compressors when only one laundry treating machine performs a cycle, which requires air heated by the heating device among the cycles of the dryer, the washing machine, and the refresher, may be lower than the RPMs of the plurality of compressors when two or more laundry treating machines perform cycles which require the air heated by the heating device.

When the plurality of compressors are operated, the operated compressors may be turned off at different times.

A cooler may be disposed in a passage between the heating device and the refresher, and the cooler may be operated when the heated air is simultaneously supplied to the refresher and the other laundry treating machines.

The heating device may further include: an evaporator for dehumidifying air by heat exchange between introduced air and a low-temperature refrigerant; a condenser for heating air by heat exchange between a high-temperature refrigerant and air; and a fan for blowing the air heated by passing through the condenser.

The heating device may further include a switching device for controlling a direction of the air blown by the fan.

The laundry treating apparatus may further include flow control valves respectively disposed in a passage between the heating device and the dryer, a passage between the heating device and the washing machine, and a passage between the heating device and the refresher, wherein an opening degree of the flow control valves may be changed based on a temperature condition during cycles of laundry treating machines connected to the passages in which the flow control valves are disposed.

When only one of the plurality of compressors is operated, and the air heated by the heating device is supplied to any one laundry treating machine among the dryer, the washing machine, and the refresher, the flow control valve disposed in a passage supplied with the heated air may be opened to a maximum degree.

When only one of the plurality of compressors is operated, and the air heated by the heating device is supplied to two or more laundry treating machines among the dryer, the washing machine, and the refresher, the heating device may be operated based on a laundry treating machine that requires highest temperature air, and the flow control valve disposed in a passage connected to a laundry treating machine that requires air of a lower temperature than the highest temperature may be opened to a minimum degree. The opening degree of the flow control valve, which is opened to the minimum degree, may gradually increase.

When the air heated by the heating device is supplied to any one laundry treating machine among the dryer, the washing machine, and the refresher: the heating device may operate one or two compressors based on a temperature condition of the laundry treating machine supplied with the heated air, wherein the flow control valve disposed in a passage connected to the laundry treating machine supplied with the heated air may be opened in response to the temperature condition.

When the air heated by the heating device is supplied to two or more laundry treating machines among the dryer, the washing machine, and the refresher: the heating device may operate one or two compressors based on a highest temperature condition among temperature conditions of the laundry treating machines supplied with the heated air, wherein the flow control valve disposed in a passage connected to a laundry treating machine under a lower temperature condition than the highest temperature condition may be opened to a minimum degree, and then an opening degree of the flow control valve may gradually increase.

Effects of the Invention

According to at least one of the embodiments of the present disclosure, there is provided a laundry treating apparatus including a plurality of laundry treating machines.

According to at least one of the embodiments of the present disclosure, there is provided a laundry treating apparatus including a washing machine, a dryer, and a refresher.

According to at least one of the embodiments of the present disclosure, there is provided a laundry treating apparatus, in which the washing machine, the dryer, and the refresher are disposed in the same space, thereby performing washing, drying, and refreshing in the same space.

According to at least one of the embodiments of the present disclosure, there is provided a laundry treating apparatus, in which laundry may be treated in the same space regardless of the type of laundry.

According to at least one of the embodiments of the present disclosure, there is provided a laundry treating apparatus, in which when washing, drying, and refreshing are performed, a user's load (e.g., amount of work, workflow, etc.) for moving the laundry may be reduced.

According to at least one of the embodiments of the present disclosure, there is provided a laundry treating apparatus in which the refresher may treat laundry which may not be subjected to high temperature drying in the same space where washing and drying are performed.

According to at least one of the embodiments of the present disclosure, there is provided a laundry treating apparatus, in which the washing machine and the refresher share one surface, thereby reducing vibrations generated in the washing machine.

According to at least one of the embodiments of the present disclosure, hot air may be supplied to each of the washing machine, the dryer, and the refresher by using a single heating device.

According to at least one of the embodiments of the present disclosure, steam may be supplied to each of the washing machine, the dryer, and the refresher by using a single steam generator.

According to at least one of the embodiments of the present disclosure, there is provided a laundry treating apparatus capable of minimizing the effect of a cycle status of any one laundry treating machine on another laundry treating machine.

According to at least one of the embodiments of the present disclosure, there is provided a laundry treating apparatus including a heating device that is operated based on a cycle status of at least one laundry treating machine.

According to at least one of the embodiments of the present disclosure, there is provided a laundry treating apparatus capable of supplying hot air suitable for operating conditions and loads of the respective laundry treating machines.

According to at least one of the embodiments of the present disclosure, there is provided a laundry treating apparatus capable of efficiently generating and supplying hot air.

According to at least one of the embodiments of the present disclosure, there is provided a laundry treating apparatus capable of performing operation optimized for the operating conditions and loads of the respective laundry treating machines.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

FIGS. 16 to 21 are diagrams referred to in the description of a compressor included in a heating device according to an embodiment of the present disclosure.

DETAILED DESCRIPTION OF THE PREFERRED EMBODIMENTS

Figure 1:
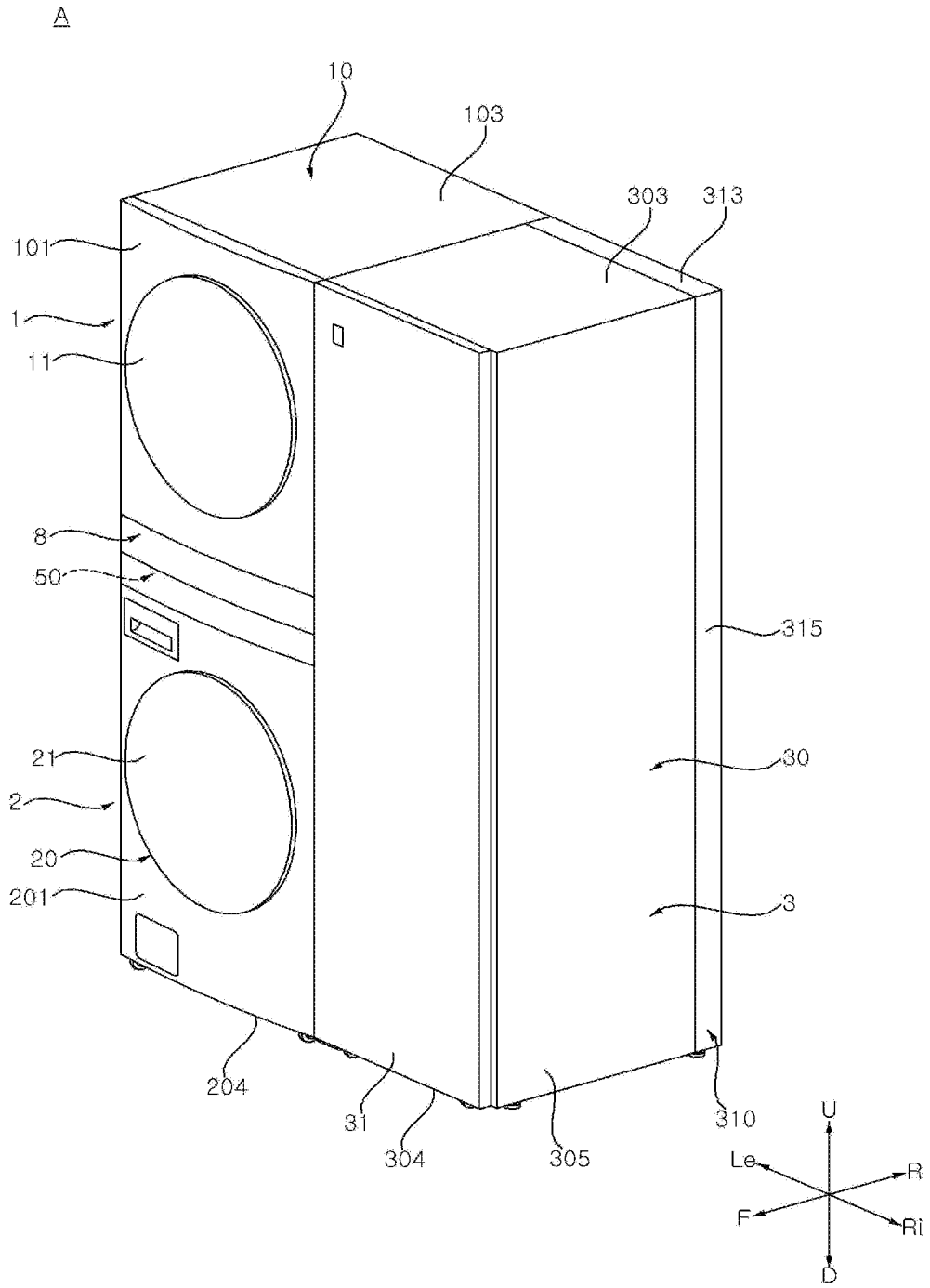
FIG. 1 is a perspective view of a laundry treating apparatus according to an embodiment of the present disclosure.

Hereinafter, the present disclosure will be described in detail with reference to the accompanying drawings, in which the same reference numerals are used throughout the drawings to designate the same or similar components, and a redundant description thereof will be omitted.

Terms "module" and "unit" for elements used in the following description are given simply in view of the ease of the description, and do not have a distinguishing meaning or role.

It will be noted that a detailed description of known arts will be omitted if it is determined that the detailed description of the known arts can obscure the embodiments of the invention. Further, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that, although the terms first, second, etc., may be used herein to describe various elements, these elements should not be limited by these terms. These terms are only used to distinguish one element from another.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, the singular forms are intended to include the plural forms as well, unless the context clearly indicates otherwise.

Hereinafter, an outward appearance of a laundry treating apparatus A will be described below with reference to FIG. 1.

The laundry treating apparatus A according to embodiments of the present disclosure may include one or more laundry treating machines. The laundry treating machines refer to devices for washing, drying, and/or refreshing objects (e.g., clothes, towels, bedding, etc.).

The laundry treating apparatus A may include a plurality of laundry treating machines of the same type. For example, the laundry treating apparatus A may include two or more dryers 1. For example, the laundry treating apparatus A may include two or more washing machines 2. For example, the laundry treating apparatus A may include two or more refreshers 3.

The laundry treating apparatus A may include different types of laundry treating machines. For example, the laundry treating apparatus may include the dryer 1, the washing machine 2, and the refresher 3.

The laundry treating apparatus A may include a plurality of the same type of laundry treating machines and laundry treating machines which are of different types. For example, the laundry treating apparatus A may include two or more washing machines, one dryer, and one refresher. For example, the laundry treating apparatus A may include one washing machine, one dryer, and two or more refreshers.

The laundry treating apparatus A of the present disclosure is not limited to the type and number of the laundry treating machines and may include various combinations thereof. The following description will be given of an example in which the laundry treating apparatus A includes one dryer 1, one washing machine 2, and one refresher 3, but the present disclosure is not limited thereto.

The dryer 1, the washing machine 2, and the refresher 3 may be referred to as any one of first to third laundry treating machines, respectively. For example, the dryer 1 may be referred to as the "first laundry treating machine," the washing machine 2 may be referred to as the "second laundry treating machine," and the refresher 3 may be referred to as the "third laundry treating machine."

The laundry treating apparatus A may include a controller 81 (see FIG. 2) for controlling operation of a dryer 1, a washing machine 2, a refresher 3, and a heating device 50. The controller 81 may be mounted on a Printed Circuit Board (PCB). The controller 81 may control the dryer 1, the washing machine 2, the refresher 3, and the heating device 50 based on an electrical signal received from a control panel 8 which will be described below. The controller 81 may communicate with the control panel 8.

The dryer 1 and the washing machine 2 may be vertically disposed. The control panel 8 may be disposed between the dryer 1 and the washing machine 2. The control panel 8 and the refresher 3 may be vertically disposed.

A user may input a command to the laundry treating apparatus A through the control panel 8. By operating the control panel 8, the user may control the operations of the dryer 1, the washing machine 2, and the refresher 3. By operating the control panel 8, the user may control the operation of the heating device 50. The control panel 8 may transmit an electrical signal, input by the user's operation, to the controller 81.

A space for providing the PCB may be formed in the control panel 8. A controller may be mounted on the PCB. The controller may be the controller 81.

Alternatively, the controller may be disposed on a rear surface of the control panel 8. The space for providing the PCB may be formed on the rear surface of the control panel 8. The controller 81 may be mounted on the PCB.

Alternatively, at least some of the washing machine 2, the dryer 1, the refresher 3, and a machine room S may include respective controllers for controlling each operation thereof. Even in this case, the respective controllers may be mounted on the PCB. The respective controllers may communicate with each other. In some cases, at least one controller may be an upper level controller that may control other controllers and devices.

The control panel 8 may display an operating state of the laundry treating apparatus A. The user may check information on the operating state of the laundry treating apparatus A through the control panel 8.

The laundry treating apparatus A may include the heating device 50. The heating device 50 may supply hot air to the dryer 1. The heating device 50 may supply hot air to the refresher 3. The heating device 50 may supply hot air to the washing machine 2. The hot air, supplied to the respective laundry treating machines, may be drawn into the heating device 50 again for circulation.

However, without circulating the hot air supplied to each of the washing machine 2, the dryer 1, and the refresher 3, the laundry treating apparatus of the present disclosure may discharge the hot air to the outside. That is, the laundry treating apparatus of the present disclosure may discharge the hot air supplied to a tub 23 of the washing machine 2 to the outside of the washing machine 2, may discharge the hot air supplied to a first drum 13 of the dryer 1 to the outside of the dryer 1, and may discharge the hot air supplied to an inner space 33 of the refresher 3 to the outside of the refresher 3.

Figure 2:
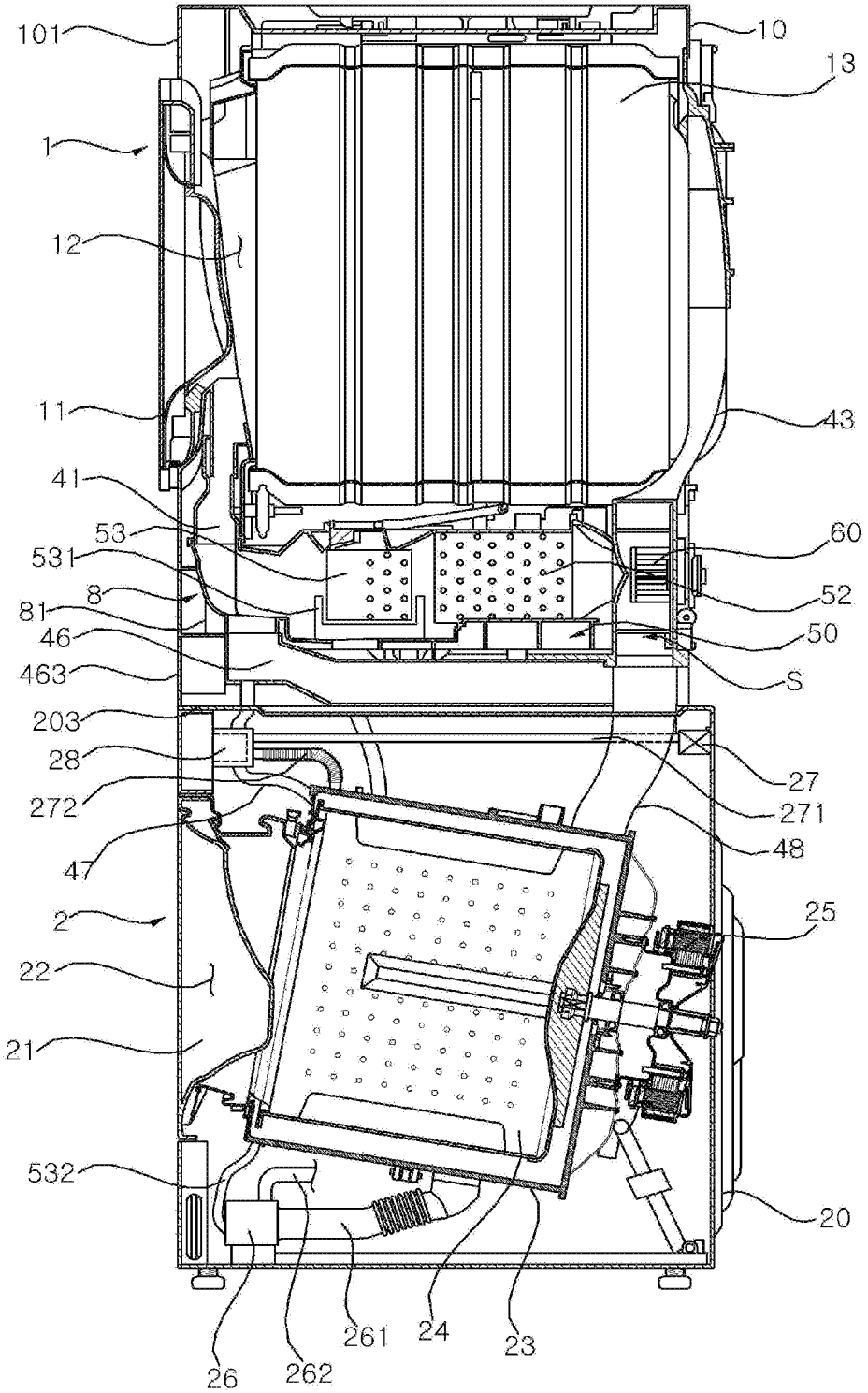
FIG. 2 is a first longitudinal cross-sectional view of the laundry treating apparatus illustrated in FIG. 1.

The laundry treating apparatus A may include the machine room S (see FIG. 2). The machine room S may provide a space in which the heating device 50 is disposed. The machine room S may be a concept that refers to a space in which the heating device 50 and components other than the heating device 50 are disposed. A pump, a blower fan, an air passage, a steam device, a steam passage, a dehumidification device, a controller, a motor, a fan housing, etc., in addition to the heating device 50, may be disposed in the machine room S. The machine room S may provide the space in which the aforementioned movable elements (a pump, a blower fan, an air passage, a steam device, a steam passage, a dehumidification device, a controller, a motor, and a fan housing) are disposed.

In the present disclosure, the machine room S may refer to the space in which the heating device 50 is disposed or may be an upper concept that encompasses the heating device 50.

The machine room S may include a separate case. When the machine room S includes the separate case, the machine room S may be separated from a first cabinet 10 and a second cabinet 20. Unlike the example, the machine room S may be disposed in any one of first to third cabinets 10, 20, and 30. In the case where the machine room S is disposed in any one of the first to third cabinets 10, 20, and 30, the machine room S may be a concept that refers to a space in which various components including the heating device 50 are disposed. That is, in the case where the machine room S is disposed in any one of the first to third cabinets 10, 20, and 30, the machine room S may refer to a portion of the inner space of the first to third cabinets 10, 20, and 30.

The machine room S may be vertically disposed with respect to the washing machine 2 and the dryer 1. The machine room S may be disposed over the washing machine 2 and the dryer 1. The machine room S may be disposed between the washing machine 2 and the dryer 1. The machine room S may be disposed under the washing machine 2 and the dryer 1. Unlike the example, the machine room S and the refresher 3 may be vertically disposed. The machine room S may be disposed over or under of the refresher 3.

The heating device 50 may supply hot air to the washing machine 2. The heating device 50 may recover the hot air supplied to the washing machine 2.

The heating device 50 may supply hot air to the dryer 1. The heating device 50 may recover the hot air supplied to the dryer 1.

The heating device 50 may supply hot air to the refresher 3. The heating device 50 may recover the hot air supplied to the refresher 3.

The heating device 50 may supply steam to the washing machine 2. The heating device 50 may supply steam to the dryer 1. The heating device 50 may supply steam to the refresher 3.

The heating device 50 may include a heat pump device. The heat pump device may include a compressor 51, a condenser 52, an evaporator 53, and an expansion device 54 (see FIG. 5). The heating device 50 may include a fan 60 (see FIG. 5). The heat pump device may be referred to as a "heat exchange unit."

Figure 5:
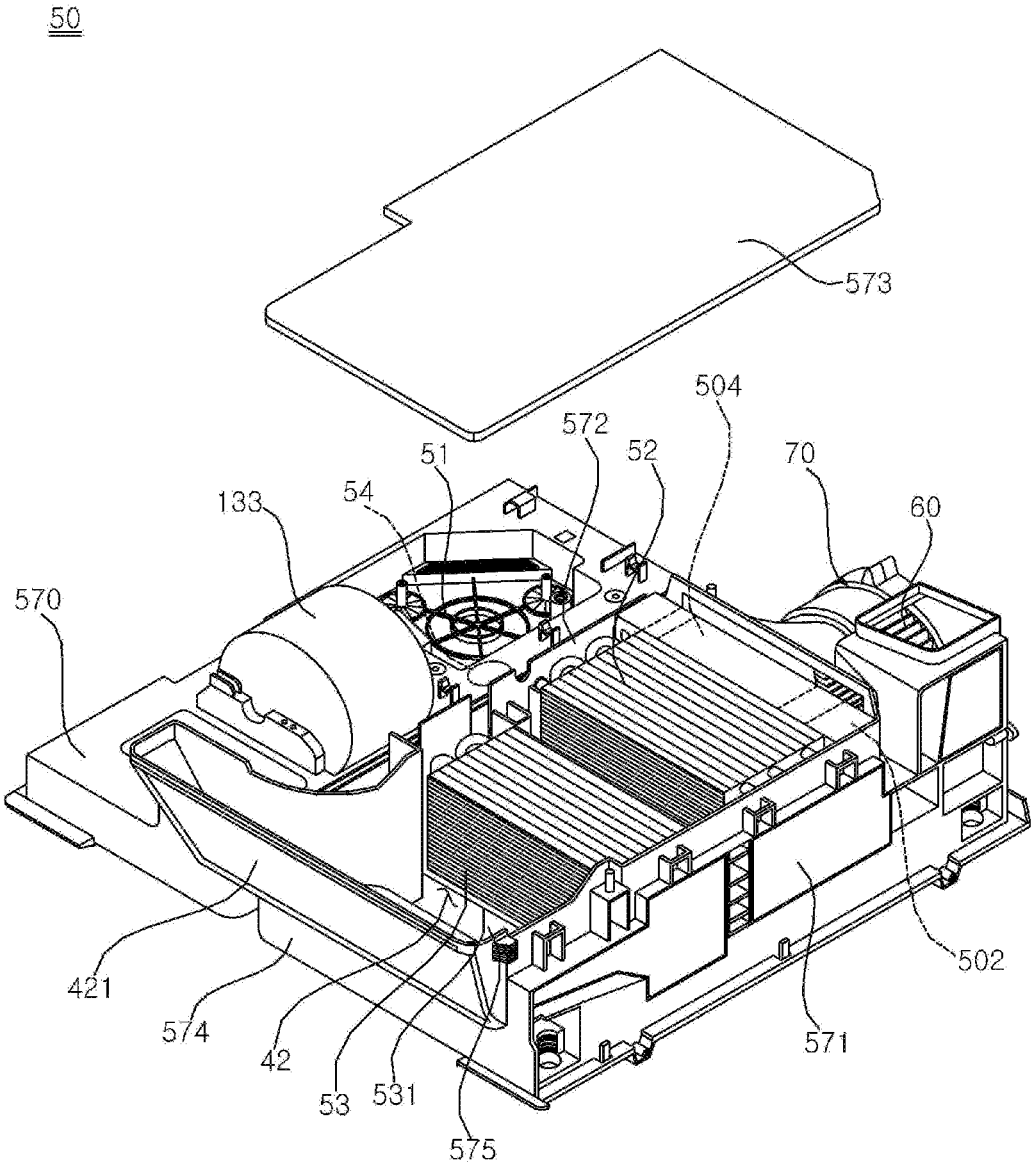
FIG. 5 is a perspective view of a heating device according to an embodiment of the present disclosure.

The heating device 50 may include a heat exchange unit for heating air flowing through a heat exchange channel 42 (see FIG. 5). The heat exchange unit may be a heat pump device connected by a refrigerant passage. The heat exchange unit may be a heater that operates using electricity as power. The heat exchange unit may be a heating device. The heat exchange unit may include the heater and a cooler. The cooler may be disposed on an upstream side of the heater. The cooler may be disposed in the heat exchange channel 42. The cooler may dehumidify and cool air passing through the heat exchange channel 42.

The heating device 50 may be vertically disposed with respect to the washing machine 2 and the dryer 1. The heating device 50 may be disposed over the washing machine 2 and the dryer 1, may be disposed between the washing machine 2 and the dryer 1, or may be disposed under the washing machine 2 and the dryer 1.

The heating device 50 and the refresher 3 may be vertically disposed. The heating device 50 may be disposed in a rear space of the refresher 3.

The heating device 50 may be disposed in the first cabinet 10. The heating device 50 may also be disposed in the second cabinet 20. The heating device 50 may also be disposed in the third cabinet 30.

The washing machine 2, the dryer 1, and the heating device 50 (or the machine room S) may be vertically arranged, and the refresher 3 may be disposed on a lateral side of the washing machine 2 and the dryer 1. The heating device 50 may be disposed on a lateral side of the refresher 3.

As illustrated in FIG. 1, the following description will be given of an example in which the dryer 1 is disposed over the washing machine 2, and the heating device 50 is disposed between the washing machine 2 and the dryer 1. However, a vertical arrangement of the washing machine 2, the dryer 1, and the heating device 50 is not limited thereto.

The refresher 3 may be disposed on a lateral side of the washing machine 2 and the dryer 1. For example, as illustrated in FIG. 1, the refresher 3 may be disposed on the right side of the washing machine 2 and the dryer 1. However, an arrangement position of the refresher 3 is not limited to the above example, and the refresher 3 may be disposed on the left side of the washing machine 2 and the dryer 1.

A longitudinal width of the refresher 3 may be smaller than a longitudinal width of the washing machine 2 and the dryer 1.

A rear case 310, in which a hot air passage or a steam passage which will be described later is disposed, may be disposed at a rear side of the refresher 3.

The washing machine 2 may include a second cabinet 20 having a second laundry loading opening 22 (see FIG. 2) formed on a front surface thereof, and a second door 21 rotatably coupled to the second cabinet 20.

By rotating the second door 21, a user may open the second laundry loading opening 22 and may put the laundry into a second drum 24 through the second laundry loading opening 22.

The dryer 1 may include the first cabinet 10 having a first laundry loading opening 12 (see FIG. 2) formed on a front surface thereof, and a first door 11 rotatably coupled to the first cabinet 10.

By rotating the first door 11, the user may open the first laundry loading opening 12 and may put the laundry into the first drum 13 through the first laundry loading opening 12.

The refresher 3 forms a space in which the laundry is placed, and includes a third cabinet 30 having a third laundry loading opening 32 (see FIG. 3) and a third door 31 rotatably coupled to the third cabinet 30. The third laundry loading opening 32 may be referred to as an "opening."

By rotating the third door 31, the user may open the third laundry loading opening 32 and may load the laundry into the third cabinet 30 through the third laundry loading opening 32.

Each of the first cabinet 10, the second cabinet 20, and the third cabinet 30 may include an upper panel, a lower panel, a front panel, a rear panel, and side panels.

The first cabinet 10 may include a first upper panel 103, a first lower panel 104, a first front panel 101, a first rear panel 102, and first side panels 105 and 106.

The second cabinet 20 may include a second upper panel 203, a second lower panel 204, a second front panel 201, a second rear panel 202, and second side panels 205 and 206.

The third cabinet 30 may include a third upper panel 303, a third lower panel 304, a third front panel 301, a third rear panel 302, and third side panel 305. The third cabinet 30 may include the third door 31 instead of the third front panel 301.

A plate may be disposed in a space between the washing machine 2 and the refresher 3 and in a space between the dryer 1 and the refresher 3. The plate may be a damping material. The dryer 1, the washing machine 2, and the refresher 3 may be coupled to each other by the plate.

The first upper panel 103 of the dryer 1 and the third upper panel 303 of the refresher 3 may be disposed on the same horizontal plane. The third upper panel 303 of the refresher 3 and an upper wall 313 of the rear case 310 may be disposed on the same horizontal plane.

The third side panel 305 of the refresher 3 and the side wall 315 of the rear case 310 may be disposed on the same plane.

The front panel 201 of the washing machine 2, the front panel 101 of the dryer 1, and the control panel 8 may be disposed on the same plane.

The third door 31 of the refresher 3 may be disposed on the same plane as the front panel 201 of the washing machine 2, the front panel 101 of the dryer 1, and the control panel 8. Alternatively, the third door 31 of the refresher 3 may be disposed on the same plane as the second door 21 of the washing machine 2 and the first door 11 of the dryer 1.

The second lower panel 204 of the washing machine 2 and the third lower panel 304 of the refresher 3 may be disposed on the same horizontal plane.

Hereinafter, an internal structure of the dryer 1, the washing machine 2, and the heating device 50 will be described with reference to FIG. 2. FIG. 2 is a diagram illustrating an internal structure of the dryer 1, the washing machine 2, and the heating device 50 which are cut in a longitudinal direction.

The washing machine 2 includes the second cabinet 20, the second door 21 rotatably coupled to the second cabinet 20, the tub 23 disposed in the second cabinet 20, a second drum 24, which is rotatably disposed in the tub 23 and in which laundry is received, a motor 25 for transmitting power to the second drum 24, a drain pump 26 for discharging water, generated in the laundry treating apparatus A, to the outside, a water supply valve 27 connected to an external water source, and a drawer 28 in which detergent is stored.

The drain pump 26 may be connected to the tub 23 by a first pipe 261. The drain pump 26 may discharge water, introduced through the first pipe 261 and a drain pipe 532, to the outside of the laundry treating apparatus A through a second pipe 262.

The water supply valve 27 may open and close water supply lines 278 and 279 (see FIG. 11) connecting the external water source and the washing machine 2. The water supply valve 27 may control a flow rate of water flowing into the washing machine 2 from the external water source. The water supply valve 27 may be connected to a first water supply pipe 271. The first water supply pipe 271 may be connected to the drawer 28 in which the detergent is stored. The water flowing into the drawer 28 through the first water supply pipe 271 may flow into the tub 23 along with the detergent in the drawer 28 through a second water supply pipe 272.

The dryer 1 includes the first cabinet 10, the first door 11 rotatably coupled to the first cabinet 10, and the first drum 13 which is rotatably mounted in the first cabinet 10 and in which the laundry is received.

The dryer 1 may include a motor 133 (see FIG. 5) for rotating the first drum 13. A pulley may be fixed to a rotating shaft of the motor 133. A belt may connect the pully with a circumferential surface of the drum 13, such that torque of the motor 133 may be transferred to the drum 13 via the pulley and the belt.

The motor 133 may be disposed under the first drum 13. The motor 133 may be disposed in the heating device 50. The motor 133 may be disposed on a lateral side of the heat exchange channel 42. A motor mounting portion 133*s* (see FIG. 6) may be provided in a case 570 (see FIG. 5) of the heating device 50.

Unlike the example, the motor 133 may be directly coupled to the first drum 13 to rotate the first drum 13.

The heating device 50 may be disposed over the second upper panel 203. The heating device 50 may be disposed in the first cabinet 10.

The heating device 50 includes: a condenser 52 for performing heat exchange between a high-temperature refrigerant and air to heat the air; a fan 60 for blowing air heated by passing through the condenser 52; and an evaporator 53 for performing heat exchange between the air flowing into the heating device 50 and a low-temperature refrigerant to cool and dehumidify the air. The condenser 52 and the evaporator 53 may be referred to as a "heat exchange unit."

The air heated by passing through the condenser 52 (hereinafter referred to as "hot air") may be blown by the fan 60, and may be supplied to at least one of the washing machine 2, the dryer 1, or the refresher 3.

The heating device 50 may be connected to the first drum 13 by a first supply air duct 43. The hot air generated by the heating device 50 may be blown by the fan 60 to be supplied into the first drum 13 through the first supply air duct 43. The first supply air duct 43 may extend upwardly from the heating device 50.

The heating device 50 may be connected to the tub 23 by a third supply air duct 48. The hot air generated by the heating device 50 may be blown by the fan 60 to be supplied into the tub 23 through the third supply air duct 48. The third supply air duct 48 may extend downwardly from the heating device 50.

The hot air generated by the heating device 50 may be blown by the fan 60 to be supplied to the outside of the laundry treating apparatus A through a dehumidification duct 46. The dehumidification duct 46 may be disposed between a base plate 575 to be described below and the second upper panel 203. The air blown by the fan 60 may be supplied into an indoor space through the dehumidification duct 46. An opening member 463 may be disposed at a front side of the dehumidification duct 46. The opening member 463 may open and close the front side of the dehumidification duct 46. The opening member 463 may be rotatably coupled to the first cabinet 10 or the second cabinet 20.

The supply air ducts 43, 45, and 48 may be referred to as any one of first to third supply air ducts. For example, the supply air duct connected to the dryer 1 may be referred to as a first supply air duct 43; the supply air duct connected to the refresher 3 may be referred to as a second supply air duct 45, and the supply air duct connected to the washing machine 2 may be referred to as a third supply air duct 48. The supply air ducts 43, 45, and 48 may be referred to as "supply ducts." The respective first, second, and third supply air ducts 43, 45, and 48 may be referred to as any one of the "first to third supply ducts." For example, the first supply air duct 43 may be referred to as a first supply duct; the second supply air duct 45 may be referred to as a second supply duct; and the third supply air duct 48 may be referred to as a third supply duct. The supply air ducts 43, 45, and 48 may be referred to as "supply pipes." The respective first, second, and third supply air ducts 43, 45, and 48 may be referred to as any one of the "first to third supply pipes." For example, the first supply air duct 43 may be referred to as a first supply pipe; the second supply air duct 45 may be referred to as a second supply pipe; and the third supply air duct 48 may be referred to as a third supply pipe.

The air supplied to the washing machine 2, the dryer 1, or the refresher 3 may be recovered to the heating device 50.

The heating device 50 may be connected to the first drum 13 by a first exhaust air duct 41. The hot air flowing into the first drum 13 through the first supply air duct 43 may dry the laundry placed in the first drum 13, and then may return to the heating device 50 through the first exhaust air duct 41. The first exhaust air duct 41 may extend downwardly from the first drum 13.

The heating device 50 may be connected to the tub 23 by a third exhaust air duct 47. The hot air flowing into the tub 23 through the third supply air duct 48 may dry the laundry placed in the second drum 24, and then may return to the heating device 50 through the third exhaust air duct 47. The third exhaust air duct 47 may extend upwardly from the tub 23.

The exhaust air ducts 41, 44, and 47 may be referred to as any one of first to third exhaust air ducts. For example, the exhaust air duct connected to the dryer 1 may be referred to as a first exhaust air duct 41; the exhaust air duct connected to the refresher 3 may be referred to as a second exhaust air duct 44; and the exhaust air duct connected to the washing machine 2 may be referred to as a third exhaust air duct 47. The exhaust air ducts 41, 44, and 47 may be referred to as "discharge ducts" or "return ducts." The respective first, second, and third exhaust air ducts 41, 44, and 47 may be referred to as any one of "first to third discharge ducts." For example, the first exhaust air duct 41 may be referred to as a first discharge duct, the second exhaust air duct 44 may be referred to as a second discharge duct, and a third exhaust air duct 47 may be referred to as a third discharge duct. The respective first, second, and third exhaust air ducts 41, 44, and 47 may be referred to as any one of "first to third return ducts." For example, the first exhaust air duct 41 may be referred to as a first return duct, the second exhaust air duct 44 may be referred to as a second return duct, and a third exhaust air duct 47 may be referred to as a third return duct. The respective first, second, and third exhaust air ducts 41, 44, and 47 may be referred to as any one of "first to third return lines." For example, the first exhaust air duct 41 may be referred to as a first return line, the second exhaust air duct 47 may be referred to as a second return line, and a third exhaust air duct 44 may be referred to as a third return line.

The hot air generated by the heating device 50 may be supplied to the washing machine 2, the dryer 1, and the refresher 3 (which may also hereinafter be referred to as devices, laundry treating devices, or laundry treating machines) to dry the laundry placed in the respective laundry treating machines 1, 2, and 3, and then may return to the heating device 50. That is, the hot air generated in the heating device 50 may circulate within the laundry treating apparatus A. The hot air, returning to the heating device 50 after drying the laundry placed in each of the laundry treating machines 1, 2, and 3, may contain a greater amount of moisture than the air for drying the laundry placed in one laundry treating machine.

By performing heat exchange between the air returning to the heating device 50 and a refrigerant, the evaporator 53 may reduce the temperature of the returning air and removes moisture contained in the air. The air returning to the heating device 50 may be heat exchanged with the evaporator 53 to generate condensate.

The heating device 50 may include a drain pan 531 disposed under the evaporator 53. The drain pan 532 may receive the condensate generated in the evaporator 53.

The drain pan 531 may be connected to the drain pump 26 by the drain pipe 532. The drain pipe 532 may extend downwardly from the drain pan 531 to be connected to the drain pump 26.

The condensate collected in the drain pan 531 may flow to the drain pump 26 through the drain pipe 532, and may be discharged to the outside of the laundry treating apparatus A by the drain pump 26.

Figure 3:
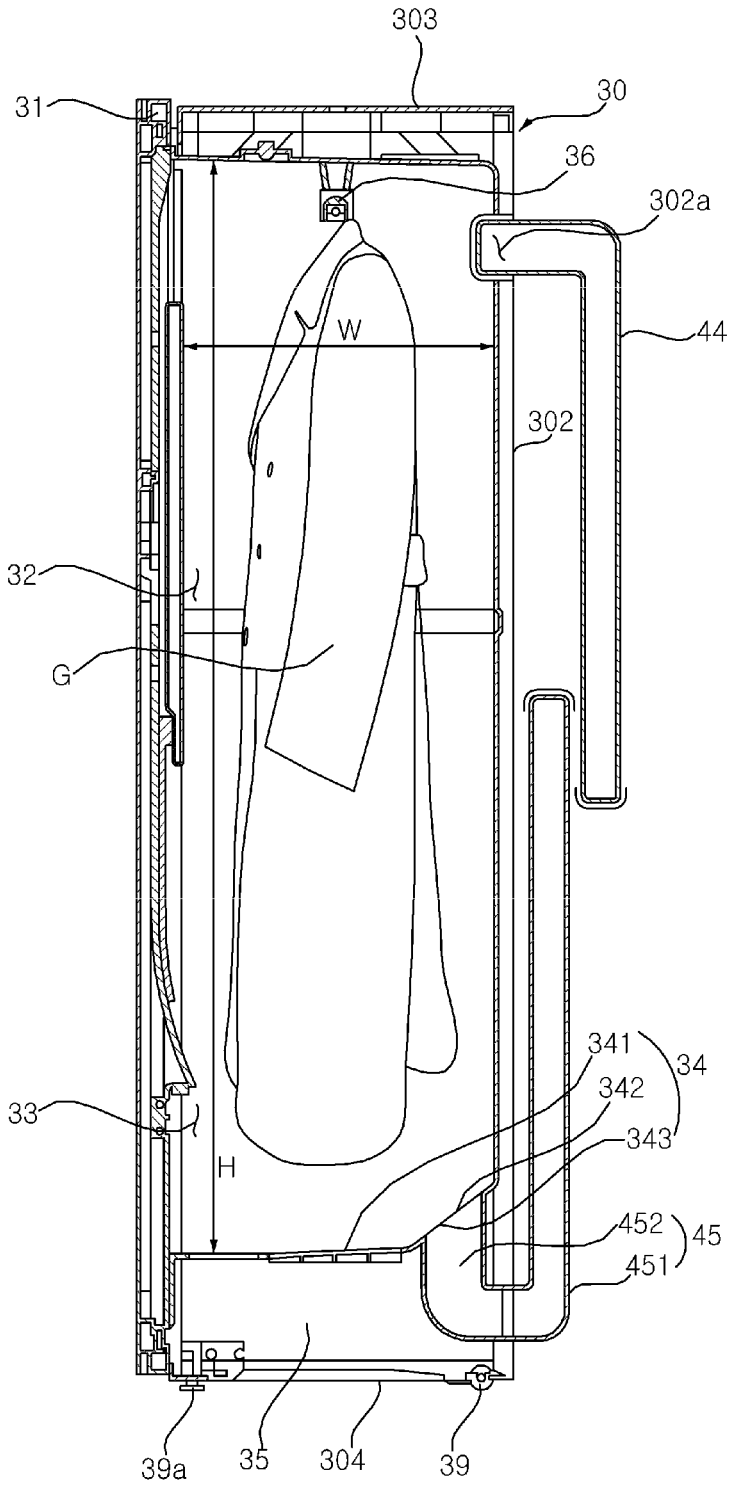
FIG. 3 is a second longitudinal cross-sectional view of the laundry treating apparatus illustrated in FIG. 1.

Hereinafter, an internal structure of the refresher 3 will be described with reference to FIG. 3. FIG. 3 is a diagram illustrating an internal structure of the refresher 3 of the laundry treating apparatus A which is cut in a longitudinal direction.

The refresher 3 may include the third cabinet 30 having an inner space for receiving laundry.

The refresher 3 may include a hanger 36, on which clothing is hung, and an inner panel 34 defining a lower portion of a space 33 in which clothing is placed.

The hanger 36 may be disposed between the third upper panel 303 and the third lower panel 304, and may be disposed closer to the third upper panel 303 than the third lower panel 304.

The inner panel 34 may be disposed between the third upper panel 303 and the third lower panel 304, and may be disposed closer to the third lower panel 304 than the third upper panel 303.

Garments G placed in the inner space 33 of the third cabinet 30 may be located between the hanger 36 and the inner panel 34.

The height H of the inner space 33 may refer to a height between the hanger 36 and the inner panel 34. The height H of the inner space 33 may be extended compared to a case where the heating device 50 is disposed between the inner panel 34 and the third lower panel 304. Accordingly, unlike an existing refresher, the refresher 3 of the present disclosure may receive garments G having a great vertical height, such as long coats or suits.

In addition, compared to the existing refresher, the refresher 3 of the present disclosure may have a longitudinal width which may be extended according to the longitudinal width of the washing machine 2 and the dryer 1. Accordingly, the refresher 3 of the present disclosure may receive a larger number of garments in the front-rear direction than the existing refresher. The longitudinal width W of the refresher 3 may refer to a width between the third door 31 and the third rear panel 302.

A storage space 35 may be formed between the inner panel 34 and the third lower panel 304. Relatively small clothing items, such as socks, underwear, hats, scarves, gloves, etc., may be placed in the storage space 35.

The inner panel 34 may be connected to the second supply air duct 45. The third cabinet 30 may be connected to the second exhaust air duct 44.

The inner panel 34 may include a first inner panel 341 spaced from an upper side of the third lower panel 304, and a second inner panel 342 extending diagonally upwardly from the first inner panel 341. The second inner panel 342 may extend diagonally upwardly from the first inner panel 341 toward the third rear panel 302.

The second supply air duct 45 may be connected to the second inner panel 342. The second inner panel 342 may have a supply air hole 343 that is open toward the inner space 33. The second supply air duct 45 may be connected to the supply air hole 343. The hot air supplied from the heating device 50 may be discharged into the inner space 33 through the supply air hole 343.

The second supply air duct 45 may include a first hot air duct 451 disposed at a rear side of the third rear panel 302, and a second hot air duct 453 disposed at a front side of the third rear panel 302.

The first hot air duct 451 may be disposed in the rear case 310. A second hot air duct 452 may be disposed in the storage space 35. The first hot air duct 451 and the second hot air duct 452 may be coupled to the third rear panel 302. The first hot air duct 451 may extend upwardly in the rear case 310 to be connected to the heating device 50. The second hot air duct 452 may extend upwardly to be connected to the second inner panel 342.

The second exhaust air duct 44 may be connected to the third rear panel 302. The third rear panel 302 may have an exhaust air hole 302*a* that is open toward the inner space 33. The second exhaust air duct 44 may be coupled to the third rear panel 302 so as to correspond to the exhaust air hole 302*a*. The hot air discharged into the inner space 33 of the refresher 3 may dry the garments G, and then may flow into the second exhaust air duct 44 through the exhaust air hole 302*a*.

The second exhaust air duct 44 may pass through the third rear panel 302 to extend into the rear case 310. After passing through the third rear panel 302, the second exhaust air duct 44 may extend downwardly in the rear case 310 to be connected to the heating device 50.

The refresher 3 may include rollers 39 and legs 39*a* protruding downwardly from the third lower panel 304. A plurality of rollers 39 may be disposed which are spaced apart from each other in the front-rear direction. A roller structure of the refresher 3 may also be applied to the second lower panel 204 of the washing machine 2. The rollers of the washing machine 2 and the refresher 3 may serve to support the weight of the laundry treating apparatus A when the laundry treating apparatus A is moved.

Figure 4:
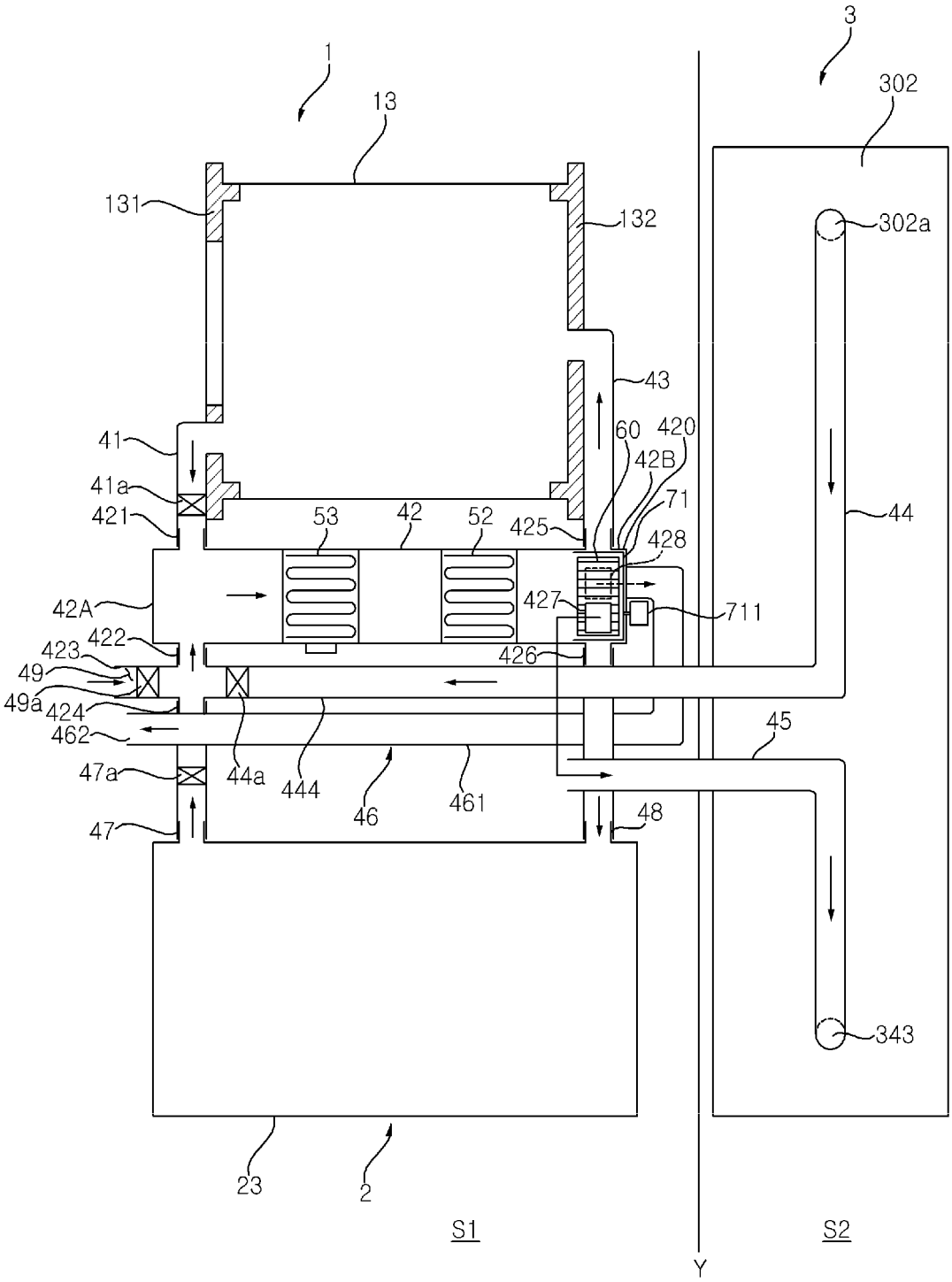
FIG. 4 is a conceptual diagram illustrating a duct system according to an embodiment of the present disclosure.

Hereinafter, a duct system in the laundry treating apparatus A according to the present disclosure will be described with reference to FIG. 4. In FIG. 4, a left side of a reference line Y shows a duct system of the dryer 1 and the washing machine 2, and a right side of the reference line Y shows a duct system of the refresher 3. The left side of the reference line Y in FIG. 4 is a conceptual view illustrating a duct system in which the dryer 1 and the washing machine 2 are cut by a plane perpendicular to a left and right direction; and the right side of the reference line Y in FIG. 4 is a conceptual view of a rear surface of the refresher 3 to show the duct system. The directions used in the description of FIG. 4 may be the same as those illustrated in FIG. 1.

The left side of the reference line Y in FIG. 4 may be referred to as a first conceptual view S1. The right side of the reference line Y in FIG. 4 may be referred to as a second conceptual view S2.

The "duct system" may be a concept that collectively refers to passages of hot air circulating in the laundry treating apparatus A. The "duct system" may be a concept that collectively refers to passages connecting the heating device 50, the dryer 1, the washing machine 2, and the refresher 3. The "duct system" may be a concept that collectively refers to passages of air heated by the heating device 50.

The heating device 50 heats air and supplies the heated air to each of the dryer 1, the washing machine 2, and the refresher 3.

The duct system may include the heat exchange channel 42 in which the air is heated. The duct system may include the first supply air duct 43 connecting the heating device 50 and the dryer 1. The duct system may include the second supply air duct 45 connecting the heating device 50 and the refresher 3. The duct system may include the third supply air duct 48 connecting the heating device 50 and the washing machine 2. The duct system may include the dehumidification duct 46 connected to the heating device 50. The air heated by passing through the heat exchange channel 42 is blown by the fan 60 to be supplied to at least any one of the first supply air duct 43, the second supply air duct 45, the third supply air duct 48, and the dehumidification duct 46.

The duct system may include the first exhaust air duct 41 connecting the heating device 50 and the dryer 1. The duct system may include the second exhaust air duct 44 connecting the heating device 50 and the refresher 3. The duct system may include the third exhaust air duct 47 connecting the heating device 50 and the washing machine 2. The heated air supplied to the dryer 1 may flow into the heat exchange channel 42 through the first exhaust air duct 41. The heated air supplied to the refresher 3 may flow into the heat exchange channel 42 through the second exhaust air duct 44. The heated air supplied to the washing machine 2 may flow into the heat exchange channel 42 through the third exhaust air duct 47.

The heat exchange channel 42, through which the air flows, may be provided in the heating device 50. The heating device 50 may include a heat exchange unit disposed in the heat exchange channel 42. The heat exchange unit may heat the air flowing in the heat exchange channel 42. The heat exchange unit may include the condenser 52 and the evaporator 53.

The laundry treating apparatus A may include the fan 60. The fan 60 may blow the air in the heat exchange channel 42. The fan 60 may be disposed on a downstream side of the condenser 52. The air, heated by heat exchange with the evaporator 53 and the condenser 52, may be blown by the fan 60. The fan 60 may be disposed in the heat exchange channel 42.

The air blown by the fan 60 may be supplied to at least any one of the dryer 1, the washing machine 2, the refresher 3, and the dehumidification duct 46.

The laundry treating apparatus A may include a blowing duct 420 surrounding the fan 60. The duct system may include the blowing duct 420. The fan 60 may be disposed in the blowing duct 420.

An inner space of the blowing duct 420 may be a portion of the heat exchange channel 42.

The fan 60 and the blowing duct 420 may be disposed at a discharge end 42B of the heat exchange channel 42. The discharge end 42B may be disposed at a downstream side of the condenser 52 and the evaporator 53.

The blowing duct 420 may include a first discharge port 425 connected to the first supply air duct 43. The blowing duct 420 may include a second discharge port 427 connected to the second supply air duct 45. The blowing duct 420 may include a third discharge port 426 connected to the third supply air duct 48. The blowing duct 420 may include a fourth discharge port 428 connected to the dehumidification duct 46.

The first discharge port 425 may protrude upwardly from the blowing duct 420. The first supply air duct 43 may connect the first drum 13 and the first discharge port 425.

The second discharge port 427 may protrude from the blowing duct 420 to a lateral side. The second supply air duct 45 may connect the third cabinet 30 and the second discharge port 427.

The third discharge port 426 may protrude downwardly from the blowing duct 420. The third supply air duct 48 may connect the tub 23 and the third discharge port 426.

The fourth discharge port 428 may protrude from the blowing duct 420 to the lateral side. The fourth discharge port 428 may protrude in a direction opposite to the second discharge port 427. The dehumidification duct 46 may be connected to the fourth discharge port 428.

A rotating body 71 of a switching device 70 (see FIG. 6) which will be described later may be disposed in the blowing duct 420. The rotating body 71 may be connected to a driving motor 711 to be rotated in the blowing duct 420. The air blown by the fan 60 may flow into at least any one of the first supply air duct 43, the second supply air duct 45, the third supply air duct 48, and the dehumidification duct 46 by the operation of the switching device 70.

The laundry treating apparatus A of the present disclosure may also include a separate distribution device in addition to the switching device 70 which will be described later. The distribution device may distribute the air blown by the fan 60 to each of the dryer 1, the washing machine 2, the refresher 3, and the dehumidification duct 46. In addition, by the distribution device, the air blown by the fan 60 may be supplied at the same time to each of the dryer 1, the washing machine 2, the refresher 3, and the dehumidification duct 46. The distribution device may be disposed in the blowing duct 420 or may be disposed in a distribution passage connected to the blowing duct 420. The distribution device may be a valve. The distribution device may include an actuator and a switching damper. The laundry treating apparatus A may include both the switching device 70 and the distribution device at the same time, may include only the switching device 70, or may include only the distribution device.

The hot air flowing into the first drum 13 through the first supply air duct 43 may dry the laundry placed in the first drum 13, and then may flow into the heat exchange channel 42 through the first exhaust air duct 41. The first drum 13 may include a front cover 131 disposed on a front side, and a rear cover 132 disposed on a rear side. The first supply air duct 43 may be connected to the rear cover 132, and the first exhaust air duct 41 may be connected to the front cover 131.

The first exhaust air duct 41 may connect the first drum 13 and the heat exchange channel 42. The first exhaust air duct 41 may extend downwardly from the first drum 13 to be connected to the heat exchange channel 42.

A first inlet port 421 connected to the first exhaust air duct 41 may be formed at an inlet end 42A of the heat exchange channel 42. The first inlet port 421 may extend upwardly from the heat exchange channel 42. The first inlet port 421 may extend upwardly from the case 570 of the heating device 50.

The laundry treating apparatus A may include a first opening and closing valve 41*a* disposed in the first exhaust air duct 41. The first opening and closing valve 41*a* may control a flow rate of air in the first exhaust air duct 41. The first opening and closing valve 41*a* may block an air flow in the first exhaust air duct 41. The first opening and closing valve 41*a* may block the air flow in the first exhaust air duct 41 when the hot air is not supplied into the first drum 13 through the first supply air duct 43.

The hot air flowing into third cabinet 30 through the second supply air duct 45 may dry the laundry placed in the third cabinet 30, and then may flow into the heat exchange channel 42 through the second exhaust air duct 44. The second supply air duct 45 and the second exhaust air duct 44 may be connected to the third rear panel 302 of the third cabinet 30.

The second exhaust air duct 44 may connect the third cabinet 30 and the heat exchange channel 42. The second exhaust air duct 44 may extend downwardly from an upper portion of the third cabinet 30 to be connected to the heat exchange channel 42.

The second exhaust air duct 44 may include a first duct section 444 disposed between the heating device 50 and the second cabinet 20. A first duct section 444 may be disposed between a base plate 575 (see FIG. 10) to be described later and the second upper panel 203 of the second cabinet 20. The first duct section 444 may extend forwardly and rearwardly in a separation space 55 (see FIG. 10) which will be described later.

A second inlet port 422 connected to the second exhaust air duct 44 may be formed at the inlet end 42A of the heat exchange channel 42. The second inlet port 422 may extend downwardly from the heat exchange channel 42. The second inlet port 422 may extend downwardly from the case 570 of the heating device 50.

The laundry treating apparatus A may include a second opening and closing valve 44*a* disposed in the second exhaust air duct 44. The second opening and closing valve 44*a* may control a flow rate of air in the second exhaust air duct 44. The second opening and closing valve 44*a* may block an air flow in the second exhaust air duct 44. The second opening and closing valve 44*a* may block the air flow in the second exhaust air duct 44 when the hot air is not supplied into the third cabinet 30 through the second supply air duct 45. The second opening and closing valve 44*a* may be disposed in the first duct section 444.

The hot air flowing into the tub 23 through the third supply air duct 48 may dry the laundry placed in the tub 23, and then may flow into the heat exchange channel 42 through the third exhaust air duct 47.

The third exhaust air duct 47 may connect the tub 23 and the heat exchange channel 42. The third exhaust air duct 47 may extend upwardly from an upper portion of the tub 23 to be connected to the heat exchange channel 42.

A third inlet port 424 connected to the third exhaust air duct 47 may be formed at the inlet end 42A of the heat exchange channel 42. The third inlet port 424 may extend downwardly from the heat exchange channel 42. The third inlet port 424 may extend downwardly from the second exhaust air duct 44. The third inlet port 424 may extend downwardly from the first duct section 444.

The third inlet port 424 may protrude downwardly from a lower surface of the second exhaust air duct 44. The third exhaust air duct 47 may connect the tub 23 and the third inlet port 424. The third exhaust air duct 47 may connect the tub 23 and the second exhaust air duct 44. The air in the third exhaust air duct 47 may join the air in the second exhaust air duct 44 to flow into the heat exchange channel 42.

The laundry treating apparatus A may include a third opening and closing valve 47*a* disposed in the third exhaust air duct 47. The third opening and closing valve 47*a* may control a flow rate of air in the third exhaust air duct 47. The third opening and closing valve 47*a* may block an air flow in the third exhaust air duct 47. The third opening and closing valve 47*a* may block the air flow in the third exhaust air duct 47 when the hot air is not supplied into the tub 23 through the third supply air duct 48.

The hot air flowing through the dehumidification duct 46 may be supplied to the outside of the laundry treating apparatus A through an outlet 462 that is open forward. The hot air flowing through the dehumidification duct 46 may be supplied into an indoor space through the outlet 462.

The dehumidification duct 46 may include a second duct section 461 disposed between the heating device 50 and the second cabinet 20. The second duct section 461 may be disposed between the base plate 575 (see FIG. 10) to be described later and the second upper panel 203 of the second cabinet 20. The second duct section 461 may extend forwardly and rearwardly in the separation space 55 (see FIG. 6) which will be described later.

An outside air inlet port 423 connected to the heat exchange channel 42 may be formed at the inlet end 42A of the heat exchange channel 42. The outside air inlet port 423 may extend forwardly from the heat exchange channel 42. The outside air inlet port 423 may extend forwardly from the second exhaust air duct 44.

The outside air inlet port 423 may protrude forwardly from one side of the second exhaust air duct 44. The outside air inlet port 423 may allow the indoor space and the second exhaust air duct 44 to communicate with each other. The air in the outside air inlet port 423 may join the air in the second exhaust air duct 44 to flow into the heat exchange channel 42. The outside air inlet port 423 may have an outside air inlet 49 that is opened forward. The air drawn in through the outside air inlet 49 may join the air in the second exhaust air duct 44 to flow into the heat exchange channel 42.

The laundry treating apparatus A may include a fourth opening and closing valve 49*a* disposed at the outside air inlet port 423. The fourth opening and closing valve 49*a* may control a flow rate of air in the outside air inlet port 423. The fourth opening and closing valve 49*a* may block an air flow in the outside air inlet port 423. The fourth opening and closing valve 49*a* may block the air flow in the outside air inlet port 423 when the hot air is not supplied to the dehumidification duct 46.

Figure 6:
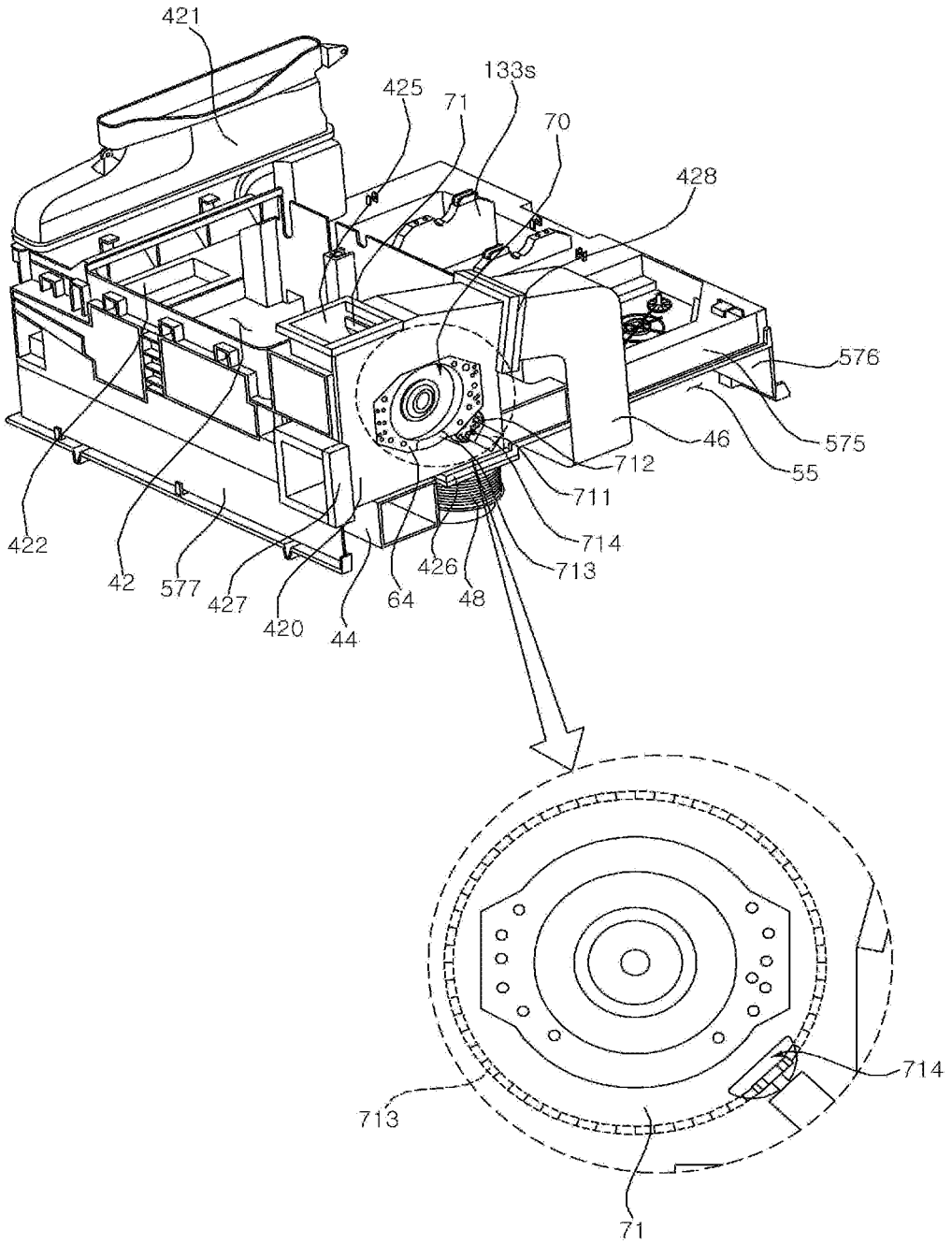
FIG. 6 is another perspective view of a heating device according to an embodiment of the present disclosure.
Figure 7:
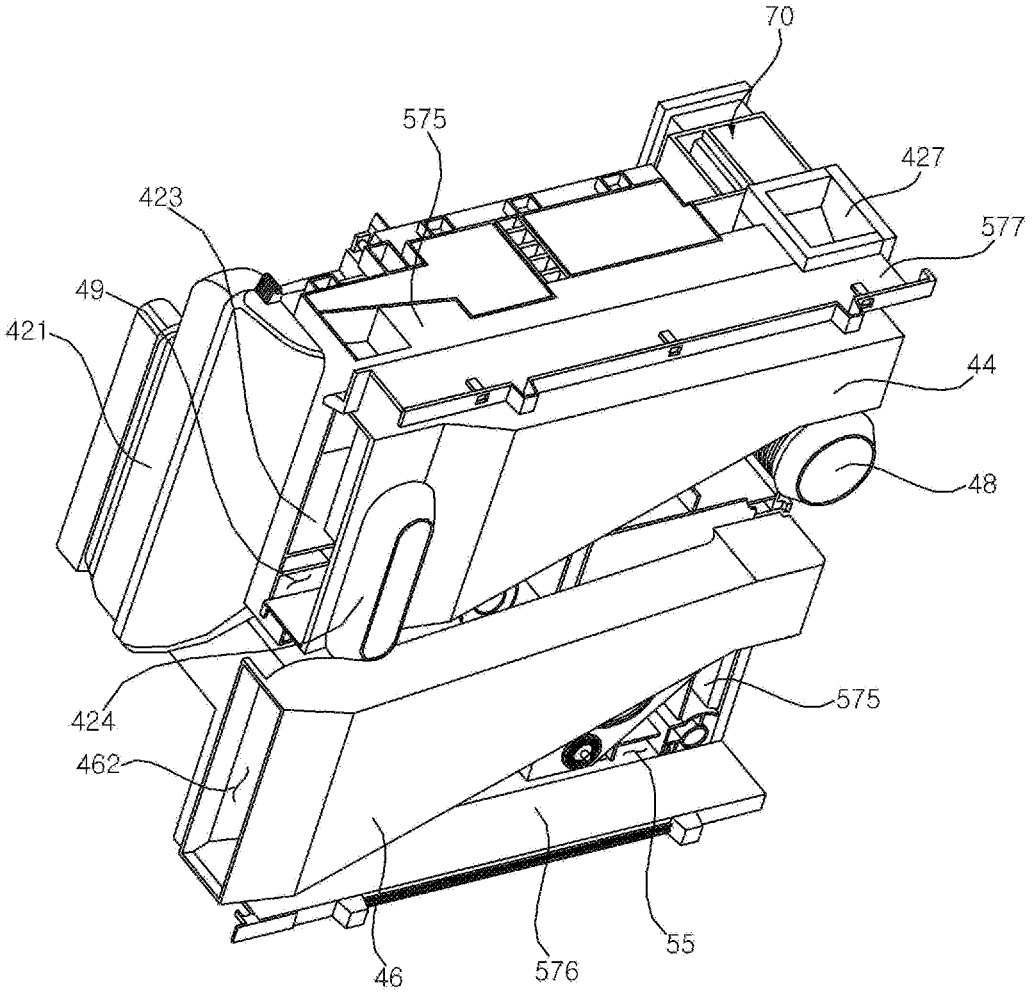
FIG. 7 is yet another perspective view of a heating device according to at least one embodiment of the present disclosure.

Hereinafter, the heating device 50 will be described with reference to FIGS. 5 to 7. FIGS. 5 and 6 are top-side perspective views of the heating device 50, and FIG. 7 is a bottom-side perspective view of the heating device 50.

The heating device 50 may include the compressor 51 for compressing a refrigerant and heat exchangers 52 and 53 for heat exchange between the refrigerant and air. When the compressor 51 operates, the refrigerant is compressed such that the temperature of the refrigerant increases. The refrigerant discharged from the compressor 51 may be heat exchanged with air via the condenser 52 and the evaporator 53. For example, the evaporator 53 may be provided on an upstream side along a flow direction of air, and the condenser 52 may be provided on a downstream side of the evaporator 53, such that the introduced air is first heat exchanged with the evaporator 53, thereby removing or reducing humidity in the air. After being heat exchanged with the evaporator 53, the air is heat exchanged with the condenser 52, such that the air may be changed into relatively high temperature dry air. A high temperature and high pressure refrigerant, compressed by the compressor 51, is heat exchanged with ambient air in the condenser 52, is decompressed and expanded by passing through the expansion device 53, and then may absorb latent heat around the evaporator 53 and is evaporated therein.

Referring to FIG. 5, the heating device 50 may include the case 570, the compressor 51, the condenser 52, the evaporator 53, and the expansion device 54.

The compressor 51, the condenser 52, the evaporator 53, and the expansion device 54 may be connected by a refrigerant passage. The heat pump device may include the compressor 51, the condenser 52, the evaporator 53, and the expansion device 54.

The drain pan 531 may be disposed under the evaporator 53.

The case 570 may provide a space in which the compressor 51, the condenser 52, the fan 60, and the evaporator 53 are disposed. The compressor 51, the condenser 52, the fan 60, the evaporator 53, and the switching device 70 may be disposed in the case 570.

The case 570 may include a cover 573, a base plate 575 spaced from a lower side of the cover 573, a front wall 574 disposed at a front side of the condenser 53, a first side wall 571 disposed on one side of the condenser 53, and a second side wall 572 disposed on the other side of the condenser 53.

The drum motor 133 rotating the first drum 13 of the dryer 1 may be disposed in the case 570 of the heating device 50. The drum motor 133 may be disposed on an upper side of the case 570. The case 570 may provide a motor mounting portion 133*s* on which the drum motor 133 is mounted.

The condenser 52, the fan 60, and the evaporator 53 may be disposed on an upper side of the base plate 575.

The heat exchange channel 42 may be a space surrounded by the base plate 575, the front wall 574, the first side wall 571, and the second side wall 572. The cover 573 may not be provided, in which case an upper portion of the heat exchange channel 42 may be open. The heat exchange channel 42 may communicate with the fan 60 disposed at a rear portion of the heating device 50. Air in the heat exchange channel 42 may be blown by the fan 60. The heat exchange channel 42 may be referred to as a "heating passage." The condenser 52 and the evaporator 53 may be disposed in the heat exchange channel 42. The heat exchange channel 42 may refer to a partially open space.

The heat exchange channel 42 may be a space surrounded by the cover 573, the base plate 575, the front wall 574, the first side wall 571, and the second side wall 572. The cover 573 may cover the upper portion of the heat exchange channel 42. The heat exchange channel 42 may refer to a space between the cover 573 and the base plate 575. The cover 573, the base plate 575, the front wall 574, the first side wall 571, and the second side wall 572 may form a "heating duct" surrounding the heat exchange channel 42. The heating duct may communicate with the fan 60, and air in the heating duct may be blown by the fan 60. The condenser 52 and the evaporator 53 may be disposed in the heating duct. The heat exchange channel 42 may refer to a duct shielded in all directions.

The heat exchange channel 42 may be formed in the heating device 50. The heat exchange channel 42 may be a portion of the inner space of the heating device 50.

The first inlet port 421 may be disposed at a front side of the heat exchange channel 42. The first inlet port 421 may cover the front side of the heat exchange channel 42. The first inlet port 421 may be connected to the front wall 574. The first inlet port 421 may be formed in the case 570. The first exhaust air duct 41 may be inserted into the first inlet port 421 and may be fixed thereto.

The heating device 50 may be disposed in the machine room S. The controller 81 may control the operation of components disposed in the machine room S. The machine room S may have a space in which the PCB is disposed, and the controller 81 may be mounted on the PCB.

The heating device 50 may include a steam generator 502 for generating steam and a dehumidifier 504 for removing moisture from the air flowing through the heat exchange channel 42.

The steam generator 502 may generate steam by heating water. The steam generator 502 may be disposed between the condenser 52 and the fan 60. The steam generated by the steam generator 502 may be pressurized by the fan 60 to be supplied to each of the washing machine 2, the dryer 1, and the refresher 3. The steam generated by the steam generator 502 may be supplied to each of the first drum 13, the second drum 24, and the inner space 33 of the refresher 3.

The dehumidifier 504 may dehumidify air under room temperature conditions (about 25 degrees Celsius). The dehumidifier 504 may dehumidify air by using desiccant cooling. The dehumidifier 504 may be filled with zeolite. The zeolite filled in the dehumidifier 504 may be replaced periodically.

The dehumidifier 504 may be disposed between the condenser 52 and the fan 60. The dehumidifier 504 may dehumidify the air flowing through the heat exchange channel 42 even when the compressor 51 is not in operation.

The switching device 70 may control the direction of air blown by the fan 60. The switching device 70 may be disposed in the machine room S.

Referring to FIG. 6, the switching device 70 may control the supply of hot air to the washing machine 2, the dryer 1, the refresher 3, or the dehumidification duct 46.

The switching device 70 may include the rotating body 71 rotatably mounted in the blowing duct 70. The switching device 70 may include the driving motor 711 that rotates the rotating body 71. The rotating body 71 may be rotated by the driving motor 711 in the blowing duct 420. The fan 60 may be disposed in the rotating body 71.

The driving motor 711 may rotate the rotating body 711. A driving gear 712 may be fixed to the rotating shaft of the driving motor 711. The driving gear 712 may be a pinion gear or a spur gear.

A driven gear 713 may be rotated in engagement with the driving gear 712. The driven gear 713 may be fixed to the rotating body 71 or may be integrally formed with the rotating body 71. The driven gear 713 may be a ring gear. The driven gear 713 may be a ring-shaped rack.

The driving gear 712 and the driven gear 713 may be engaged with each other. By the rotation of the driving gear 712, the driven gear 713 may be moved in a circumferential direction with respect to the rotational axis of the fan 60. When the driven gear 713 is moved in a circumferential direction, the rotating body 71 having the driven gear 713 fixed thereto may also be moved in the circumferential direction with respect to the rotational axis of the fan 60.

The driving motor 712 may be disposed outside of the blowing duct 420. One surface (e.g., rear surface) of the blowing duct 420 that faces the rotating body 71 may have a cut-out portion 714. The cut-out portion 714 may be formed at a position corresponding to the driven gear 713. A portion of the driving gear 712 may be inserted into the cut-out portion 714. The driving gear 712 and the driven gear 713 may be engaged with each other in the cut-out portion 714.

A rotating shaft of the driving motor 711 may be disposed side by side with the rear surface of the blowing duct 420. Accordingly, a volume occupied by the driving motor 711 and the driving gear 712 in the front-rear direction may be reduced.

The driving motor 711 may be a motor capable of controlling the position, angle, and direction of rotation. For example, the driving motor may be a Brushless Direct Current (BLDC) motor. Alternatively, the driving motor 711 may be a step motor. The driving motor 711 may be electrically connected to the control panel 8 and/or the controller 81. Rotation of the driving motor 711 may be controlled by an electrical signal transmitted from the control panel 8 and/or the controller 81 to the driving motor 711. The control panel 8 and/or the controller 81 may control a hot air supplying direction by controlling the rotation angle of the driving motor 711.

Meanwhile, the driving motor 711 may rotate the rotating body 71 by various known methods used by the motor for rotating the rotating body. For example, the driving motor 711 may rotate the rotating body 71 by using a belt-pulley method, or by using a plurality of gears that are engaged with each other, or the rotating shaft of the motor may be rotated together with the rotating body.

The blowing duct 420 may be connected to the first supply air duct 43, the second supply air duct 45, the third supply air duct 48, and the dehumidification duct 46.

The blowing duct 420 may be connected to a motor mount 64, to which a fan motor rotating the fan 60 is fixed. The motor mount 64 may be disposed on a rear surface of the blowing duct 420. The driving motor 711, the driving gear 712, and the driven gear 713 may be disposed radially outwardly from the motor mount 64.

The blowing duct 420 may include the first discharge port 425, the second discharge port 427, the third discharge port 426, and the fourth discharge port 428.

The first supply air duct 43 may be connected to the first discharge port 425. The first supply air duct 43 may be inserted into the first discharge port 425. The first discharge port 425 may be directed upward in the blowing duct 420. The first discharge port 425 may provide a supply air hole that is vertically open.

The second supply air duct 45 may be connected to the second discharge port 427. The second supply air duct 45 may be inserted into the second discharge port 427. The second discharge port 427 may be directed toward the lateral side in the blowing duct 420. The second discharge port 427 may provide a supply air hole that is horizontally open.

The third supply air duct 48 may be connected to the third discharge port 426. The third supply air duct 48 may be inserted into the third discharge port 426. The third discharge port 426 may be directed downward in the blowing duct 420. The third discharge port 426 may provide a supply air hole that is vertically open.

The dehumidification duct 46 may be connected to the fourth discharge port 428. The dehumidification duct 46 may be inserted into the fourth discharge port 428. The fourth discharge port 428 may be directed toward a direction opposite to the second discharge port 427. The fourth discharge port 428 may be directed toward the lateral side in the blowing duct 420. The fourth discharge port 428 may provide a supply air hole that is horizontally open.

The heating device 50 may be connected to each of the first exhaust air duct 41, the second exhaust air duct 44, the third exhaust air duct 47, and the outside air inlet port 423. The third exhaust air duct 47 and the outside air inlet port 423 may be connected to the heating device 50 via the second exhaust air duct 44.

The heating device 50 may include the first inlet port 421 connected to the first exhaust air duct 41, and the second inlet port 422 connected to the second exhaust air duct 44. The first inlet port 421 may extend upwardly, and the second inlet port 422 may extend downwardly. The first inlet port 421 and the second inlet port 422 may protrude from the case 570 of the heating device 50.

Air drawn into the heating device 50 through the first exhaust air duct 41, the second exhaust air duct 44, the third exhaust air duct 47, and the outside air inlet port 423 may pass through the heat exchange channel 42 and flow into the fan 60 by the suction force of the fan 60.

Referring to FIGS. 5 to 7, the air flowing through the first exhaust air duct 41, the second exhaust air duct 44, the third exhaust air duct 47, and the outside air inlet port 423 may meet in the heat exchange channel 42 to flow into the fan 60.

The third inlet port 424 connected to the third exhaust air duct 47 may protrude downwardly from the second exhaust air duct 44. The air in the third exhaust air duct 47 may join the air in the second exhaust air duct 44 to flow into the heat exchange channel 42.

The outside air inlet port 423 communicating with the indoor space may protrude forwardly from the second exhaust air duct 44. The air flowing into the outside air inlet port 423 through the outside air inlet 49 may join the air in the second exhaust air duct 44 to flow into the heat exchange channel 42.

The air flowing into the heat exchange channel 42 through the second exhaust air duct 44 may join the air flowing into the heat exchange channel 42 through the first exhaust air duct 41 to flow to the fan 60.

The heating device 50 may include a first support plate 576 extending downwardly from the base plate 575, and a second support plate 577 extending downwardly from the base plate 575 and spaced apart from the first support plate 576.

A separation space 55 may be formed between the first support plate 576 and the second support plate 577.

The second exhaust air duct 44, the third exhaust air duct 48, and the dehumidification duct 46 may be disposed in the separation space 55. The second exhaust air duct 44, the third exhaust air duct 48, and the dehumidification duct 46 may be formed between the first support plate 576 and the second support plate 577. The second exhaust air duct 44, the third exhaust air duct 48, and the dehumidification duct 46 may be disposed under the base plate 575.

The dehumidification duct 42 may be disposed under the base plate 575 and may extend forwardly to discharge the air forwardly through a hot air outlet 462. When an opening member 463 (see FIG. 10) which will be described later opens a front side of the separation space 55, the air discharged through the hot air outlet 462 may be discharged forwardly from the laundry treating apparatus A.

A portion of the second exhaust air duct 44 disposed under the base plate 575 may be defined as the first duct section 444.

A portion of the dehumidification duct 46 disposed under the base plate 575 may be defined as the second duct section 461.

Figure 8:
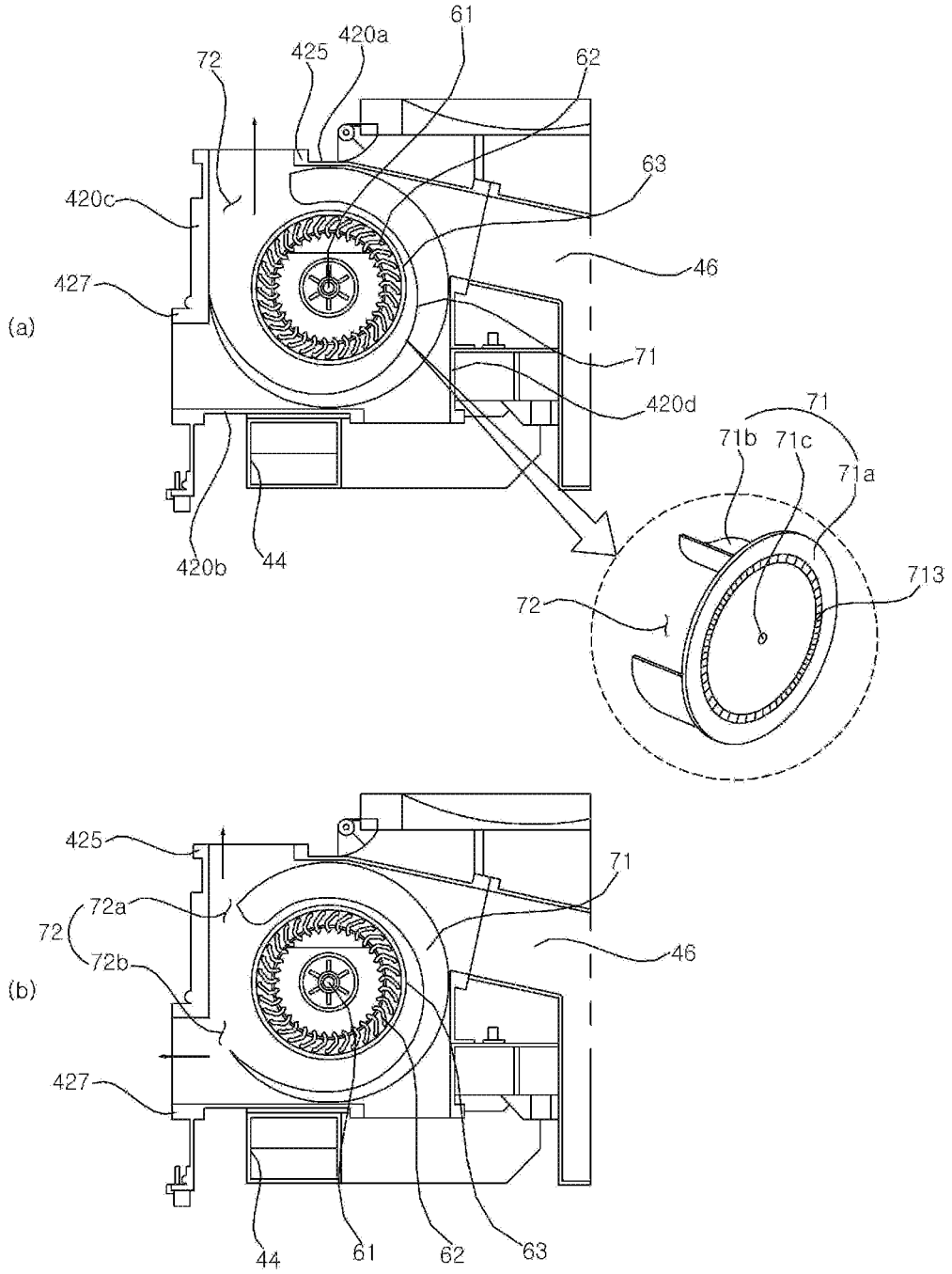
FIG. 8 is a diagram explaining an example of operation of a switching device according to an embodiment of the present disclosure.

Hereinafter, a method of controlling a blowing direction of air by the switching device 70 will be described with reference to FIG. 8. In FIG. 8, (a) is a diagram illustrating an example of operation when air is supplied to the first supply air duct 43 by the operation of the switching device 70, and (b) is a diagram illustrating an example of operation when air is supplied to the first supply air duct 43 and the second supply air duct 45 at the same time by the operation of the switching device 70.

The fan 60 may be a Sirocco fan. The fan 60 may rotate to blow air in a direction perpendicular to the rotating shaft 61. The fan 60 may blow air in a direction coming into contact with the rotation direction. The air blown by the fan 60 may be concentrated in a predetermined range of angles relative to the rotating shaft 61.

The fan 60 may include the rotating shaft 61 coupled to the fan motor and rotated thereby, a plurality of blades 62 spaced apart in a radially outward direction of the rotating shaft 61, and an outer body 63 coupled to the blades 62 and extending in a rotation direction of the fan 60. The outer body 63 may have an annular shape. The rotating shaft 61 and the blades 62 may be connected by the outer body 63. When the rotating shaft 61 rotates, the outer body 63 and the blades 62 may also be rotated together with the rotating shaft 61.

The rotating body 71 may include a rotating plate 71*a* having the driven gear 713, a scroll 71*b* coupled to the rotating plate 71*a*, and a shaft through hole 71*c* formed in the rotating plate 71*a*.

The rotating plate 71*a* may have a disk shape and may be disposed at a rear side of the fan 60. The driven gear 713 may be formed in an annular shape on one side surface of the rotating plate 71*a*. The driven gear 713 may be formed integrally with the rotating plate 71*a*. When the driven gear 713 is rotated in engagement with the driving gear 711, the rotating plate 71*a* may be rotated in the same direction as the rotation direction of the fan 60. The rotating plate 71*a* may have the shaft through hole 71*c*, through which the rotating shaft 61 passes. The rotating shaft 61 may pass through the shaft through hole 71*c* to be coupled to the fan motor.

The fan 60 may be disposed between the heat exchange channel 24 and the rotating plate 71*a*. That is, the rotating plate 71*a* may be disposed behind the heat exchange channel 42 and the fan 60. The rotating plate 71*a* may be disposed behind the fan 60 in the blowing duct 420.

The scroll 71*b* may be integrally formed with the rotating plate 71*a*. When the rotating plate 71*a* is rotated, the scroll 71*b* may also be rotated together. The scroll 71*b* may extend in the rotation direction of the fan 60. The scroll 71*b* may be disposed to surround the fan 60. The fan 60 may be disposed in the scroll 71*b*.

The scroll 71*b* may include a blowing channel 72. The blowing channel 72 may be a cut-out portion of an outer circumferential surface of the scroll 71*b*. The scroll 71*b* may cover the outside of the fan 60, and the blowing channel 72 may be an outer region of the fan 60 which is not covered by the scroll 71*b*. The air blown by the fan 60 may be discharged to the outside of the blowing duct 420 through the blowing channel 72.

When the scroll 71*b* is rotated by the rotation of the rotating plate 71*a*, the blowing channel 72 may be changed in position. That is, by the rotation of the scroll 71*b*, the position of the blowing channel 72 may be changed relative to the rotating shaft 61. By rotating the scroll 71*b* to change the position of the blowing channel 72, the driving motor 711 may control the direction of air discharged from the blowing duct 420.

A longitudinal section of the blowing duct 420 may have a square shape. Accordingly, by the rotation of the scroll 71*b*, interference between the scroll 71 and the blowing duct 420 may be avoided.

The blowing duct 420 may include a first wall 420*a* disposed over the fan 60, a second wall 420*b* disposed under the fan 60, a third wall 420*c* disposed on one side of the fan 60, and a fourth wall 420*d* disposed on the other side of the fan 60.

The first discharge port 425 may protrude upwardly from the first wall 420*a*. The second discharge port 427 may protrude toward the lateral side from the third wall 240*c*. The third discharge port 426 may protrude downwardly from the second wall 420*b*. The fourth discharge port 428 may protrude toward the lateral side from the fourth wall 420*d*.

Referring to (a) of FIG. 8, the driving motor 711 may rotate the rotating body 71 by a first angle, and when the rotating body 71 is rotated by the first angle, the air blown by the fan 60 may be supplied to the first supply air duct 43. In this case, the blowing channel 72 may communicate with only an inner space of the first discharge port 425. Accordingly, the air blown by the fan 60 may be supplied to only the dryer 1.

Referring to (b) of FIG. 8, the driving motor 711 may rotate the rotating body 71 by a second angle, and when the rotating body 71 is rotated by the second angle, the air blown by the fan 60 may be supplied to the first supply air duct 43 and the second supply air duct 45 at the same time. In this case, the blowing channel 72 may communicate with an inner space of the first discharge port 425 and an inner space of the second discharge port 427. Accordingly, the air blown by the fan 60 may be supplied to the dryer 1 and the refresher 3 at the same time. The blowing channel 72 may include a first blowing channel 72*a* communicating with the inner space of the first discharge port 425, and a second blowing channel 72*b* communicating with the inner space of the second discharge port 427. The air blown by the fan 60 may be supplied to the dryer 1 through the first blowing channel 72*a*. The air blown by the fan 60 may be supplied to the refresher 3 through the second blowing channel 72*b*.

A user may control the switching device 70 by inputting a signal to the control panel 8. Once the signal is input to the control panel 8, the signal may be transmitted to the driving motor 711, to control a rotation angle of the driving motor 711. For example, when the user inputs, to the control panel 8, a signal for supplying hot air to the dryer 1, the driving motor 711 may rotate the rotating body 71 so that the blowing channel 72 may be moved to a position as illustrated in (a) of FIG. 8. For example, when the user inputs, to the control panel 8, a signal for supplying hot air to the dryer 1 and the refresher 3 at the same time, the driving motor 711 may rotate the rotating body 71 so that the blowing channel 72 may be moved to a position as illustrated in (b) of FIG. 8.

Figure 9:
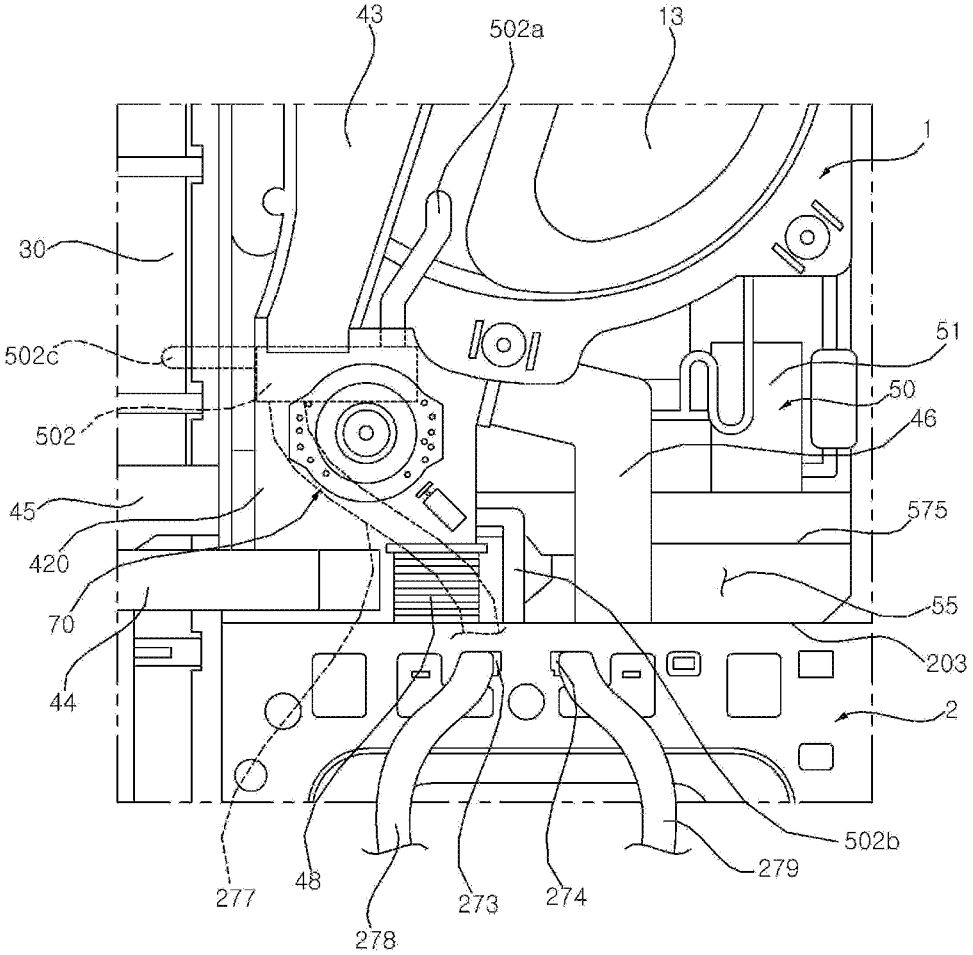
FIG. 9 is a diagram illustrating a portion of a rear surface of a laundry treating apparatus according to an embodiment of the present disclosure.

Hereinafter, a structure for supplying hot air and steam by the heating device 50 to the respective laundry treating machines 1, 2, and 3 will be described with reference to FIG. 9. FIG. 9 is an enlarged view of a portion of a rear surface of the laundry treating apparatus A.

The heating device 50 may be disposed over the second upper panel 203. The heating device 50 may be disposed in the cabinet 10 of the dryer 1.

The switching device 70 may be disposed over the second upper panel 203. The switching device 70 may be disposed in the cabinet 10 of the dryer 1.

The blowing duct 420 may be connected to the first supply air duct 43, the second supply air duct 45, and the third supply air duct 48.

The first supply air duct 43 may extend upwardly from the blowing duct 420. The first supply air duct 43 may be connected to the first drum 13.

The second supply air duct 45 may extend from the blowing duct 420 to a lateral side. The second supply air duct 45 may be connected to the third cabinet 30.

The third supply air duct 48 may extend downwardly from the blowing duct 420. The third supply air duct 48 may pass through the separation space 55 to extend into the second cabinet 20.

The laundry treating apparatus A may include a first steam supply pipe 502*a* connecting the steam generator 502 and the first drum 13, a second steam supply pipe 502*c* connecting the steam generator 502 and the third cabinet 30, and a third steam supply pipe 502*b* connecting the steam generator 502 and the tub 23.

The steam generator 502 may be disposed in the heating device 50. The steam generated by the steam generator 502 may be sprayed into the first drum 13 through the first steam supply pipe 502*a*. The steam generated by the steam generator 502 may be sprayed into the inner space 33 of the refresher 3 through the second steam supply pipe 502*c*. The steam generated by the steam generator 502 may be sprayed into the second drum 24 through the third steam supply pipe 502*b*.

The first steam supply pipe 502*a* may extend upwardly from the steam generator 502 to be connected to the first drum 13.

The second steam supply pipe 502*c* may extend from the steam generator 502 to the lateral side, to be connected to the third cabinet 30.

The third steam supply pipe 502*b* may extend downwardly from the steam generator 502 to be connected to the tub 23.

The steam generated by the steam generator 502 may flow to each of the first drum 13, the second drum 24, and the inner space 33 of the refresher 3 by the blowing force of the fan 60. That is, by pressurizing the steam generated by the steam generator 502, the fan 60 may cause the steam to flow into the first drum 13, the second drum 24, and the inner space 33 of the refresher 3.

A valve for controlling an amount of steam flow may be provided for each of the first steam supply pipe 502*a*, the second steam supply pipe 502*c*, and the third steam supply pipe 502*b*. By adjusting an opening degree of the valve, the controller 81 may adjust the amount of steam supplied to each of the first drum 13, the second drum 24, and the inner space 33 of the refresher 3.

The washing machine 2 may be connected to a cold water supply pipe 278 for supplying cold water to the tub 23, and a hot water supply pipe 279 for supplying hot water to the tub 23.

The steam generator 502 may be connected to a third water supply pipe 277 branching off from the cold water supply pipe 278 or the hot water supply pipe 279. The steam generator 502 may be connected to the third water supply pipe 277 branching off from the hot water supply pipe 279.

The steam generator 502 may be supplied with hot water through the third water supply pipe 277. The steam generator 502 may generate steam by heating the water supplied through the third water supply pipe 277.

Water supply ports 273 and 274 may be disposed closer to the second upper panel 203 than to the second lower panel 204. The steam generator 502 may be disposed between the second upper panel 203 and the first drum 13. Accordingly, as a distance between the steam generator 502 and the water supply pipes 278 and 279 becomes shorter, the third water supply pipe 277 may be reduced in length.

Figure 10:
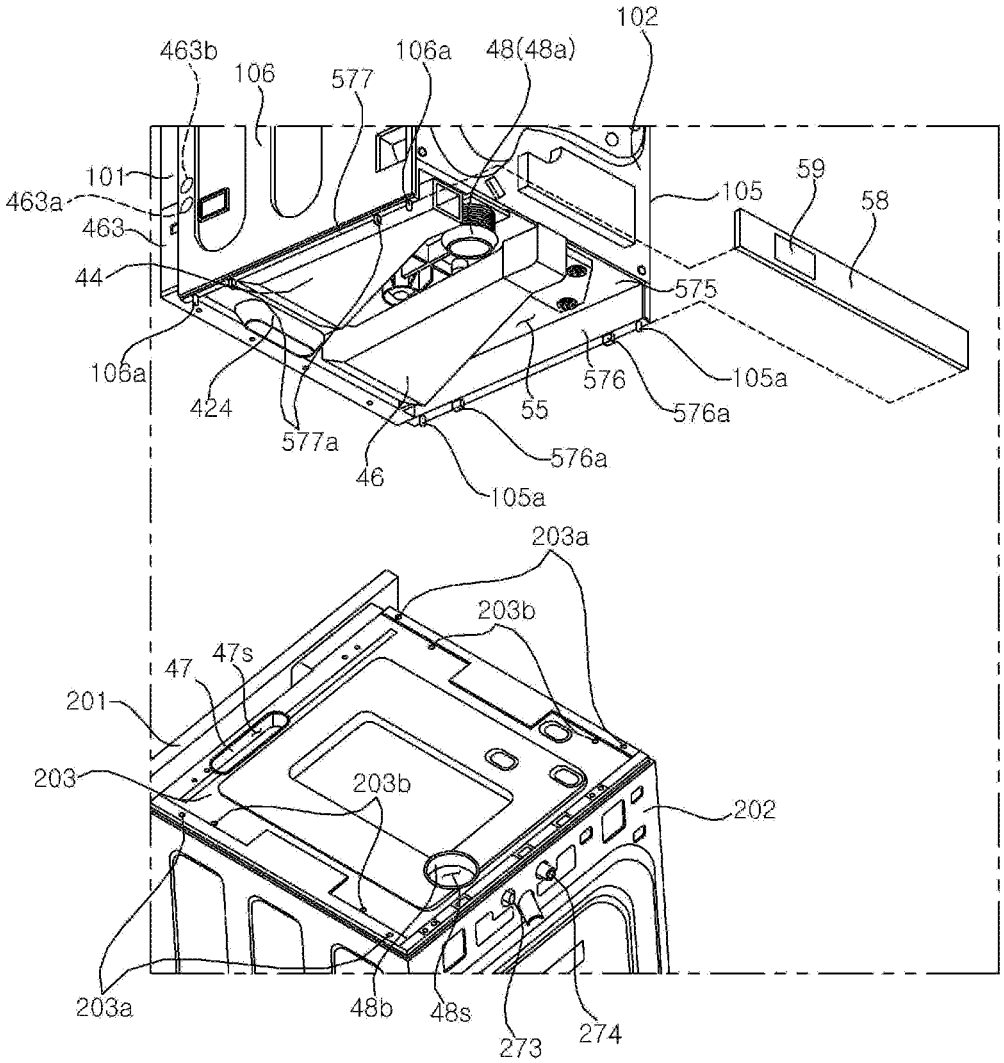
FIG. 10 is a diagram illustrating assembly of a washing machine and a dryer according to an embodiment of the present disclosure.

Hereinafter, a connection structure of the first cabinet 10 and the second cabinet 20 will be described with reference to FIG. 10. FIG. 10 is a diagram illustrating a state in which the first cabinet 10 and the second cabinet 20 are separated from each other.

The base plate 575 of the heating device 50 may be spaced from the upper side of the second upper panel 203 of the washing machine 2. The separation space 55 may be formed between the base plate 575 and the second upper panel 203.

The first side panels 105 and 106 of the dryer 1 may protrude downwardly below the base plate 575.

The first side walls 105 and 106 may include a 1-1 side panel 105 forming one side surface of the laundry treating apparatus A, and a 1-2 side panel 106 facing the third cabinet 30.

The heating device 50 may include the first support plate 576 extending downwardly from the base plate 575. The first support plate 576 may be disposed inside the 1-1 side panel 105.

The heating device 50 may include the second support plate 577 extending downwardly from the base plate 575. The second support plate 577 may be disposed inside the 1-2 side panel 106.

The base plate 575 and the support plates 576 and 577 may be integrally formed with each other. The 1-1 side panel 105 and the first support plate 576 may be integrally formed with each other. The 1-2 side panel 106 and the second support plate 577 may be integrally formed with each other.

The first side panels 105 and 106 may include first protrusions 105*a* and 106*a* protruding downwardly. The 1-1 side panel 105 may include a 1-1 protrusion 105*a* protruding downwardly. The 1-2 side panel 106 may include a 1-2 protrusion 106*a* protruding downwardly. The first protrusions 105*a* and 106*a* may protrude downwardly from a lower end of the first side panels 105 and 106.

The second cabinet 20 may include first recesses 203*a* into which the first protrusions 105*a* and 106*a* are inserted. The first recesses 203*a* may be formed in the second upper panel 203. The first recesses 203*a* may be formed at positions corresponding to the first protrusions 105*a* and 106*a*.

The support plates 276 and 277 may include second protrusions 576*a* and 577*a* protruding downwardly. The first support plate 276 may include a 2-1 protrusion 576*a* protruding downwardly. The second support plate 577 may include a 2-2 protrusion 577*a* protruding downwardly. The second protrusions 576*a* and 577*a* may protrude downwardly from a lower end of the support plates 576 and 577.

The second cabinet 20 may include second recesses 203*b* into which the second protrusions 576*a* and 577*a* are inserted. The second recesses 203*b* may be formed in the second upper panel 203. The second recesses 203*b* may be formed at positions corresponding to the second protrusions 576*a* and 577*a*.

The first protrusions 105*a* and 106*b* and the second protrusions 576*a* and 577*a* may be referred to as "protrusions." The first recesses 203*a* and the second recesses 203*b* may be referred to as "recesses."

The first cabinet 10 and the second cabinet 20 may be coupled to each other by the protrusions 105*a*, 106*b*, 576*a*, and 577*a* inserted into the recesses 203*a* and 203*b*.

The machine room S may be disposed over the base plate 575. Accordingly, the machine room S may be spaced from the upper side of the second upper panel 203.

The separation space 55 may be formed between the first support plate 576 and the second support plate 577.

The second exhaust air duct 44, the dehumidification duct 46, and the third exhaust air duct 48 may be disposed in the separation space 55. The second exhaust air duct 44, the dehumidification duct 46, and the third supply air duct 48 may be disposed between the second upper panel 203 and the base plate 575.

The third supply air duct 48 may protrude downwardly toward the second upper panel 203. The third supply air duct 48 may include a first connection duct 48*a* extending downwardly from the blowing duct 230, and a second connection duct 48*b* connected to the tub 23.

The first connection duct 48*a* may be disposed in the separation space 55.

The second connection duct 48*b* may extend downwardly from the second upper panel 203 to be connected to the tub 23. The second connection duct 48*b* may have a first insertion hole 48*s* which is formed on the inside thereof, and into which the first connection duct 48*a* is inserted.

The first connection duct 48*a* is inserted into the first insertion hole 48*s* to be fixed to the second connection duct 48*b*.

The third inlet port 424 may be connected to the second exhaust air duct 44 and may be disposed in the separation space 55.

The third inlet port 424 may be inserted into a second insertion hole 47*s*, formed on the inside of the third exhaust air duct 47, to be fixed to the third exhaust air duct 47.

When the first cabinet 10 and the second cabinet 20 are assembled, the first connection duct 48*a* and the third inlet port 424 are inserted into the first insertion hole 48*s* and the second insertion hole 47*s*, respectively, to be fixed thereto, thereby facilitating the assembly and alignment of the first cabinet 10 and the second cabinet 20.

The laundry treating apparatus A may include an auxiliary panel 58 disposed at a rear side of the separation space 55.

The auxiliary panel 58 may shield a rear side of the separation space 55. The auxiliary panel 58 may be connected to the first rear panel 102 and the second rear panel 202. The first rear panel 102 and the second rear panel 202 may be connected to each other by the auxiliary panel 58.

The auxiliary panel 58 may include a duct through hole 59, through which the second exhaust air duct 44 passes. The second exhaust air duct 44 may pass through the auxiliary panel 58 to extend into the separation space 55.

The auxiliary panel 58 may be coupled to the first side panels 105 and 106 and the support plates 576 and 577.

The opening member 463 may shield the front side of the separation space 55. The opening member 463 may be disposed at the front side of the dehumidification duct 46 and the outside air inlet port 423.

The laundry treating apparatus A may include a hinge 463*a* connected to the opening member 463, and a motor 463*b* rotating the hinge 463*a*.

The hinge 463*a* may be rotatably connected to the first front panel 101. The hinge 463*a* may extend in a left-right direction. The opening member 463 may be rotated in a front-rear direction with respect to the hinge 463*a* serving as a rotational axis. The opening member 463 may be integrally formed with the hinge 463*a*. When the motor 463*b* rotates the hinge 463*a*, the opening member 463 may be rotated together with the hinge 463*a*. The opening member 463 may be rotated forward to open the front side of the separation space 55. Once the opening member 463 opens the front side of the separation space 55, outside air of the laundry treating apparatus A may flow into the heat exchange channel 44 through the outside air inlet port 423, and the air passing through the dehumidification duct 46 may be discharged to the outside of the laundry treating apparatus A.

The controller 81 may be electrically connected to the motor 463*b*. The controller 81 may control the operation of the motor 463*b*. The user may open the separation space 55 by operating the control panel 8.

Figure 11:
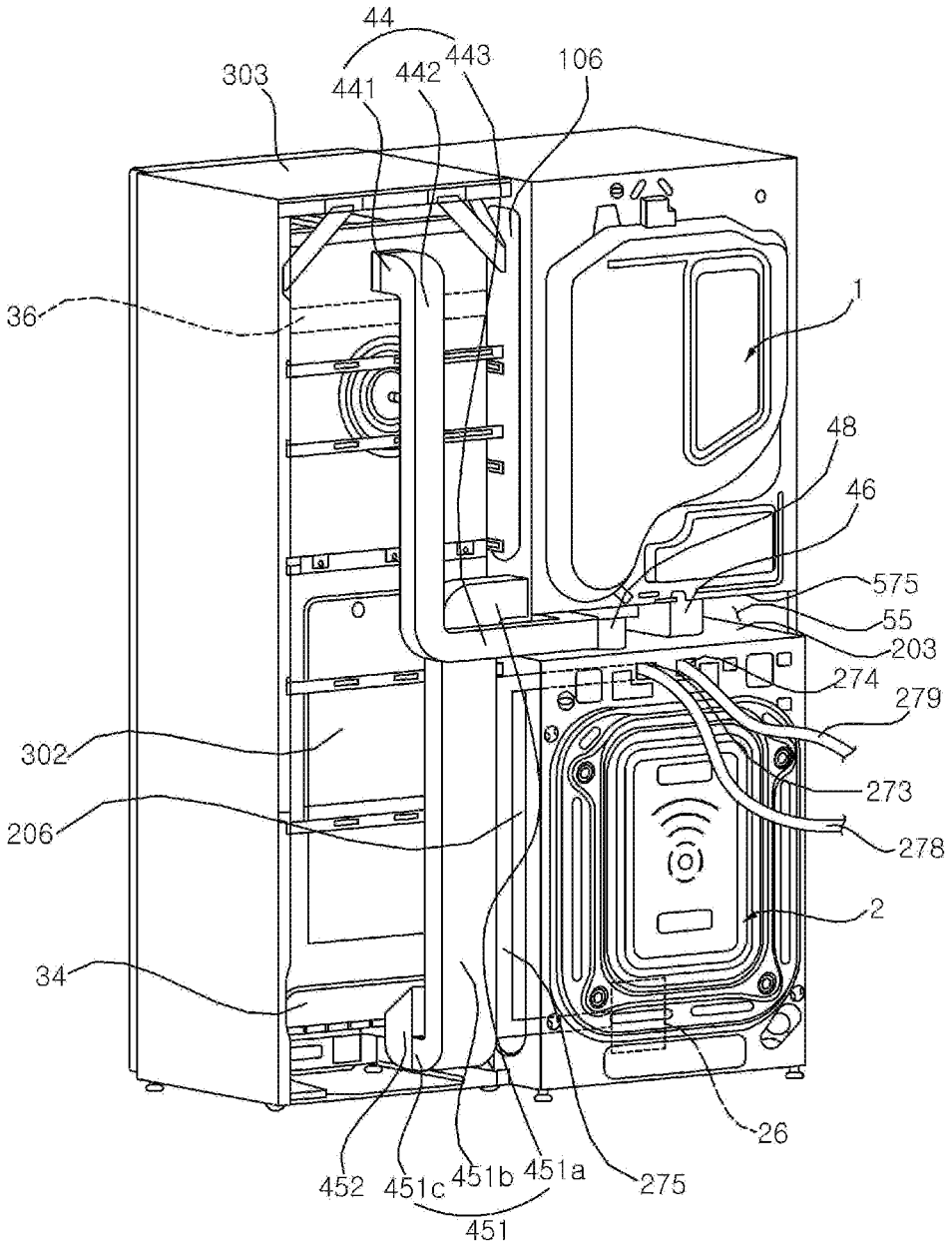
FIG. 11 is a rear view of a laundry treating apparatus according to an embodiment of the present disclosure.

Hereinafter, a structure of the second supply air duct 45 and the second exhaust air duct 44 will be described with reference to FIG. 11. FIG. 11 is a rear view of the laundry treating apparatus A, from which the rear case 310 is removed.

The second supply air duct 45 and the second exhaust air duct 44 for circulating hot air to the refresher 3 may be disposed at the rear side of the third cabinet 30.

The second supply air duct 45 and the second exhaust air duct 44 may be disposed behind the third rear panel 302.

The second supply air duct 45 may extend downwardly from the heating device 50 to be connected to the inner panel 34.

The second supply air duct 45 may face the second side panel 206 of the washing machine 2. The second supply air duct 45 may be disposed side by side with the second side panel 206.

As described above, the second supply air duct 45 may include the first hot air duct 451 and the second hot air duct 452. The first hot air duct 451 may include a first connection part 451*a* connected to the heating device 50, a first extension part 451*b* extending downwardly from the first connection part 451*a*, and a second connection part 451*c* connected to the second hot air duct 452.

The first connection part 451*a* may be coupled to the first side panel 106 of the first cabinet 10. The first connection part 451*a* may be connected to the blowing duct 420, and the air blown by the fan 60 may be introduced through the first connection part 451*a*. The first connection part 451*a* may extend horizontally from the heating device 50.

The first extension part 451*b* may be bent downwardly from the first connection part 451*a*. The first extension part 451*b* may extend downwardly from one end of the first connection part 451*a*. The first extension part 451*b* may face the second side panel 206 of the washing machine 2 and may be disposed side by side with the second side panel 206.

The second connection part 451*c* may be coupled to the third rear panel 302 of the third cabinet 30. The second connection part 451*c* may be coupled to the second hot air duct 452. That is, the third rear panel 302 may be disposed between the second hot air duct 452 and the second connection part 451*c*. The second connection part 451*c* may extend from the first extension part 451*b* in the front-rear direction.

The washing machine 2 may include water supply ports 273 and 274 connected to the external water source. The water supply ports 273 and 274 may be connected to the water supply pipes 278 and 279 which are connected to the external water source. The tub 23 may be supplied with water from the external water source through the water supply pipes 278 and 279.

The water supply ports 273 and 274 may include a first water supply port 273 connected to the cold water supply pipe 278 for supplying cold water, and a second water supply port 274 connected to the hot water supply pipe 279 for supplying hot water. The tub 23 may be supplied with cold water through the cold water supply pipe 278, and may be supplied with hot water through the hot water supply pipe 279. The water supply valve 270 may be connected to the cold water supply pipe 278 and the hot water supply pipe 279, and may control an amount of cold water and hot water flowing into the tub 23.

The laundry treating apparatus A may include a cooling pipe 275 branching off from the cold water supply pipe 289 or the hot water supply pipe 279. The cooling pipe 275 may branch off from the cold water supply pipe 278.

The cooling pipe 275 may branch off from the cold water supply pipe 278 to be disposed adjacent to the second supply air duct 45. The cooling pipe 275 may extend side by side with the second supply air duct 45 or may come into contact with the second supply air duct 45. Hot air flowing in the second supply air duct 45 may be heat exchanged with water flowing in the cooling pipe 275, such that temperature of the hot air may be reduced. The cooling pipe 275 may be disposed adjacent to the first extension part 451*b* or may come into contact with the first extension part 451*b*.

The cooling pipe 275 may be connected to the drain pump 26. Water branched off from the cold water supply pipe 278 and flowing into the cooling pipe 275 may be heat exchanged with the hot air flowing in the second supply air duct 45, and then may flow into the drain pump 26. The drain pump 26 may discharge the water, introduced through the cooling pipe 275, to the outside of the laundry treating apparatus A.

Clothing treated by the refresher 3 may be susceptible to damage when dried at a high temperature. It is required to supply hot air at a relatively lower temperature to the clothing dried by the refresher 3 than clothing treated by the dryer 1 and the washing machine 2. High temperature hot air generated by the heating device 50 may be supplied directly to the washing machine 2 or the dryer 1. However, the high temperature hot air generated by the heating device 50 is required to be cooled before being supplied to the refresher 3. Accordingly, in the laundry treating apparatus A according to the present disclosure, hot air at a lower temperature than the hot air supplied to the washing machine 2 and the dryer 1 may be supplied to the refresher 3 by using the water supply pipes 275, 278, and 279 of the washing machine 2, thereby preventing damage to the clothing placed in the refresher 3. In addition, by discharging water, used for reducing the temperature of the hot air supplied to the refresher 3, to the outside through the drain pump 26, it is possible to effectively manage the water used for cooling the hot air.

The second exhaust air duct 44 may include a third connection part 441 connected to the third cabinet 30, a second extension part 442 extending downwardly from the third connection part 441, and a fourth connection part 443 connected to the heating device 50.

The third connection part 441 may be coupled to the third rear panel 302 of the third cabinet 30. The third connection part 441 may communicate with the inner space 33 of the refresher 3, and air circulating in the refresher 3 may flow through the third connection part 441. The third connection part 441 may extend rearwardly from the third cabinet 30. A position where the third connection part 441 and the third cabinet 30 are connected may be between the third upper panel 303 and the hanger 36.

The second extension part 442 may be bent downwardly from the third connection part 441. The second extension part 442 may extend downwardly from the third connection part 441. The second extension part 442 may extend downwardly from one end of the third connection part 441. The second connection part 442 may face the first side panel 106 of the dryer 1 and may be disposed side by side with the first side panel 106.

The fourth connection part 443 may extend into the separation space 55. The fourth connection part 443 may extend in the front-rear direction from the second extension part 442. The fourth connection part 443 may be connected to the heating device 50 in the separation device 55.

Hereinafter, a laundry treating apparatus B according to an embodiment of the present disclosure will be described with reference to FIGS. 12 to 14.

Figure 12:
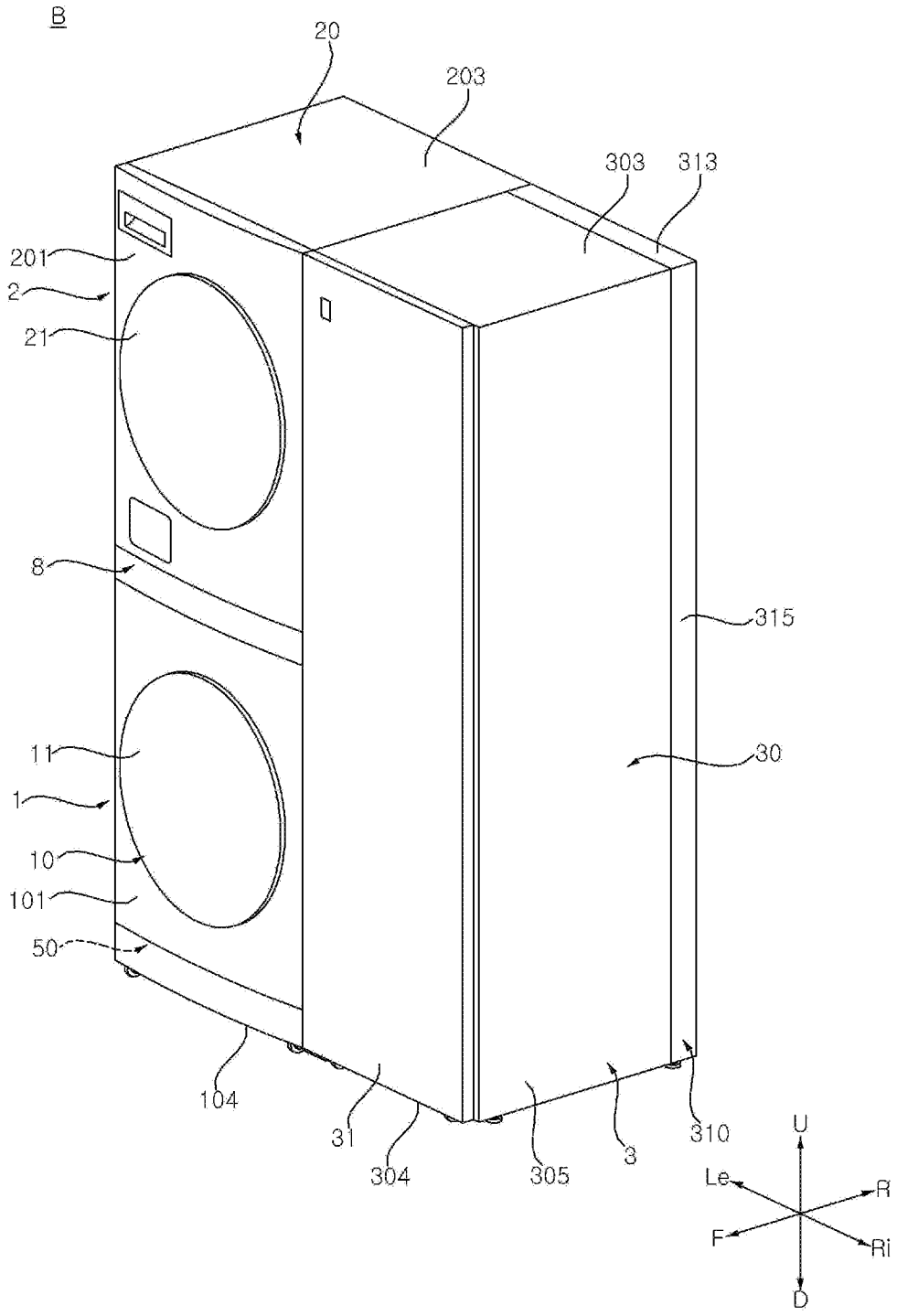
FIG. 12 is a perspective view of a laundry treating apparatus according to an embodiment of the present disclosure.
Figure 13:
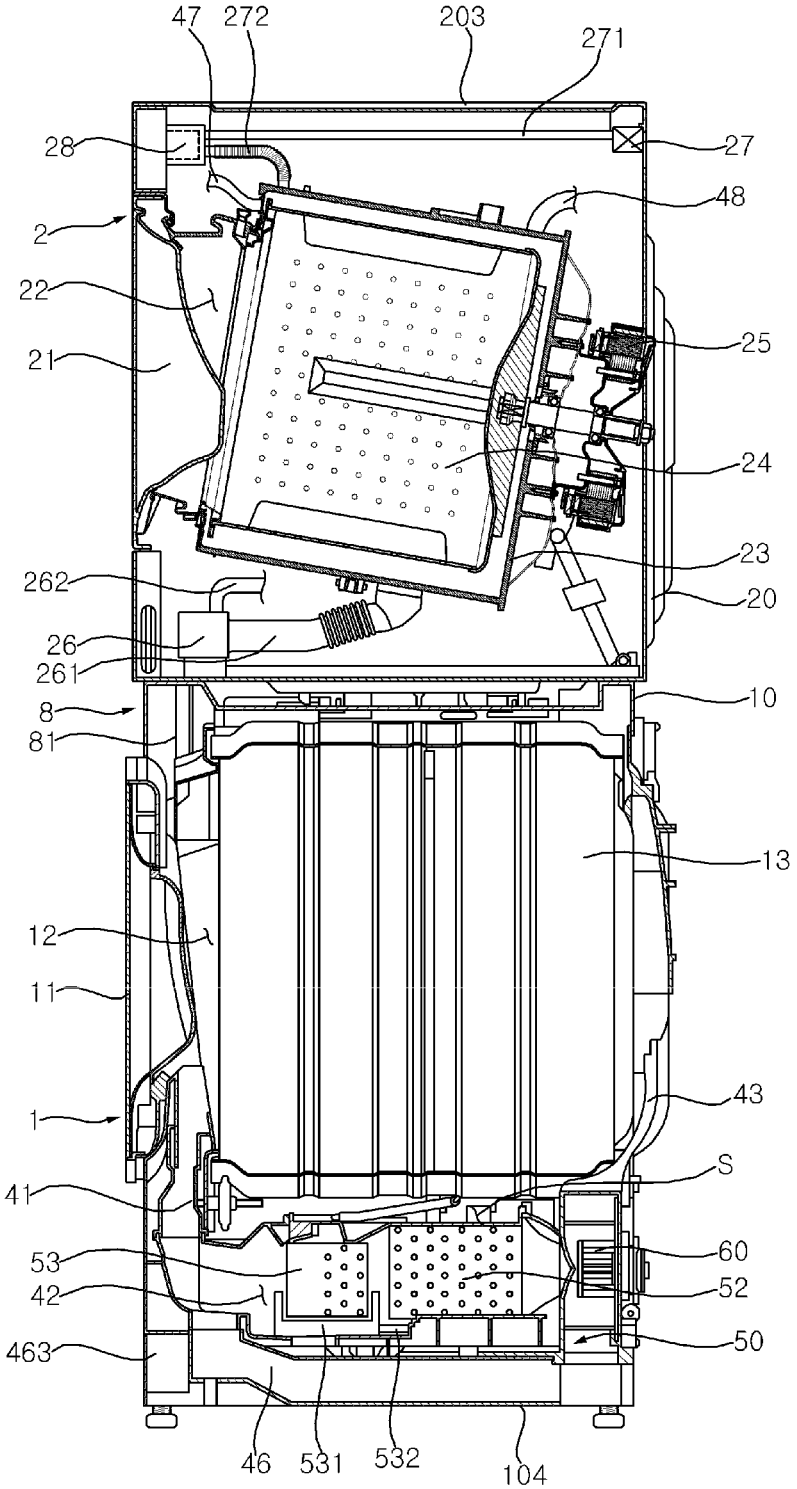
FIG. 13 is a first longitudinal cross-sectional view of the laundry treating apparatus illustrated in FIG. 12.
Figure 14:
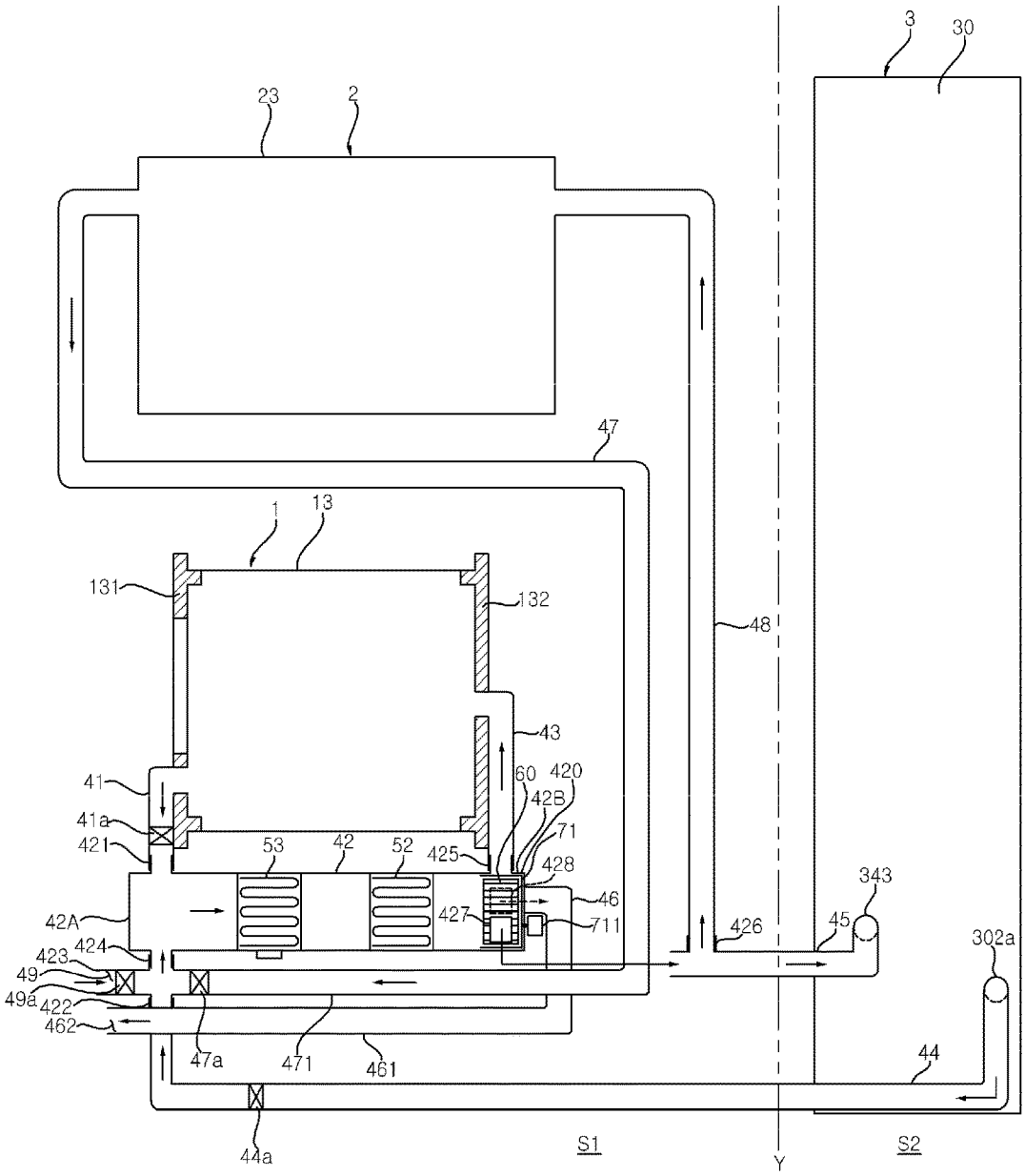
FIG. 14 is a conceptual diagram illustrating a duct system according to an embodiment of the present disclosure.

Referring to FIGS. 12 to 14, in the laundry treating apparatus B according to an embodiment of the present disclosure, the dryer 1 is disposed under the washing machine 2, and the heating device 50 is disposed under the dryer 1.

That is, the laundry treating apparatus B illustrated in FIGS. 12 to 14 is different from the laundry treating apparatus A described above with reference to FIGS. 1 to 11 in terms of arrangement of the washing machine 2, the dryer 1, and the heating device 50.

Accordingly, components, other than those related to the arrangement of the washing machine 2, the dryer 1, and the heating device 50, may be the same as the components of the laundry treating apparatus A described above with reference to FIGS. 1 to 11.

Referring to FIGS. 12 to 14, the heating device 50 may be disposed in the dryer 1. The heating device 50 may be disposed in the first cabinet 10. The heating device 50 may be disposed at a lower portion of the first cabinet 10 or under the first drum 13 (see FIG. 13).

The second upper panel 203 of the washing machine 2 and the third upper panel 303 of the refresher 3 may be disposed on the same horizontal plane. The third upper panel 303 of the refresher 3 and the upper wall 313 of the rear case 310 may be disposed on the same horizontal plane.

The first lower panel 104 of the dryer 1 and the third lower panel 304 of the refresher 3 may be disposed on the same horizontal plane.

The drain pump 26 may be connected to the tub 23 by a first pipe 261. The drain pump 26 may discharge water, introduced through the first pipe 261, to the outside of the laundry treating apparatus B through a second pipe 262.

The heating device 50 may be disposed under the second cabinet 320. The heating device 50 may be disposed in the first cabinet 10. The heating device 50 may be disposed under the first drum 13.

The third supply air duct 48 may be connected to an upper portion of the tub 23. The dehumidification duct 46 may be disposed between the base plate 575 and the first lower panel 104. The opening member 463 may be rotatably coupled to the first cabinet 10. The third exhaust air duct 47 may be connected to the upper portion of the tub 23.

The drain pan 531 may discharge condensate to the outside of the laundry treating apparatus B through the drain pipe 532. The drain pipe 532 may be connected to the drain pump 26. A separate transfer pump for extruding the condensate collected in the drain pan 531 may be provided in the machine room S.

The third supply air duct 48 may branch off from the second supply air duct 45, and a third discharge port 426 may be formed at a portion where the third supply air duct 48 branches off from the second supply air duct 45.

The third discharge port 426 may protrude upwardly from the second supply air duct 45. The third supply air duct 48 may connect the tub 23 and the third discharge port 426. The third supply air duct 48 may connect the tub 23 and the second supply air duct 45.

The second supply air duct 45 may be connected to the third rear panel 302 of the third cabinet 30. The second exhaust air duct 44 may pass through the third side panel of the third cabinet 30 to be connected to the heat exchange channel 42.

The second exhaust air duct 44 may connect the third cabinet 30 and the heat exchange channel 42. The second exhaust air duct 44 may extend downwardly in a lateral direction from the upper and lower sides of the third cabinet 30, to be connected to the heat exchange channel 42.

The second inlet port 422 connected to the second exhaust air duct 44 may be formed at the inlet end 42A of the heat exchange channel 42. The second inlet port 422 may extend from the heat exchange channel 42 to the lateral side. The second inlet port 422 may extend from the third exhaust air duct 47 to the lateral side. The second inlet port 422 may extend from a first duct section 471 to the lateral side.

The second inlet port 422 may protrude from one side surface of the third exhaust air duct 47 to the lateral side. The second exhaust air duct 44 may connect the inner space 33 of the refresher 3 and the second inlet port 422. The second exhaust air duct 44 may connect the inner space 33 of the refresher 3 and the third exhaust air duct 47. The air in the second exhaust air duct 44 may join the air in the third exhaust air duct 47, to flow into the heat exchange channel 42.

The third exhaust air duct 47 may extend from the upper side of the tub 23, to be connected to the heat exchange channel 42. The third exhaust air duct 47 may include the first duct section 471 located between the base plate 575 and the first lower panel 104. The first duct section 471 may be disposed in the separation space 55. The first duct section 471 may extend forwardly and rearwardly in the separation space 55.

The third inlet port 424 connected to the third exhaust air duct 47 may be formed at the inlet end 42A of the heat exchange channel 42. The third inlet port 424 may extend downwardly from the heat exchange channel 42. The third inlet port 424 may extend downwardly from the case 570 of the heating device 50.

The dehumidification duct 46 may include a second duct section 461 disposed between the base plate 575 and the first lower panel 104. The second duct section 461 may be disposed in the separation space 55. The second duct section 461 may extend forwardly and rearwardly in the separation space 55.

The outside air inlet port 423 may extend forwardly from the third exhaust air duct 47. The outside air inlet port 423 may protrude forwardly from one side of the third exhaust air duct 47. The outside air inlet port 423 may allow the inner space and the third exhaust air duct 47 to communicate with each other. The air in the outside air inlet port 423 may join the air in the third exhaust air duct 47 to flow into the heat exchange channel 42. The outside air inlet port 423 may have the outside air inlet 49 that is open forward. The air drawn in through the outside air inlet 49 may join the air in the third exhaust air duct 47 to flow into the heat exchange channel 42.

Figure 15:
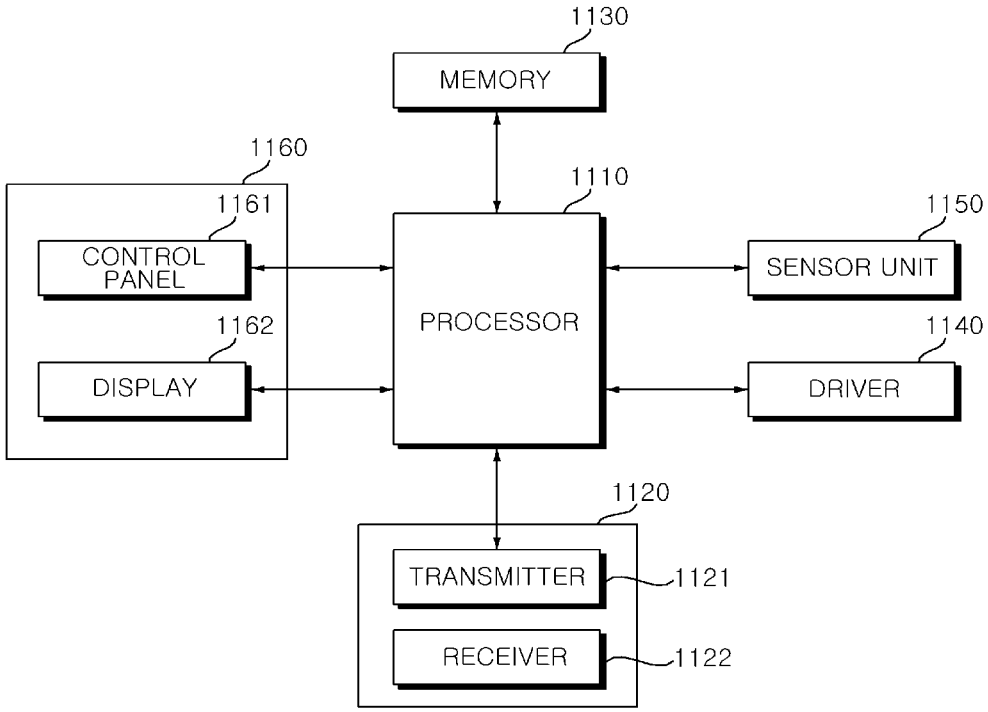
FIG. 15 is an internal block diagram schematically illustrating a laundry treating apparatus according to an embodiment of the present disclosure.

FIG. 15 is an internal block diagram schematically illustrating a laundry treating apparatus according to an embodiment of the present disclosure.

Referring to FIG. 15, at least one of the devices 1, 2, 3, and 50 included in the laundry treating apparatuses A and B may include a sensor unit 1150, an interface 1160, a memory 1130, a communication module 1120, and a processor 1110 for controlling the overall operation thereof, which may be commonly included in the respective devices 1, 2, 3, and 50, and a detailed configuration thereof may vary depending on characteristics of the apparatuses. In addition, the respective devices 1, 2, 3, and 50 may have components for performing predetermined operations and a driver 1140 for the components.

For example, the washing machine 2 may include a motor 133 for transmitting power to the second rotatable drum 240, the drain pump 260 for discharging water, generated in the laundry treating apparatuses A and B, to the outside thereof, and the like. The driver 1140 of the washing machine 2 may include a motor driver, such as an inverter and the like, for driving the motor 250, a pump driver for driving the drain pump 260, and the like.

The heating device 50 may include a steam generator 502 for generating steam and a dehumidifier 504 for removing moisture from the air flowing through the heat exchange channel 42.

The steam generator 502 may be included in another component. For example, the steam generator 502 may be disposed in the machine room S or in the dryer 1. The refresher 3 may include the hanger 36, a hanger motor for moving the hanger 36, and the like.

The sensor unit 1150 may include a plurality of sensors for sensing a state of the laundry treating apparatuses A and B. The sensor unit 1150 may include various types of sensors. For example, the sensor unit 1150 may include a temperature sensor, a humidity sensor, a pressure sensor, and the like. In addition, the sensors included in the sensor unit 1150 may be disposed at positions required for obtaining data. For example, various sensors may be disposed in the heating device 6, the duct system, and the respective laundry treating machines 1, 2, and 3.

The type, number, and installation position of sensors included in the sensor unit 1150 may vary depending on the type of the devices 1, 2, 3, and 50.

The memory 1130 may store control data for controlling operations of the devices 1, 2, 3, and 50, and operation data generated or sensed during the operations. The memory 1130 may store execution programs for each function, data for controlling the operations, and transmitted and received data.

The interface 1160 may include components for receiving a user's control command. For example, the interface 1160 may include a receiver for receiving a control command transmitted from a remote control device. Depending on embodiments, the interface 1160 may include at least one input means, such as a button, a switch, and a touch input means.

The interface 1160 may include a control panel 1611 and/or a display 1162. Here, the control panel 1611 may be the aforementioned control panel 8. Alternatively, the control panel 1611 may include a control panel disposed at another position, in addition to the control panel 8 disposed between the washing machine 2 and the dryer 1.

The display 1162 may visually display predetermined information. For example, the display 1162 may output state information of the laundry treating apparatuses A and B, data sensed by the sensors, guide information guiding a specific operation/function, and the like.

Generally, the washing machine 2 and the dryer 1 may have front surfaces through which laundry therein may be seen, such that the display 1162 is desirably disposed on a front surface of the refresher 3. Accordingly, compared to the front surfaces of the washing machine 2 and the dryer 1, the display 1162 may be implemented as a large screen display.

The display 1162 may be implemented as a touch screen and may be used as an input means.

When a user command or predetermined data is input by operating the input means, the interface 1160 may apply the input data to the processor 1110.

According to the user command and the like, the processor 1110 may control the devices 1, 2, 3, and 50. For example, the processor 1110 may control the heating device 50 to heat air. Further, the processor 1110 may switch a passage to supply the air, heated by the heating device 50, to at least one of the laundry treating machines 1, 2, and 3.

In addition, the processor 1110 may control the steam generator 502 and the like to supply steam to at least one of the laundry treating machines 1, 2, and 3.

The processor 1110 may be the aforesaid controller 690.

Alternatively, the processor 1110 may correspond to controllers provided for at least some of the devices 1, 2, 3, and 50. For example, the washing machine 2, the dryer 1, the refresher 3, and the machine room S may include respective controllers for controlling each operation thereof. In this case, the controllers may be mounted on a printed circuit board (PCB) disposed in the respective devices 1, 2, 3, and 50. The processor 1110 may correspond to the controllers of the devices 1, 2, 3, and 50 and may control the operations of the respective devices 1, 2, 3, and 50.

The respective controllers may communicate with each other. In some cases, at least one controller may be an upper level controller that may control other controllers and devices.

Further, rather than having individual controllers, some of the devices 1, 2, 3, and 50 may be operated under the control of the controllers mounted on the PCB of the other devices.

The processor 1110 may be implemented as a block of the controller, and any one controller may include a plurality of processors 1110. The plurality of processors 1110 may be disposed in the same predetermined space or may be mounted on a single PCB. Alternatively, some of the plurality of processors 1110 may be mounted on another PCB.

The devices 1, 2, 3, and 50 may communicate with another device, the mobile terminal 1020, and the like through the communication module 1120. The communication module 1120 of at least some of the devices 1, 2, 3, and 50 may include a wireless communication module to communicate wirelessly with the mobile terminal 1020 and the like. In addition, at least one of the devices 1, 2, 3, and 50 may include a plurality of different types of communication modules.

The communication module 1120 may include a transmitter 1121 for transmitting predetermined data to another device. In addition, the devices 1, 2, 3, and 50 may include a receiver 1122 for receiving predetermined data from another device. The transmitter 1121 and the receiver 1122 may be integrated as a transceiver.

By using the mobile terminal 1020, a user may execute an application or may access a predetermined website to remotely monitor and control the laundry treating apparatuses A and B. In addition, the user may receive various services by registering the laundry treating apparatuses A and B with a manufacturer or a service provider.

The laundry treating apparatuses A and B according to an embodiment of the present disclosure includes the washing machine 2, the dryer 1 disposed vertically with respect to the washing machine 2, the refresher 3 disposed on one side of the washing machine 2 and the dryer 1, and the heating device 50 heating air supplied to at least one of the washing machine 2, the dryer 1, and the refresher 3.

According to an embodiment of the present disclosure, hot air may be supplied to the washing machine 2, the dryer 1, and the refresher 3 by using the common heating device 50.

The heating device 50 may be operated based on a cycle status of at least one of the laundry treating machines 1, 2, and 3, and may heat air to supply the heated air to at least one of the washing machine 2, the dryer 1, and the refresher 3.

The heating device 50 according to an embodiment of the present disclosure supplies hot air based on the cycle status of at least one of the laundry treating machines 1, 2, and 3, such that the other laundry treating machines 1, 2, and 3 may be less affected by the cycle status of one of the laundry treating machines 1, 2, and 3, thereby operating efficiently.

The processor 1110 may control the heating device 50 to heat air and to supply the heated air (hot air) to at least one of the laundry treating machines 1, 2, and 3. The processor 1110 may control the supply of hot air based on the cycle status of at least one of the laundry treating machines 1, 2, and 3.

According to an embodiment of the present disclosure, the heating device 50 may include one compressor 51.

Alternatively, according to an embodiment of the present disclosure, the heating device 50 may include a plurality of compressors 51.

FIGS. 16 to 21 are diagrams referred to in the description of a compressor included in the heating device according to an embodiment of the present disclosure.

The compressor 51 is a device for compressing a refrigerant, and examples thereof include a reciprocating compressor 1610 that produces compression pressure by a rectilinear reciprocating motion of a piston, and rotary compressors 1620 and 1630 that produce compression pressure by a rotary motion of a roller, and a scroll compressor that produces compression pressure by the rotation of a scroll.

Figure 16:
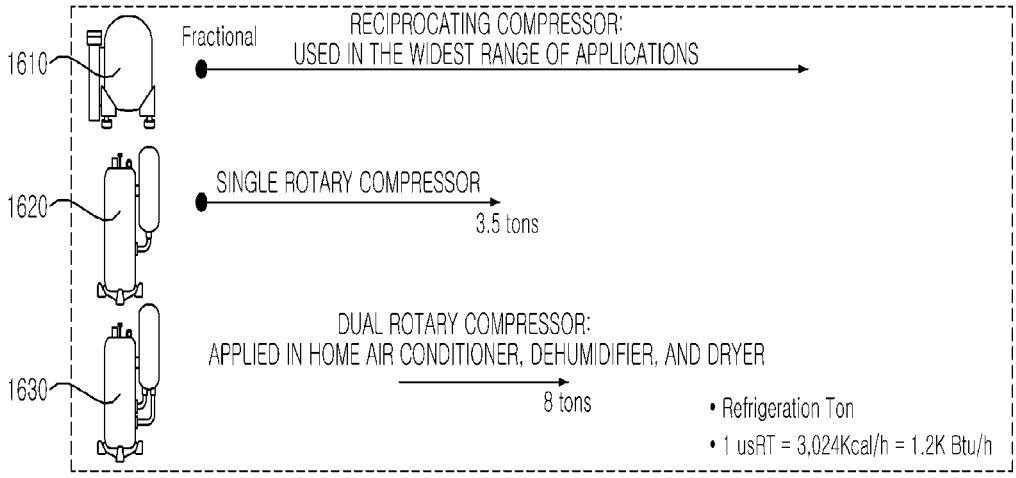

Referring to FIG. 16, the reciprocating compressor 1610 is used in the widest range of applications. Vibrations occur in the reciprocating compressor 1610 due to the rectilinear motion of the piston, but by fixing the reciprocating compressor 1610 to the machine room and the like using a supporting structure such as four springs and the like, the vibrations in the entire product may be reduced compared to the vibrations caused by the rotary motion.

In addition, a dual rotary compressor 1630, having a dual eccentric portion, has an improved efficiency over the single rotary compressor 1620, and is widely used in home appliances such as a home air conditioner, a dehumidifier, a dryer, and the like. Depending on the structure of a home appliance, a single horizontal rotary compressor may also be used, which is effective in terms of use of space and price. The scroll compressor may be used in large-capacity devices, as well as in the home appliances.

The heating device 50 according to an embodiment of the present disclosure supplies hot air to the washing machine 2, the dryer 1, and the refresher 3. Accordingly, it is required to select specifications of the compressor 51 by considering sequential operations of the washing machine 2, the dryer 1, and the refresher 3 (stepwise independent operations: washing dehydration drying refreshing). Further, in consideration of the case where the washing machine 2, the dryer 1, and the refresher 3 are operated at the same time, it is required to provide the compressor 51 having a sufficient capacity.

The heating device 50 may include the compressor 51 having a large capacity that may meet the load when the washing machine 2, the dryer 1, and the refresher 3 are operated at the same time. However, in the case of operation under low load conditions, such as low temperature drying, drying delicate clothing items such as lingerie, drying heat-sensitive clothing items such as wool/knit, etc., it is inefficient to respond to all the drying operations with one large-capacity compressor.

Accordingly, the heating device 50 includes the plurality of compressors 51 to operate with an optimal efficiency by adjusting the number of compressors 51 to be operated, an operating frequency, and the like according to load conditions. For example, when a minimum load operation is required, only one of the compressors 51 may be operated to minimize power consumption.

At least one of the compressors 51 included in the heating device 50 may have a different capacity from the other compressors. For example, by selecting and combining two compressors having different capacities, a maximum drying load may be met, and when a minimum load operation is required, only one compressor having a minimum capacity is operated to minimize power consumption.

According to an embodiment of the present disclosure, the heating device 50 may include two compressors 51, and by adjusting the number (e.g., one or two) of the compressors 51 to be operated and an operating frequency thereof, the heating device 50 may control the temperature of supplied hot air, thereby efficiently supplying hot air according to fabric characteristics and providing efficient operation by considering a drying time.

Figure 17:
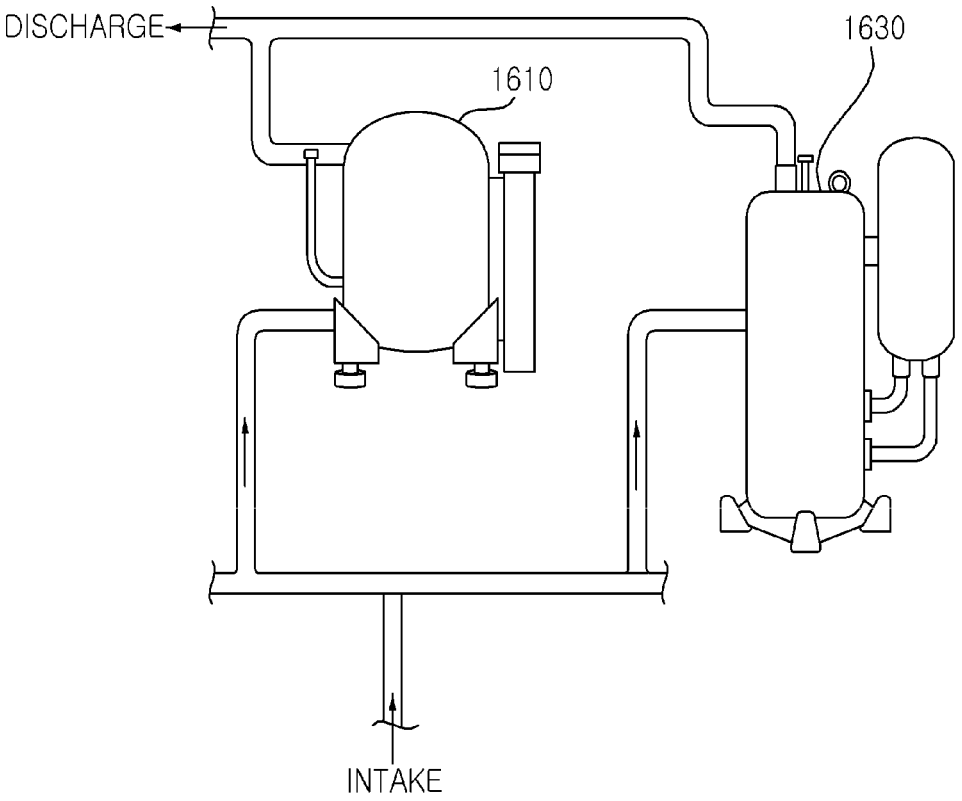

According to an embodiment of the present disclosure, the plurality of compressors 51 included in the heating device 50 may have different compression methods. Referring to FIG. 17, an example is illustrated in which the reciprocating compressor 1610 and the dual rotary compressor 1630 are connected in parallel with each other.

Further, according to an embodiment of the present disclosure, the plurality of compressors 51 included in the heating device 50 may have different capacities and compression methods. Accordingly, the compressors 51 may be provided in various combinations.

According to an embodiment of the present disclosure, the heating device 50 of integrated laundry treating apparatuses A and B, in which the washing machine 2, the dryer 1, and the refresher 3 are integrated, may include one or a plurality of compressors 51. The processor 1110 may control the operation of the compressors 51 for supplying hot air suitable for a cycle status of the respective laundry treating machines 1, 2, and 3.

For example, during a single operation in which any one of the laundry treating machines 1, 2, and 3 is individually operated, the processor 1110 may operate only one of the two compressors 51, which is suitable to the capacity of the load, to generate hot air and to supply the generated hot air to the laundry treating machine being in operation.

During an integrated operation in which the plurality of laundry treating machines 1, 2, and 3 are operated, the processor 1110 may operate two compressors 51 at the same time to generate hot air according to the capacity, and may supply the generated hot air to the laundry treating machines being in operation.

Hereinafter, an example of selecting specifications of the compressor 51 and combinations thereof will be described in detail with reference to FIGS. 18 to 21.

FIG. 18 is a diagram illustrating comparison of types and specifications of compressors applied to each of an existing dryer, washing machine, and refresher.

Referring to FIG. 18, each of the existing dryer, washing machine, and refresher includes one type of compressor. In this case, the capacity of the included compressor is set to a capacity that meets the load during a cycle of each single product.

For example, the dryer may include the dual rotary compressor having the largest capacity of 10.2 cc and the widest operation range of 1200 rpm to 7800 rpm among the illustrated products, so as to respond to the load during the drying cycle.

The washing machine using less hot air, generated by a heat pump, than the dryer may include a single horizontal rotary compressor, which is effective in terms of use of space and price. The compressor included in the washing machine may be a single horizontal rotary compressor having a capacity of 7.2 cc and an operation range of 1200 rpm to 5400 rpm.

The refresher uses hot air and steam during a clothing refreshing process, in which hot air at a relatively lower temperature than hot air for the drying cycle of the dryer is used. The refresher may use a dual rotary compressor having a capacity of 9.2 cc and an operation range of 1200 rpm to 5400 rpm, or a reciprocating compressor having a capacity of 8.2 cc and an operation range of 1200 rpm to 5400 rpm.

FIGS. 19 to 21 are diagrams illustrating examples of selecting a compressor for use in the common heating device 50 that supplies hot air and steam to the respective laundry treating machines 1, 2, and 3 in the integrated laundry treating apparatuses A and B in which the washing machine 2, the dryer 1, and the refresher 3 are integrated.

FIG. 19 is an example of selecting specifications of the compressor in the case where the washing machine 2, the dryer 1, and the refresher 3 are sequentially operated. For example, a user may operate the laundry treating apparatuses A and B in the order of washing dehydration drying refreshing. In this case, the single operation may be performed stepwise in the order of washing machine 2, the dryer 1, and the refresher 3.

Depending on embodiments, without supplying the hot air to the plurality of laundry treating machines 1, 2, and 3 at the same time, the hot air may be supplied sequentially one after another. Even in this case, the washing machine 2, the dryer 1, and the refresher 3 may be operated independently.

Referring to FIG. 19, in the existing individual product in which one dual rotary compressor having a maximum capacity of 10.2 cc is used, and the washing machine 2, the dryer 1, and the refresher 3 are operated sequentially, there is no problem with applying the maximum load to each product.

The heating device 50 may include a plurality of compressors to operate a small capacity compressor to reduce power consumption during a drying process at low operating load conditions, including low temperature drying, drying of delicate clothing items such as lingerie, drying of heat-sensitive clothing items such as wool/knit and the like.

A combination of two compressors may be selected which have a capacity corresponding to a capacity of one individual compressor. For example, a combination of the dual rotary compressor having a capacity of 6.6 cc and an operation range of 1200 rpm to 5400 rpm and the reciprocating compressor having a capacity of 4.0 cc and an operation range of 1200 rpm to 4500 rpm may be provided, thereby meeting a maximum drying load, and when a minimum load operation is required, only one compressor having a minimum capacity may be operated to minimize power consumption.

FIG. 20 is a diagram illustrating an example of selecting specifications of a compressor by considering an integrated operation in which the washing machine 2 and the dryer 1 are operated at the same time, an integrated operation in which the dryer 1 and the refresher 3 are operated at the same time, and an integrated operation in which the washing machine 2 and the refresher 3 are operated at the same time.

Referring to FIG. 20, one dual rotary compressor is applied which has a capacity of 18 cc to 20.0 cc corresponding to combined capacities of the existing individual products.

More desirably, during a drying process at low operating load conditions, a total of two compressors may be combined in which one compressor is added in consideration of an operating capacity combined with a small capacity compressor for reducing power consumption.

Referring to FIG. 20, a 10.2 cc dual rotary compressor and a 9.2 cc dual rotary compressor may be combined, or the 10.2 cc dual rotary compressor and an 8.2 cc dual rotary compressor may be combined, thereby meeting a maximum drying load, and during a minimum load operation, only one small capacity compressor may be operated to minimize power consumption.

FIG. 21 is a diagram illustrating an example of selecting specifications of a compressor in consideration of an integrated operation in which three units of the washing machine 2, the dryer 1, and the refresher 3 are operated at the same time.

Referring to FIG. 21, one dual rotary compressor is applied which has a capacity of 25 cc to 27 cc corresponding to combined capacities of the existing individual products.

More desirably, during a drying process at low operating load conditions, a total of two compressors may be combined, including a small capacity compressor for reducing power consumption, and one compressor which is added in consideration of an operating capacity during the integrated operation of all the units, thereby meeting a maximum drying load, and during a minimum load operation, only one small capacity compressor may be operated to minimize power consumption.

Referring to FIG. 21, a 17.4 cc dual rotary compressor and a 9.2 cc dual rotary compressor may be combined, or the17.4 cc dual rotary compressor and the 8.2 cc reciprocating compressor may be combined.

According to an embodiment of the present disclosure, the heating device 50 may include a plurality of compressors. A total capacity of the plurality of compressors may be greater than a sum of loads of heated air which is required for cycles of the dryer 1, the washing machine 2, and the refresher 3. Among the plurality of compressors, a capacity of a compressor having a minimum capacity may be greater than a minimum load value among the loads of the heated air, which is required for cycles of the dryer 1, the washing machine 2, and the refresher 3.

The processor 1110 may control the number of compressors 51 to be operated, according to a cycle status of the dryer 1, the washing machine, and the refresher 3.

In addition, the processor 1110 may also control an RPM of the compressors 51 to be operated, according to a cycle status of the dryer 1, the washing machine, and the refresher 3.

In the integrated laundry treating apparatus in which the common heating device 50 is used to supply hot air in three directions toward the washing machine 2, the dryer 1, and the refresher 3, it is required to selectively supply hot air according to a cycle status of the respective laundry treating machines, and a cycle status of any one machine may affect the supply of hot air to another machine. Accordingly, according to an embodiment of the present disclosure, hot air may be supplied in consideration of the temperature of hot air (high temperature/medium temperature/low temperature) according to the cycles of the respective machines.

Further, according to an embodiment of the present disclosure, hot air may be supplied differently according to a cycle status of the respective machines. For example, hot air having a high temperature may be supplied to the dryer 1, and at the same time hot air having a relatively medium temperature or low temperature may be supplied to the refresher 3. The processor 1110 may control operation by differentiating the temperature hot air supplied to the refresher 3 from the temperature hot air supplied to the dryer 1/washing machine 2 according to cycles and operation characteristics of the respective machines.

According to an embodiment of the present disclosure, by using two or more compressors 51, the number (one or two) of the operated compressors 51 and an operating RPM thereof may be controlled according to a cycle/load condition, thereby minimizing the effect of a cycle of one unit on the supply of hot air to another unit. In addition, hot air may be supplied efficiently according to fabric characteristics, and efficient operation may be provided by considering a drying time.

The processor 1110 may vary the number of the compressors 51 to be operated, according to a cycle status of one or more units. Here, the cycle status may include one or more of the following: the type of cycles performed by the respective laundry treating machines, the type of loaded laundry, and a temperature condition.

For example, if a temperature condition of the heated air, which is required for cycles of the dryer 1, the washing machine 2, and the refresher 3, is a first value, the processor 1110 may operate one compressor. If a temperature condition of the heated air, which is required for the cycles of the dryer 1, the washing machine 2, and the refresher 3, is a second value, which is greater than the first value, the processor 1110 may operate two compressors.

In addition, according to an embodiment of the present disclosure, the number of the compressors 51 to be operated may vary according to the type of laundry treating machine that requires hot air, among the dryer 1, the washing machine 2, and the refresher 3.

Further, according to a cycle status of one or more units, the processor 1110 may control the number of the compressors 51 to be operated and the operating RPM (speed of revolution) of the respective compressors 51.

For example, when only one laundry treating machine performs a cycle which requires air heated by the heating device 50 (hot air) among the cycles of the dryer 1, the washing machine 2, and the refresher 3, at least one of the RPMs of the plurality of compressors 51 may be lower than the RPMs of the plurality of compressors when two or more laundry treating machines perform cycles that require the air heated by the heating device 50.

In the case where the heating device 50 includes first and second compressors, the processor 1110 may differently control the operating frequency (RPM) of the first compressor and the second compressor. The operating frequency of the first compressor may be higher than that of the second compressor.

In the case where a plurality of units is operated, the processor 1110 may increase the operating frequency of the first compressor and the second compressor.

In the case where all the units are operated independently, the processor 1110 may decrease the operating frequency.

In the case where one or more units are all operated for low temperature drying, the processor 1110 may decrease the operating frequency of the first and second compressors or may decrease the operating frequency of either the first compressor or the second compressor.

According to an embodiment of the present disclosure, the number of the compressors 51 to be operated and the operating frequency of the respective compressors may vary depending on the number of the operated units and a combination thereof.

For example, if all of the three laundry treating machines 1, 2, and 3 require the supply of high temperature hot air, the processor 1110 may operate two compressors 51 at a high RPM. When only the refresher 3 is operated for low temperature drying, the processor 1110 may operate only one compressor 51 at a low RPM.

According to an embodiment of the present disclosure, if one laundry treating machine requires the heated air among the dryer 1, the washing machine 2, and the refresher 3, the processor 1110 may operate one compressor 51, and if two laundry treating machines require the heated air among the dryer 1, the washing machine 2, and the refresher 3, the processor 1110 may operate two compressors 51.

If one compressor is insufficient to supply hot air to all of the three units, the processor 1110 may further operate one additional compressor. In addition, if the plurality of compressors 51 are operated, the operated compressors may be turned off at different times. The processor 1110 may operate two compressors when the plurality of units performs a drying cycle, and then when a drying cycle of one unit is finished, the processor 1110 may turn off one of the compressors.

The temperature of the hot air supplied to the refresher 3 may be different from the temperature of the hot air supplied to the dryer 1/washing machine 2. By controlling the operation of the compressors, the processor 1110 may adjust the temperature of the hot air. Even when all the units are operated at the same time, the processor 1110 may separately supply hot air suitable for operating conditions and loads of the respective units.

According to an embodiment of the present disclosure, a cooler may be disposed in a passage between the heating device 50 and the refresher 3. The cooler for reducing the temperature of flowing air, discharged to the refresher 3, may be disposed in the hot air passage. In the case where the refresher 3 and one or more units 1 and 2 are operated at the same time, the cooler may be operated. The cooler is operated when hot air is supplied to the refresher 3 and the other laundry treating machines 1 and 2 at the same time, thereby preventing damage to clothing which is caused by high temperature hot air supplied to the refresher 3.

According to an embodiment of the present disclosure, flow control valves 2315 and 2325 (see FIG. 23) may be further provided in a passage between the heating device 50 and the dryer 1, a passage between the heating device 50 and the washing machine 2, and the passage between the heating device 50 and the refresher 3.

An opening degree of the flow control valves 2315 and 2325 may be changed based on temperature conditions during cycles of the laundry treating machines connected to the passages in which the flow control valves 2315 and 2325 are disposed. According to the cycle status of the laundry treating machines 1, 2, and 3, the processor 1110 may control the heating device 50 and the flow control valves 2315 and 2325.

When only one of the compressors 51 is operated, and the air heated by the heating device 50 is supplied to any one laundry treating machine among the dryer 1, the washing machine 2, and the refresher 3, the flow control valves 2315 and 2325 disposed in the passages for supplying the heated air may be opened to the maximum.

When only one of the compressors 51 is operated, and the air heated by the heating device 50 is supplied to two or more laundry treating machines among the dryer 1, the washing machine 2, and the refresher 3, the heating device 50 is operated based on the laundry treating machine requiring air of the highest temperature. In this case, the processor 1110 may control the flow control valves 2315 and 2325, disposed in the passages connected to the laundry treating machines requiring air of a lower temperature than the highest temperature, to be opened to the minimum. In addition, the processor 1110 may gradually increase the opening degree of the flow control valves 2315 and 2325 which are opened to the minimum. For example, in the case where hot air supplied for high temperature drying is branched into air for low temperature drying, the processor 1110 may first open the flow control valves to a minimum opening degree according to the low drying temperature, and then may gradually increase the opening degree thereof until a target low temperature is reached.

When the air heated by the heating device 50 is supplied to any one laundry treating machine among the dryer 1, the washing machine 2, and the refresher 3, the heating device 50 may operate one or two compressors 51 according to the temperature condition of the laundry treating machine supplied with the hot air. In addition, the flow control valves 2315 and 2325, disposed in the passages connected to the laundry treating machine supplied with the hot air, may be opened according to the temperature condition.

When the air heated by the heating device 50 is supplied to two or more laundry treating machines among the dryer 1, the washing machine 2, and the refresher 3, the heating device 50 may operate one or two compressors 51 based on a highest temperature condition, among the temperature conditions of the laundry treating machines supplied with the hot air. In addition, the flow control valves 2315 and 2325, disposed in the passages connected to the laundry treating machine under a temperature condition lower than the highest temperature condition, may be opened to the minimum, and the opening degree thereof may gradually increase.

Hereinafter, an example of supplying hot air will be described in detail according to an embodiment of the present disclosure.

Figure 22:
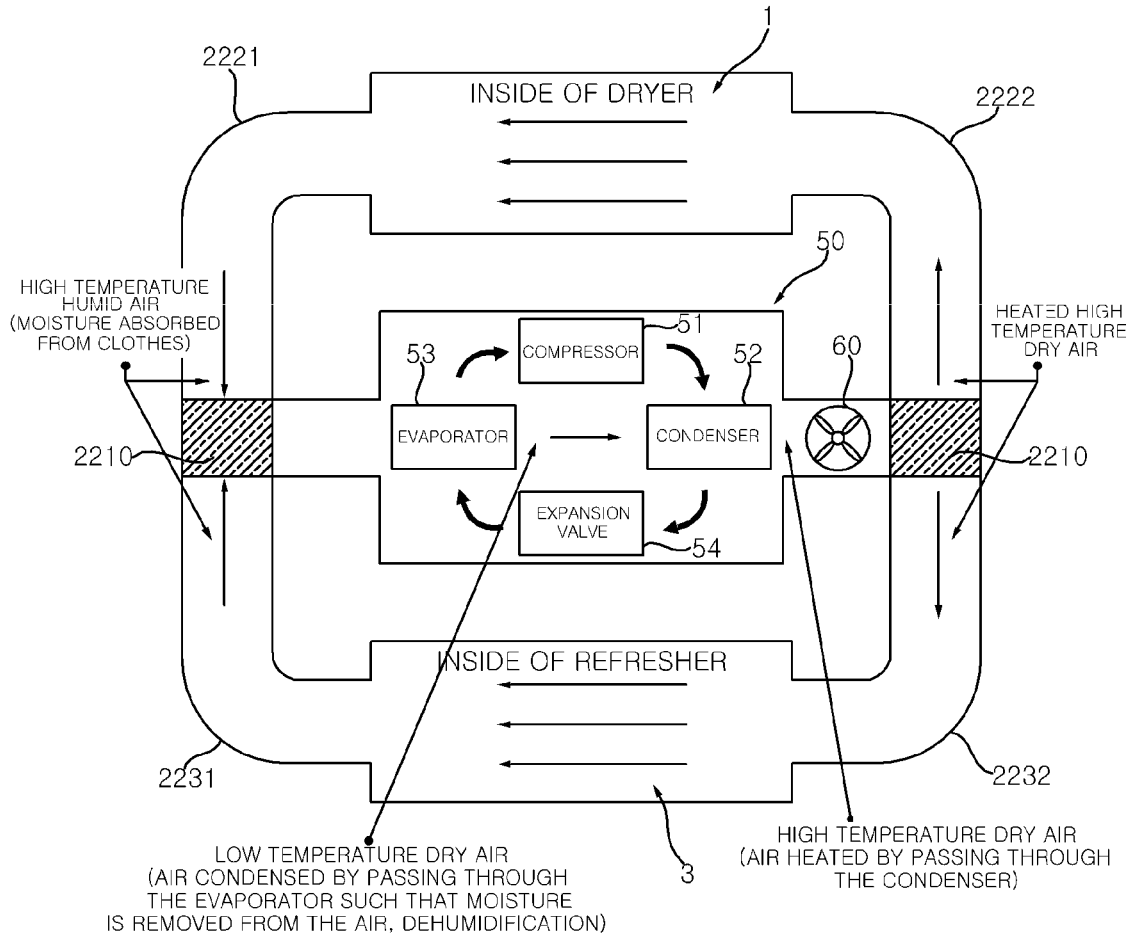
FIG. 22 is a diagram referred to in the description of an example of supplying hot air according to an embodiment of the present disclosure.

FIG. 22 is a diagram referred to in the description of an example of supplying hot air according to an embodiment of the present disclosure, in which hot air is supplied to the dryer 1 and the refresher 3.

Referring to FIG. 22, the heating device 50 disposed in the machine room S may heat introduced air to generate high temperature hot air. The hot air generated by the heating device 50 is supplied to the washing machine 2, the dryer 1, and the refresher 3 to dry laundry placed in the respective laundry treating machines 1, 2, and 3, and then may be recovered to the heating device 50.

The heating device 50 may include the compressor 51, the condenser 52, the evaporator 53, and the expansion device 54. In addition, the heating device 50 may further include the fan 60.

As described above, the laundry treating apparatuses A and B may include a distribution device 2210 and/or the switching device 70 for distributing the air, blown by the fan 60, to each of the dryer 1, the washing machine 2, the refresher 3, and the dehumidification duct 46. The distribution device 2210 and/or the switching device 70 may be disposed in the machine room S, the passages 2221, 2222, 2231, and 2232, and the like.

The distribution device 2210 may be a valve. For example, the distribution device 2210 may include branch pipes 2310 and 2320 and the flow control valves 2315 and 2325.

Figure 23:
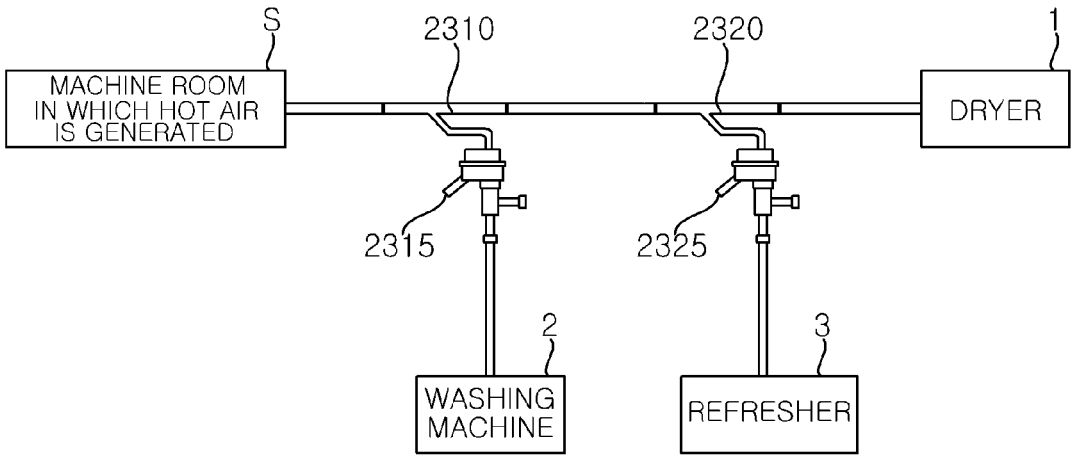
FIG. 23 is a diagram referred to in the description of an example of supplying hot air according to an embodiment of the present disclosure.

FIG. 23 is a diagram referred to in the description of an example of supplying hot air according to an embodiment of the present disclosure, in which the branch pipes 2310 and 2320 and the flow control valves 2315 and 2325 are illustrated. While FIG. 23 illustrates an example in which the flow controls valves 2315 and 2325 are disposed in a branch passage toward the washing machine 2 and the refresher 3, the present disclosure is not limited thereto. For example, the flow controls valves 2315 and 2325 may also be disposed in a main passage toward the dryer 1. Particularly, the flow controls valves 2315 and 2325 may be disposed after the branch pipe 2320 for controlling a flow amount of the dryer 1.

During the integrated operation of the plurality of units 1, 2, and 3, hot air generated by operating two compressors is supplied according to operating conditions of the respective units 1, 2, and 3.

The processor 1110 may adjust the temperature and amount of hot air by controlling the branch pipes 2310 and 2320 and the flow control valves 2315 and 2325 installed at an inlet of a duct for supplying the hot air to the respective units 1, 2, and 3, thereby supplying hot air at an optimal temperature.

The flow control valves 2315 and 2325 may be opened and closed to control a flow amount. The processor 1110 may also control a minute flow amount by controlling an opening degree of the flow control valves 2315 and 2325.

The flow control valves 2315 and 2325 may be an Electronic Expansion Valve (EEV). By controlling a minute flow amount of hot air by controlling an opening degree from 0 to 500 steps and from 0 to 2,000 steps, the processor 1110 may supply hot air according to an optimal temperature for each product.

During a drying cycle, high temperature humid air (moisture absorbed from clothes) is introduced into the heating device 50, and moisture is removed from the air by passing through the evaporator 53. Then, low temperature dry air, having passed through the evaporator 53, may be heated by passing through the condenser 52. The heating device 50 discharges high temperature dry air, which is heated by passing through the condenser 52, to the laundry treating machines 1, 2, and 3 operating in the drying cycle.

Meanwhile, the processor 1110 may control the temperature of hot air by controlling operation of the compressor 51.

For example, the processor 1110 may increase an amount of refrigerant by operating both of the first and second compressors at the same time or by increasing the RPM of the compressor. Accordingly, the increased amount of refrigerant (increase in heat exchange quantity) may lead to an increase in temperature of the hot air having passed through the condenser 52 and flowing toward the dryer 1 and the refresher 3.

Meanwhile, in an example in which one heating device 50 generates hot air and supplies the hot air through one duct, if it is required to supply the hot air to a plurality of units, the heating device 50 may supply the hot air to the units, requiring the hot air, through passages branching off from the main duct.

In addition, the processor 1110 may operate only one of the first and second compressors, and may stop the other one or may reduce the RPM of the compressor. Accordingly, the decreased amount of refrigerant (decrease in heat exchange quantity) may lead to decrease in temperature of the hot air having passed through the condenser 52 and flowing toward the dryer 1 and the refresher 3.

Meanwhile, the processor 1110 may change compressor control conditions according to operating conditions, such as the type of clothes, drying load, high temperature/low temperature drying, and the like.

In the case where a drying load is high during high temperature drying of bedding and the like, or in the case where high temperature hot air is required for high speed drying and the like, the processor 1110 may operate two or more compressors 51. When a plurality of units among the dryer 1, the washing machine 2, and the refresher 3 are performed in the integrated operation in which one main duct is used, it is required to maintain the temperature of hot air in consideration of distribution of the supply of hot air.

The processor 110 may operate only one compressor 51 when only one unit performs drying, when low temperature drying is performed, when drying of delicate clothing items, such as lingerie, or heat-sensitive clothing items, such as wool/knit is performed, or when it is required to perform drying with hot air at a reduced temperature.

Even when the plurality of units is operated, if the drying is performed by reducing the temperature of hot air in the above conditions, the processor 1110 may operate only one compressor.

Further, when one or two products finish drying after the plurality of units are operated, the processor 1110 may stop operating one of the two compressors being in operation.

Figure 24:
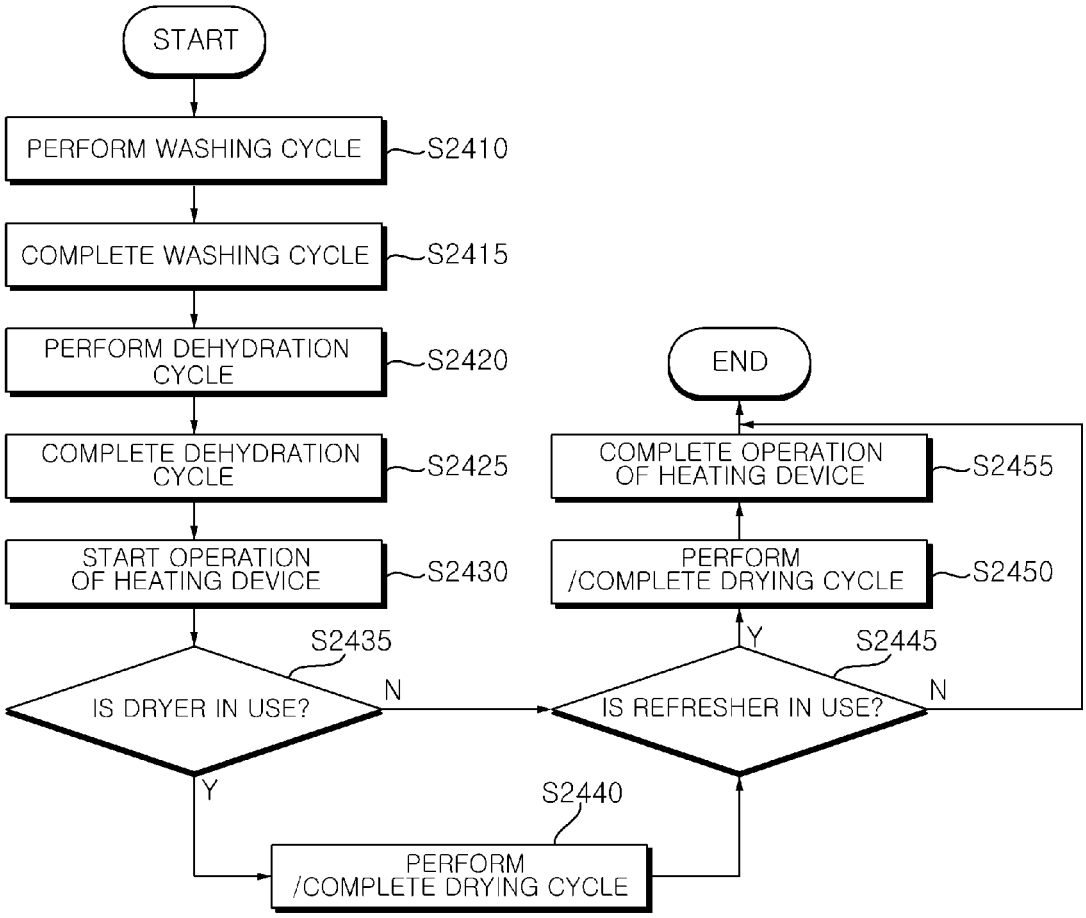
FIG. 24 is a flowchart illustrating a method of operating a laundry treating apparatus according to an embodiment of the present disclosure.

FIG. 24 is a diagram illustrating a method of operating a laundry treating apparatus according to an embodiment of the present disclosure, in which washing and drying processes of laundry are sequentially performed in an integrated laundry treating apparatus including only one compressor or in an integrated laundry treating apparatus including a plurality of compressors and one of the plurality of compressors being in operation.

Referring to FIG. 24, the washing machine 2 performs a washing cycle for washing laundry loaded therein (S2410). Upon completing the washing cycle (S2415), the washing machine 2 may perform a dehydration cycle (S2420).

Once the dehydration cycle is complete (S2425), operation of the heating device 50 may be started (S2430), and even if the dryer is detected to be in use (S2435), the dryer 1 may perform a drying cycle (S2440). In some cases, the washing machine 2 or the refresher 3 may perform the drying cycle (S2450). In addition, even when the dryer 1 is used (S2435), the refresher 3 may also be used, and operation of the heating device 50 may be completed (S2445).

According to an embodiment of the present disclosure, the hot air supply passage may be changed rapidly according to the cycle status of the units, thereby providing efficient operation.

The temperature of hot air in the drying cycle (S2440) of the dryer 1 and the drying cycle (S2450) of the refresher 3 may be controlled by controlling the RPM of the compressor. For example, the heating device 50 may increase the RPM of the compressor to generate high temperature hot air required for the drying cycle (S2440) of the dryer 1. By reducing the RPM of the compressor, the heating device 50 may generate low temperature hot air required for the drying cycle (S2450) of the refresher 3.

Meanwhile, an opening degree of the flow control valve 2325, which branches off from one hot air passage duct, is opened to the maximum, thereby controlling the temperature of branched and supplied hot air by controlling the RPM of the compressor. For example, by increasing the RPM of the compressor, the heating device 50 may generate high temperature hot air required for the drying cycle (S2440) of the dryer 1, and by controlling the opening degree of the flow control valve 2325, the heating device 50 may gradually supply the hot air to the refresher 3, thereby preventing the temperature of air supplied to the refresher 3 from increasing rapidly.

Meanwhile, if there is no unit that performs a drying cycle using hot air among the laundry treating machines 1, 2, and 3, the heating device 50 may complete the operation and may be turned off (S2455).

Figure 25:
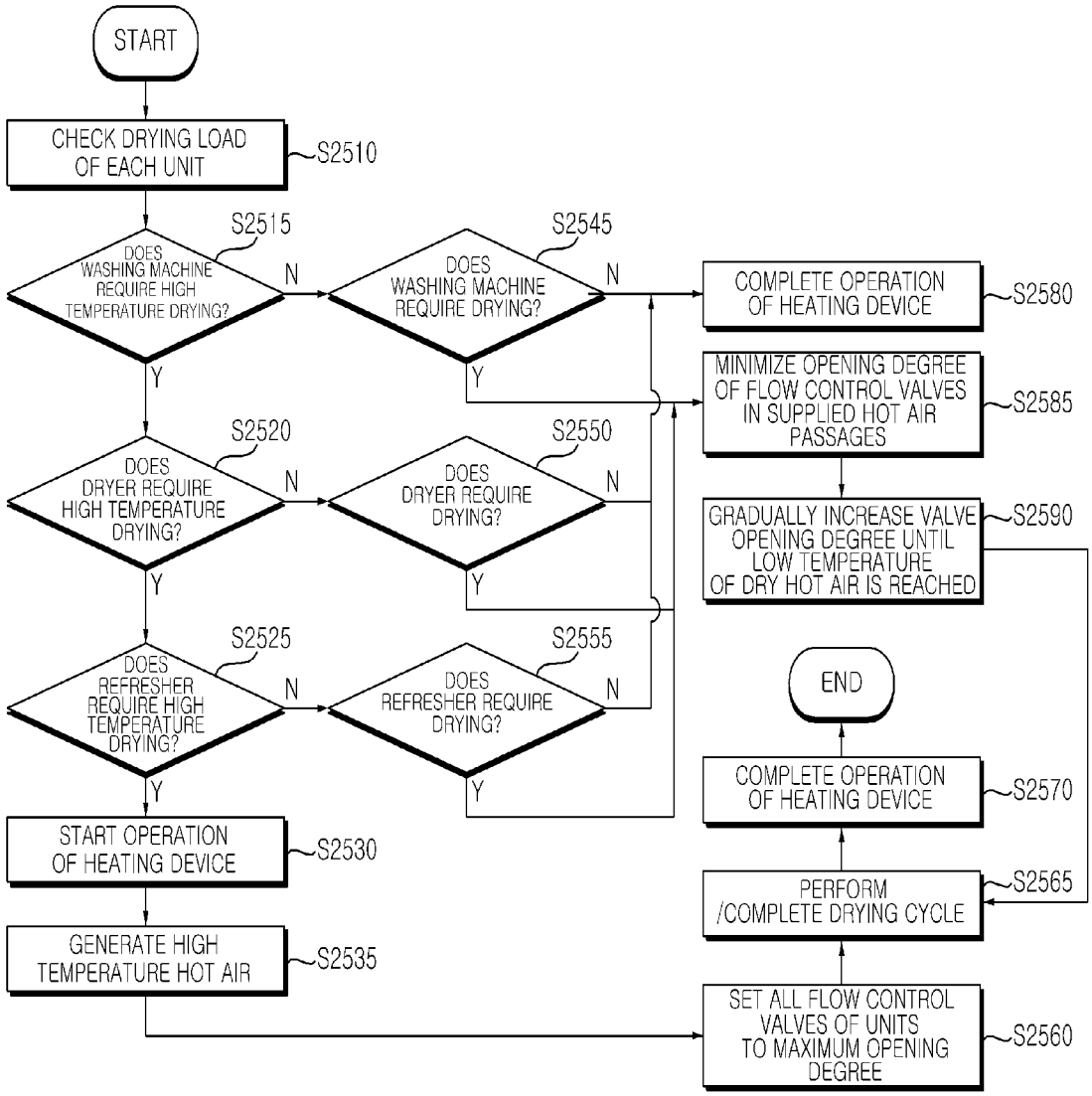
FIG. 25 is a flowchart illustrating a method of operating a laundry treating apparatus according to an embodiment of the present disclosure.

FIG. 25 is a flowchart illustrating a method of operating a laundry treating apparatus according to an embodiment of the present disclosure, in which in an integrated laundry treating apparatus with one compressor being in operation, a plurality of units requires a drying function.

The processor 1110 may check a drying load for each unit (S2510).

The processor 1110 may operate the heating device 50 (S2530) by selecting temperature of hot air based on units requiring high temperature drying (S2515, S2520 and S2525).

For example, if the dryer 1 requires high temperature drying (S2520) and the refresher 3 also requires high temperature drying (S2525), the heating device 50 is operated based on a drying cycle of one of the dryer 1 and the refresher 3, which requires a higher temperature condition (S2530).

If only one unit requires drying, the heating device 50 is operated according to a corresponding temperature condition (S2530).

In the case where high temperature drying is not required (S2515, S2520, and S2525) and medium temperature or low temperature drying is also not required (S2545, S2550, and S2555), the processor 1110 may block the supply of hot air to corresponding units (S2580).

In the case where high temperature drying is not required (S2515, S2520, and S2525), but drying is required (S2545, S2550, and S2555), the processor 1110 may minimize an opening degree of the flow control valves 2315 and 2325 in hot air passages for supplying the hot air to corresponding units, thereby preventing the high temperature hot air from being supplied all at once (S2585). Then, the processor 1110 may gradually increase the opening degree (S2590).

That is, when supplying hot air to units performing low temperature drying and requiring prevention of fabric damage, the processor 1110 may start to supply the hot air by opening the flow control valves 2315 and 2325, which controls a flow amount of hot air, to a minimum opening degree, and then may gradually increase the opening degree of the flow control valves 2315 and 2325 until a target temperature is reached.

The heating device 50 generates hot air based on units requiring high temperature drying (S2535). If all the laundry treating machines 1, 2, and 3 perform high temperature drying (S2515, S2520, and S2525), the processor 1110 may open all the flow control valves 2315 and 2325 to the maximum (S2560), and may perform the drying cycle (S2565).

Meanwhile, when all the laundry treating machines 1, 2, and 3 complete the drying cycle (S2565), the heating device 50 may be turned off (S2570).

Figure 26:
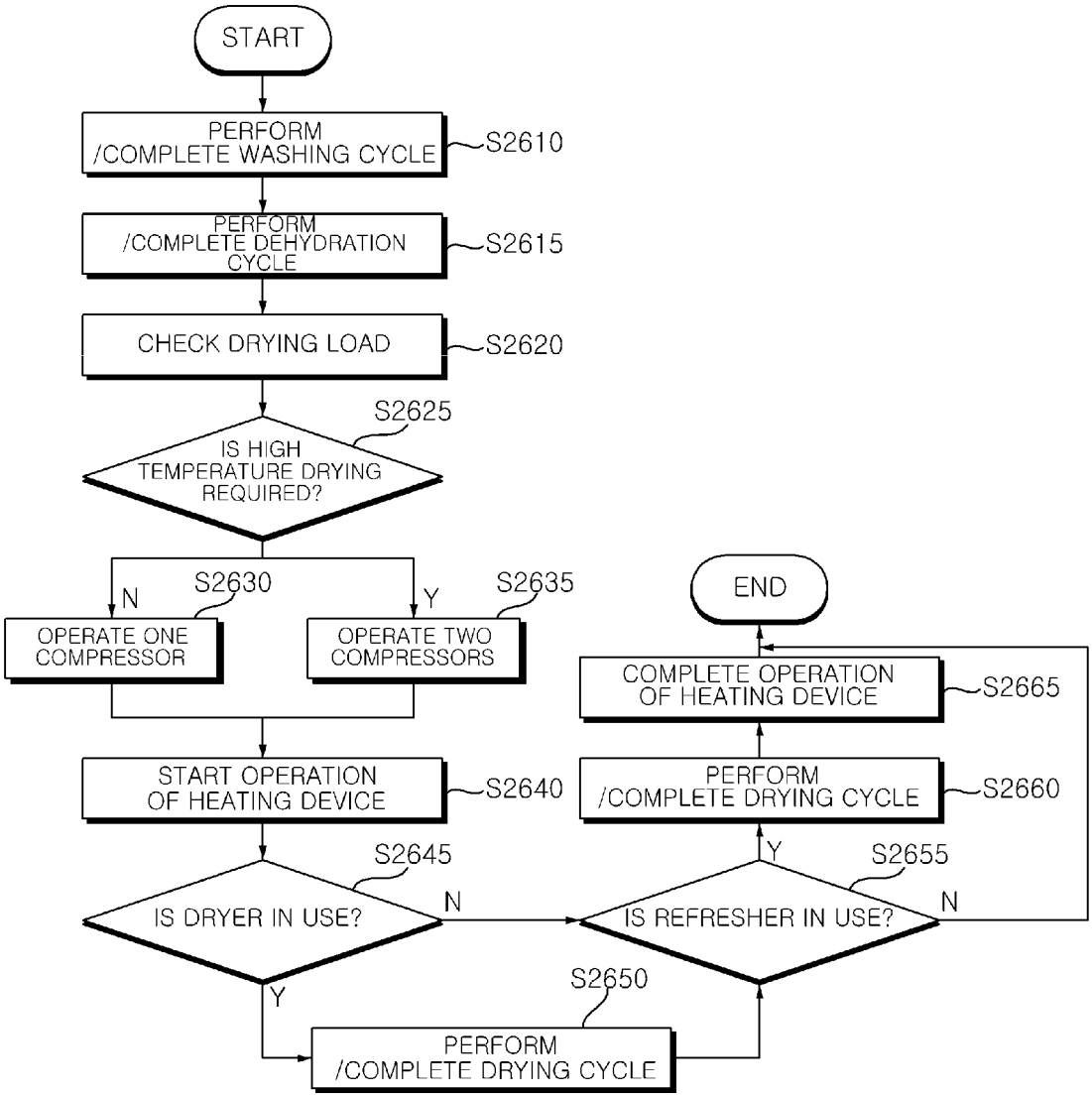
FIG. 26 is a flowchart illustrating a method of operating a laundry treating apparatus according to an embodiment of the present disclosure.

FIG. 26 is a flowchart illustrating a method of operating a laundry treating apparatus according to an embodiment of the present disclosure, in which in an integrated laundry treating apparatus including two compressors, washing and drying processes of laundry are sequentially performed.

Referring to FIG. 26, when a washing cycle and/or a dehydration cycle are complete (S2610 and S2615), the processor 1110 may check a drying load of each unit (S2620).

In the case where the units sequentially perform a drying cycle, the temperature of hot air may be adjusted by controlling the number of compressors to be operated. If high temperature drying is required (S2625), the processor 1110 may operate two compressors 51 (S2635), and if high temperature drying is not required (S2625), the processor 1110 may operate one compressor 51 (S2630). The processor 1110 may operate two compressors to increase the temperature of hot air for high temperature drying, and the processor 1110 may operate one compressor to control the temperature of hot air for low temperature drying/drying while preventing fabric damage.

Meanwhile, an opening degree of a control valve in a passage branching off from one hot air passage duct may be opened to the maximum, and the temperature of branched and supplied hot air may be adjusted by controlling the RPM of the compressor. In addition, the temperature of the hot air may be adjusted by controlling an opening degree of a control valve in a hot air passage branching off from one hot air passage duct according to the temperature of a hot air passage through which the hot air is supplied.

Meanwhile, the heating device 50 may be operated based on a high temperature condition among drying loads of each unit (S2640).

Meanwhile, when the dryer 1 is used (S2645), the dryer 1 may perform a drying cycle (S2650). When the dryer is not in use (S2645), the refresher 3 may be used (S2655). Further, even when the dryer 1 is used (S2645), the refresher 3 may also be used (S2655).

Meanwhile, if drying cycles of all the laundry treating machines 1, 2, and 3 are complete (S2650 and S2660), or if laundry treating machines 1, 2, and 3 do not require drying (S2645 and S2655), the heating device 50 may be turned off (S2665).

Figure 27:
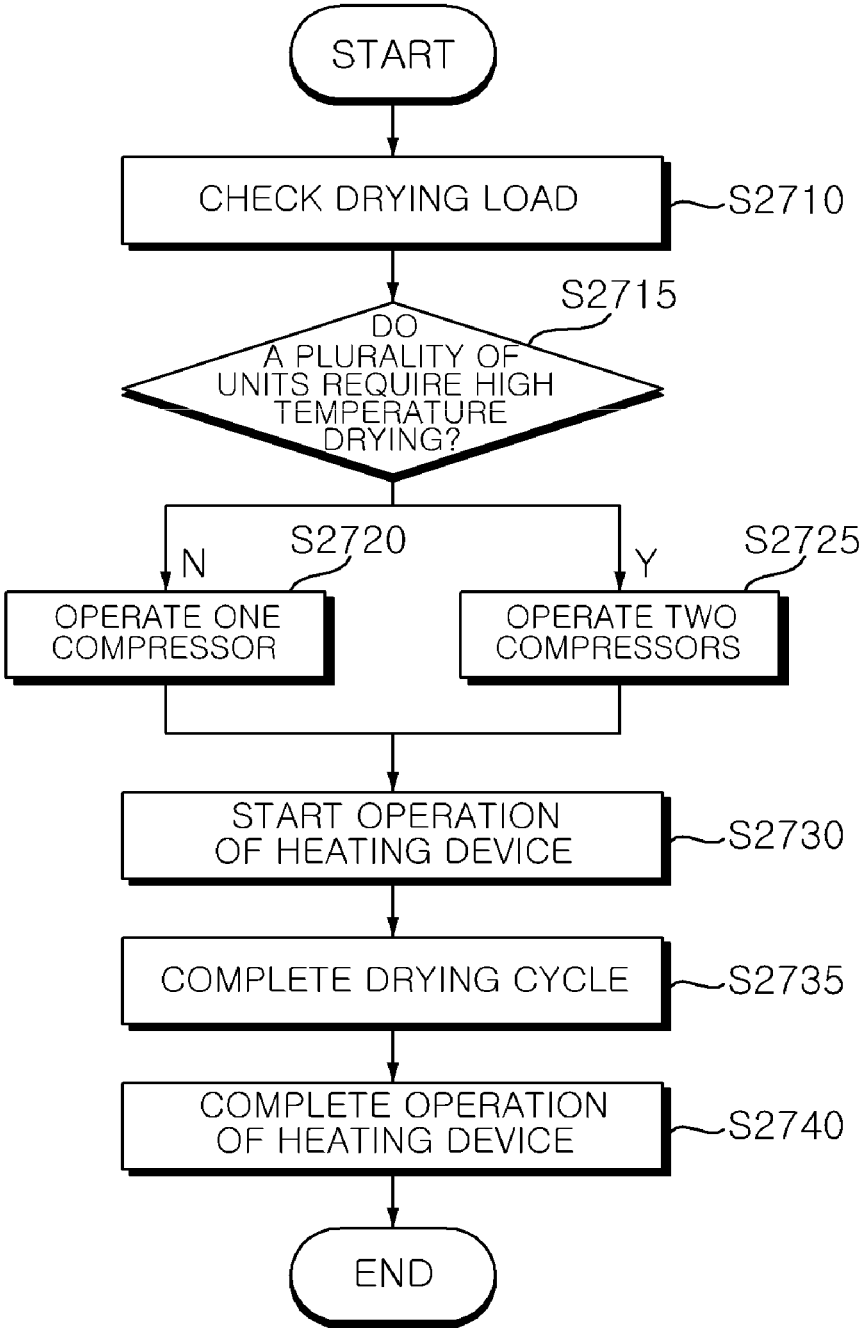
FIG. 27 is a flowchart illustrating a method of operating a laundry treating apparatus according to an embodiment of the present disclosure.

FIG. 27 is a flowchart illustrating a method of operating a laundry treating apparatus according to an embodiment of the present disclosure, in which in an integrated laundry treating apparatus including two compressors, a plurality of units requires a drying function.

The processor 1110 checks a drying load of each unit (S2710), and in response to the number of laundry treating machines 1, 2, and 3 that require high temperature drying (S2715), the processor 1110 may determine the number of compressors to be operated (S2720 and S2725).

If a plurality of units requires the high temperature drying (S2715), the processor 1110 may operate two compressors (S2725). If one unit requires the high temperature drying (S2715), or one or more units require only low temperature drying, the processor 1110 may operate one compressor to control the temperature of hot air (S2720).

Meanwhile, the processor 1110 may operate the heating device 50 by selecting the temperature of hot air based on units that require the high temperature drying (S2730).

For example, if the dryer 1 and the refresher 3 require the high temperature drying (S2715), the compressors may be operated based on a drying cycle of one of the dryer 1 or the refresher 3, which requires a higher temperature condition (S2725 and S2730).

If only one unit requires the high temperature drying (S2715), one compressor may be operated (S2720 and S2730).

If the drying cycle is complete (S2735), the heating device 50 may be turned off (S2740).

Meanwhile, when two compressors are operated for the high temperature drying of the plurality of units, and then one unit completes drying, the operation of one of the two compressors may be stopped.

When one unit performs high temperature drying and the other one performs low temperature drying while two compressors are operated, high temperature hot air may be generated for the high temperature drying.

The generated high temperature hot air may be supplied as it is to the unit that performs the high temperature drying. An opening degree of a control valve installed at an inlet of hot air supplied to a low temperature drying unit is opened to the minimum, and then the opening degree may gradually increase until a target temperature is reached.

According to at least one of the embodiments of the present disclosure, hot air suitable for operating conditions and loads of the respective laundry treating machines may be generated and supplied efficiently.

In addition, according to at least one of the embodiments of the present disclosure, the laundry treating machines may perform operation optimized for the operating conditions and loads.

Figure 28:
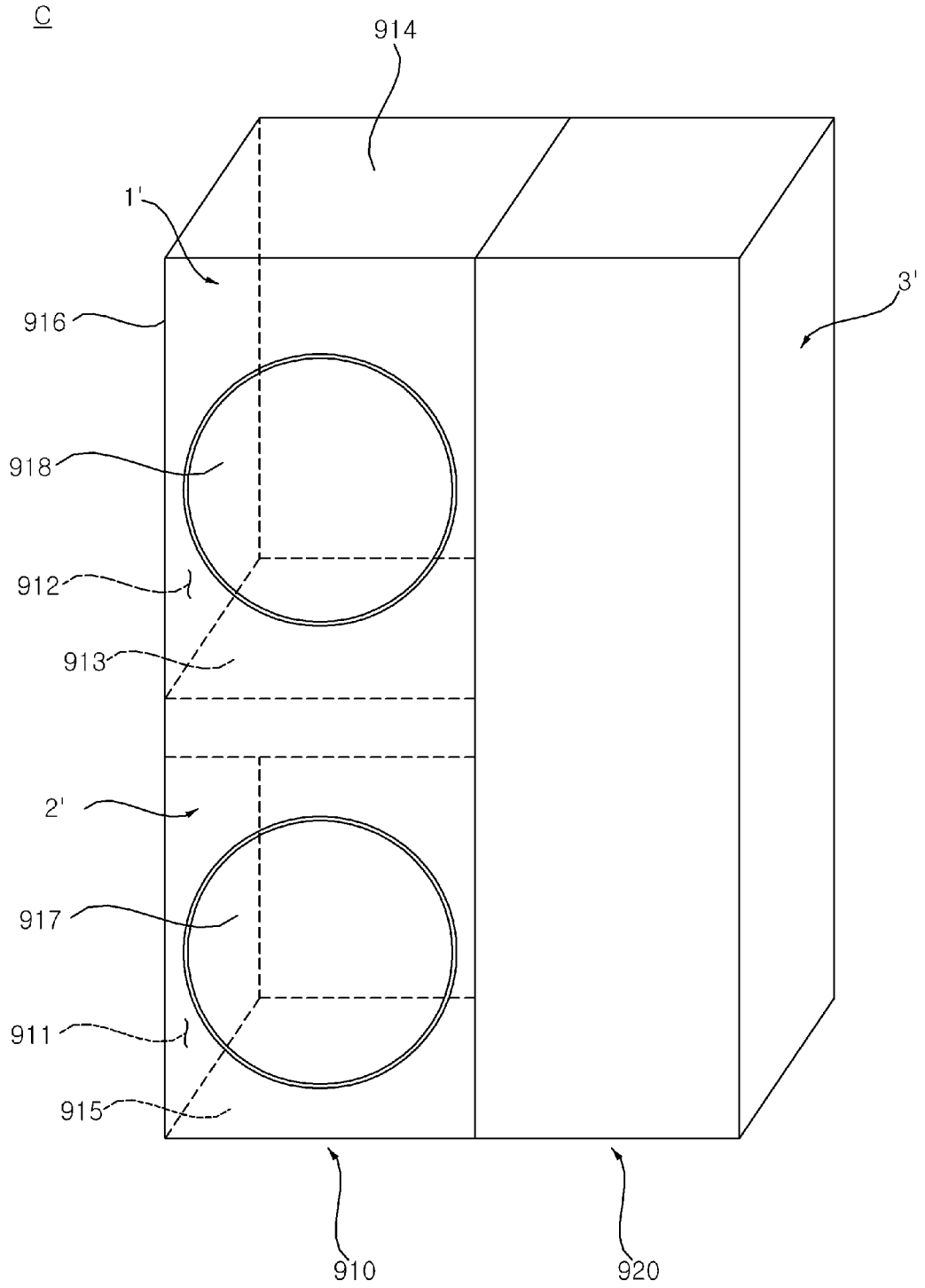
FIG. 28 is a perspective view of a laundry treating apparatus according to another embodiment of the present disclosure.

Hereinafter, a laundry treating apparatus C according to another embodiment of the present disclosure will be described with reference to FIG. 28.

The laundry treating apparatus C according to another embodiment of the present disclosure may include an integrated frame 910, and a refresher 3' disposed on one side of the integrated frame 910.

The refresher 3' may include a third cabinet 920 disposed on one side of the integrated frame 910, and a description of the third cabinet 920 and the refresher 3' is the same as the above description of the embodiments (see FIGS. 1 to 14) of the present disclosure. The third cabinet 920 or a portion of the third cabinet 920 may be referred to as a "side frame."

The laundry treating apparatus C may include a horizontal partition wall 913 disposed at an intermediate position of the integrated frame 910.

A washing room 911, in which the tub 23 and the second drum 24 are disposed, may be formed between the horizontal partition wall 913 and a lower panel 915 of the integrated frame 910. An internal structure of the washing room 911 is the same as the internal structure of the washing machine 2 according to an embodiment of the present disclosure.

The second laundry loading opening 22 may be formed in the front surface of the integrated frame 910, and the laundry treating apparatus B may have a second door 917 for opening and closing the second laundry loading opening 22.

A drying room 912, in which the first drum 13 is disposed, may be formed between an upper panel 914 and the horizontal partition wall 913 of the integrated frame 910. An internal structure of the drying room 912 is the same as the internal structure of the dryer 1 according to an embodiment of the present disclosure. The drying room 912 may also include a side panel 916.

The first laundry loading opening 12 may be formed in a front surface of the integrated frame 910, and the laundry treating apparatus B may have a first door 918 for opening and closing the first laundry loading opening 12.

The horizontal partition wall 913 may separate the washing room 911 from the drying room 912. The washing room 911 may be formed under the horizontal partition wall 913, and the drying room 912 may be formed over the horizontal partition wall 912.

The horizontal partition wall 913 may be separated from the integrated frame 910. The horizontal partition wall 913 may be assembled to the integrated frame 910, and the washing room 911 and the drying room 912 may communicate with each other before the horizontal partition wall 913 is assembled to the integrated frame 910.

An upper side of the horizontal partition wall 913 may be divided as the dryer 1' and a lower side of the horizontal partition all 913 may be divided as the washing machine 2'.

The heating device 50 may be disposed over the horizontal partition wall 913. The heating device 50 may be disposed in the drying room 912.

The above description of the laundry treating apparatuses A and B according to the embodiments of the present disclosure may also be applied to a description of other components.

Figure 29:
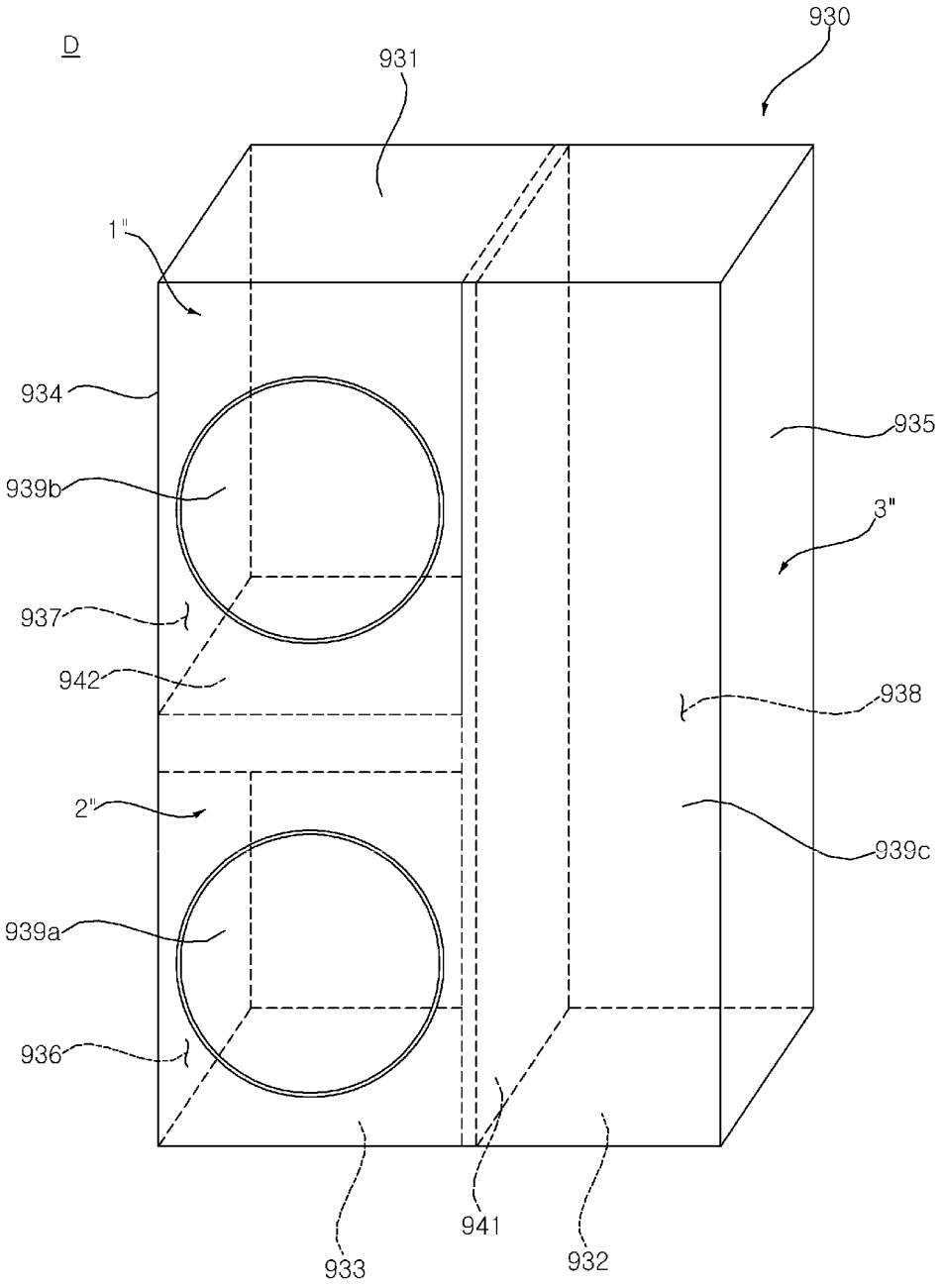
FIG. 29 is a perspective view of a laundry treating apparatus according to yet another embodiment of the present disclosure.

Hereinafter, a laundry treating apparatus D according to yet another embodiment of the present disclosure will be described with reference to FIG. 29.

The laundry treating apparatus D according to yet another embodiment of the present disclosure may include a single frame 930.

The laundry treating apparatus D may include a vertical partition wall 941 disposed in the single frame 930, and a horizontal partition wall 942 disposed between the vertical partition wall 941 and one side panel 934 of the single frame 930.

A washing room 936 and a drying room 937 may be separated vertically by the horizontal partition wall 942 between the one side panel 934 and the vertical partition wall 942 of the single frame 930.

The washing room 936 may be formed between the horizontal partition wall 942 and a lower panel 932 of the single frame 930. An internal structure of the washing room 936 is the same as the internal structure of the washing machine 2 according to an embodiment of the present disclosure.

A second laundry loading opening 22 may be formed in a front panel 933 of the single frame 930, and the laundry treating apparatus C may have a second door 939*a* for opening and closing the second laundry loading opening 22.

The drying room 937 may be formed between the horizontal partition wall 942 and an upper panel 931 of the single frame 930. An internal structure of the drying room 937 is the same as the internal structure of the dryer 3 according to an embodiment of the present disclosure.

A first laundry loading opening 12 may be formed in the front panel 933 of the single frame 930, and the laundry treating apparatus C may have a first door 939*b* for opening and closing the first laundry loading opening 12.

A refreshing room 938 for treating clothes may be formed between the vertical partition wall 941 and the other side panel 935. A description of a refresher 3" having the refreshing room 938 formed therein is the same as the above description of the refresher 3 according to an embodiment of the present disclosure.

A third laundry treating opening 32 may be formed in the front panel 933 of the single frame 930, and the laundry treating apparatus C may have a third door 939*c* for opening and closing the third laundry loading opening 32.

The vertical partition wall 941 may separate the washing room 936 from the refreshing room 938. The vertical partition wall 941 may separate the drying room 937 from the refreshing room 938. The washing room 936 and the drying room 937 may be formed one side of the vertical partition wall 941, and the refreshing room 938 may be formed on the other side thereof. That is, the washing room 936 and the drying room 937, which communicate with each other, may be formed between the vertical partition wall 941 and the one side panel 934, and the refreshing room 938 may be formed between the vertical partition wall 941 and the other side panel 935.

The vertical partition wall 941 may be separated from the single frame 930. The vertical partition wall 941 may be assembled to the single frame 930, and the washing room 936, the drying room 937, and the refreshing room 938 may communicate with each other before the vertical partition wall 941 is assembled to the single frame 930.

The horizontal partition wall 942 may separate the washing room 936 from the drying room 937. The washing room 936 may be formed under the horizontal partition wall 942, and the drying room 937 may be formed over the horizontal partition wall 942.

The horizontal partition wall 942 may be separated from the single frame 930. The horizontal partition wall 942 may be assembled to the single frame 930, and the washing room 936 and the drying room 937 may communicate with each other before the horizontal partition wall 942 is assembled to the single frame 930.

An upper side of the horizontal partition wall 942 may be divided as the dryer 1", and a lower side of the horizontal partition wall 942 may be divided as the washing room 2".

The heating device 50 may be disposed over the horizontal partition wall 942. The heating device 50 may be disposed in the drying room 937.

The above description of the laundry treating apparatuses A and B according to the embodiments of the present disclosure may also be applied to a description of other components.

Figure 30:
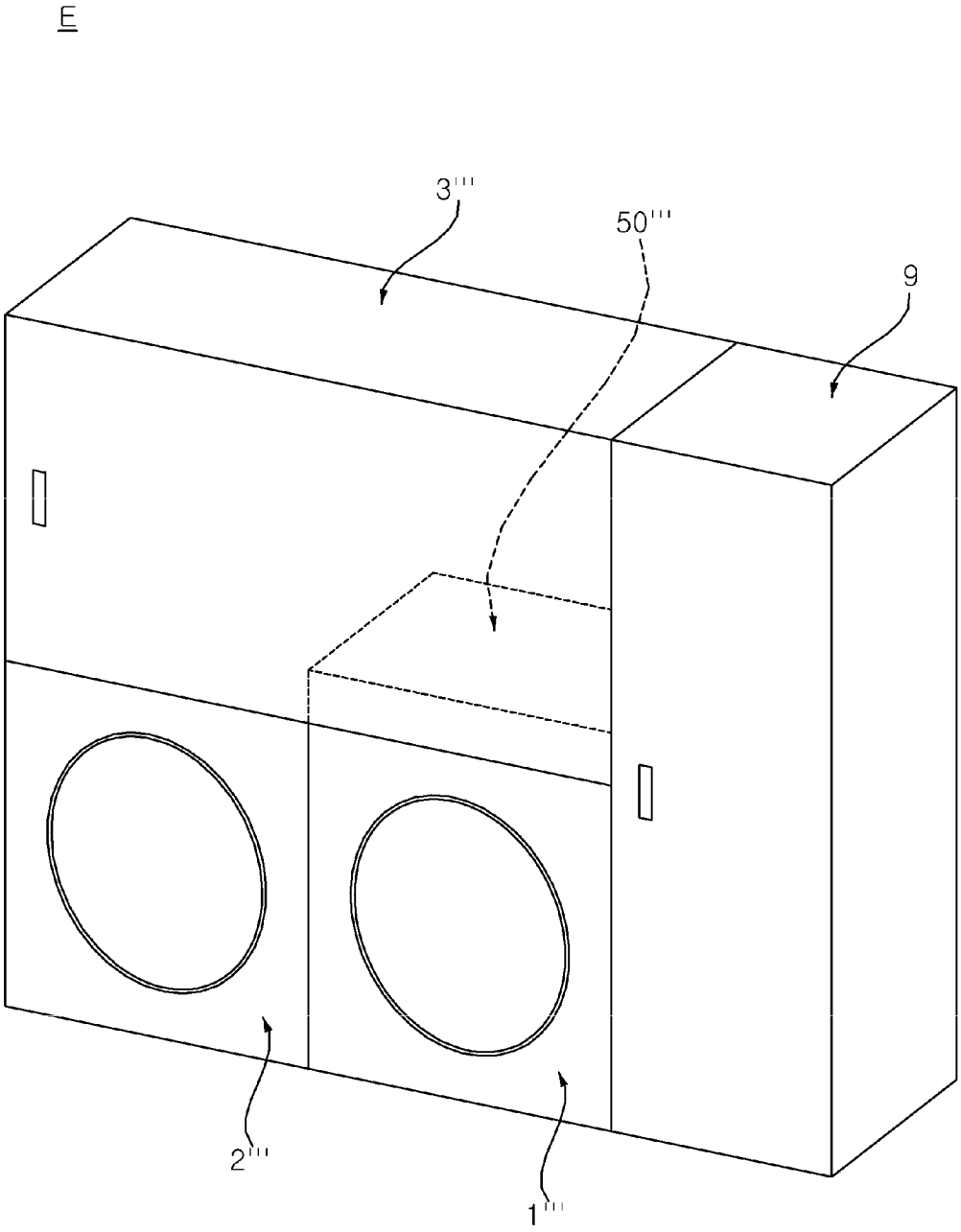
FIG. 30 is a perspective view of a laundry treating apparatus according to still another embodiment of the present disclosure.

Hereinafter, a laundry treating apparatus E according to yet another embodiment of the present disclosure will be described with reference to FIG. 30.

The laundry treating apparatus E according to the embodiment of the present disclosure may include a dryer 1''', a washing machine 2''', a first refresher 3''', a heating device 50''', and a second refresher 9.

The dryer 1''' and the washing machine 2''' may be disposed under the first refresher 3'''. The dryer 1''' and the washing machine 2''' may be disposed on a lateral side of the second refresher 9. The dryer 1''' may be the same as the dryer 1 of the laundry treating apparatus A according to an embodiment of the present disclosure. The washing machine 2''' may be the same as the washing machine 2 of the laundry treating apparatus A according to an embodiment of the present disclosure.

The first refresher 3''' may be disposed over the dryer 1''' and the washing machine 2'''. The first refresher 3''' may be disposed on the lateral side of the second refresher 9.

However, the arrangement positions of the dryer 1''', the washing machine 2''', the first refresher 3''', and the second refresher 9 are not limited to the above example. For example, the dryer 1''' may be disposed side by side with the washing machine 2''' over the first refresher 3'''. Further, the dryer 1''', the washing machine 2''', the first refresher 3''', and the second refresher 9 may be arranged horizontally.

A vertical height of the first refresher 3''' may be smaller than a vertical height of the second refresher 9. A transverse width of the first refresher 3''' may be greater than a transverse width of the second refresher 9. The transverse width of the first refresher 3''' may be greater than a transverse width of the dryer 1''' and the washing machine 2'''.

Clothing items having a small height, such as dress shirts, coats, trousers, etc., may be placed in the first refresher 3'''.

A vertical height of the second refresher 9 may be lower than a vertical height of the first refresher 3'''.

Clothing items having a great height, such as long coats, gowns, etc., may be placed in the second refresher 9. The second refresher 9 may be the same as the refresher 3 of the laundry treating apparatus A according to an embodiment of the present disclosure.

The first refresher 3''' and the second refresher 9 may be integrally formed with each other. If the first refresher 3''' and the second refresher 9 are integrally formed with each other, an overall outer shape thereof may be an inverted L shape.

The heating device 50''' may be disposed in the first refresher 3'''. The heating device 50''' may be disposed over the dryer 1'''. However, an arrangement position of the heating device 50''' is not limited thereto. For example, the heating device 50''' may be disposed in the dryer 1''', the washing machine 2''', or the second refresher 9. In addition, the heating device 50''' may be disposed over the first refresher 3''' or may be disposed under the dryer 1''' and the washing machine 2'''.

The heating device 50''' may supply hot air and stem to each of the dryer 1''', the washing machine 2''', the first refresher 3''', and the second refresher 9. The heating device 50''' may be disposed adjacent to each of the dryer 1''', the first refresher 3''', and the second refresher 9. By supplying the hot air to each of the dryer 1''', the first refresher 3''', and the second refresher 9, the heating device 50''' may dry the clothing placed therein or may sterilize the clothing by supplying the steam thereto.

The heating device 50''' may be the same as the heating device 50 of the laundry treating apparatuses A and B according to the embodiments of the present disclosure.

A duct system connecting the dryer 1''', the washing machine 2''', the refreshers 3''' and 9, and the heating device 50''' may be the same as the duct system of the laundry treating apparatuses A and B according to the embodiments of the present disclosure.

While the present disclosure has been particularly shown and described with reference to preferred embodiments thereof, it will be understood by those skilled in the art that the present disclosure is not limited to those exemplary embodiments and various changes in form and details may be made therein without departing from the scope and spirit of the invention as defined by the appended claims and should not be individually understood from the technical spirit or prospect of the present disclosure.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Various embodiments described herein may be implemented in a computer-readable medium using, for example, software, hardware, or some combination thereof. For example, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions may be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A laundry treating apparatus comprising:

a dryer;

a washing machine vertically disposed with respect to the dryer;

a refresher disposed on one side of the dryer and the washing machine;

a heating device including a plurality of compressors, the heating device configured to heat air supplied to at least one of the dryer, the washing machine, and the refresher;

a processor configured to control a number of the plurality of compressors to be operated and revolutions per minute (RPM) of each of the operated compressors for supplying hot air suitable for a cycle status of the dryer and configured to control a supply of hot air suitable for a cycle status of the refresher;

a first flow control valve disposed in a first passage between the heating device and the dryer;

a second flow control valve disposed in a second passage between the heating device and the washing machine; and a third flow control valve disposed in a third passage between the heating device and the refresher, wherein the processor is further configured to change an opening degree of each of the first flow control valve, the second flow control valve and the third flow control valve based on a required temperature during cycles of the dryer, the washing machine, and the refresher connected to the first to third passages in which the first to third flow control valves are disposed.

2. The laundry treating apparatus of claim 1, wherein the plurality of compressors have different capacities from one another and use different compression methods.

3. The laundry treating apparatus of claim 1, wherein a total capacity of the plurality of compressors is greater than a sum of loads of heated air required for the cycles of the dryer, the washing machine, and the refresher, and wherein, among the plurality of compressors, a first compressor has a minimum capacity which is greater than a minimum load value among the loads required for the cycles of the dryer, the washing machine, and the refresher.

4. The laundry treating apparatus of claim 1, wherein the processor is further configured to:

operate one compressor among the plurality of compressors in response to there being one laundry treating machine among the dryer, the washing machine, and the refresher that requires the heated air, and operate two compressors among the plurality of compressors in response to there being two or more laundry treating machines among the dryer, the washing machine, and the refresher that require the heated air.

5. The laundry treating apparatus of claim 1, wherein the processor is further configured to:

operate one compressor among the plurality of compressors in response to a temperature of the heated air required for cycles of the dryer, the washing machine, and the refresher being a first value or less, and operate two compressors among the plurality of compressors in response to the temperature of the heated air required for the cycles of the dryer, the washing machine, and the refresher being a second value that is greater than the first value.

6. The laundry treating apparatus of claim 1, wherein the processor is further configured to vary a number of compressors among the plurality of compressors to be operated according to a type of laundry treating machine among the dryer, the washing machine, and the refresher that requires the heated air.

7. The laundry treating apparatus of claim 1, wherein the cycle status comprises one or more of a type of a cycle performed by each laundry treating machine of the dryer, the washing machine, and the refresher, a type of loaded laundry, and the required temperature for the cycle performed by each laundry treating machine of the dryer, the washing machine, and the refresher.

8. The laundry treating apparatus of claim 1, wherein the processor is further configured to control the RPMs of the plurality of compressors when only one laundry treating machine among the dryer, the washing machine, and the refresher performs a cycle that requires air heated by the heating device to be lower than the RPMs of the plurality of compressors when two or more laundry treating machines among the dryer, the washing machine, and the refresher perform cycles that require the air heated by the heating device.

9. The laundry treating apparatus of claim 1, wherein the processor is further configured to turn off the plurality of compressors at different times in response to completion of cycles of the dryer, the washing machine, and the refresher.

10. The laundry treating apparatus of claim 1, wherein the heating device further includes:

an evaporator for dehumidifying air by heat exchange between introduced air and a low-temperature refrigerant;

a condenser for heating air by heat exchange between a high-temperature refrigerant and air; and a fan for blowing the air heated by passing through the condenser.

11. The laundry treating apparatus of claim 10, further comprising:

a first supply air duct connecting the dryer to the heating device; and a second supply air duct connecting the washing machine to the heating device, wherein the heating device further includes a switching device for controlling a direction of the air blown by the fan.

12. The laundry treating apparatus of claim 11, further comprising a blowing duct surrounding the fan, wherein the switching device includes:

a rotating body rotatably mounted in the blowing duct, the rotating body having a cut-out portion; and a driving motor for rotating the rotating body to supply the blown air through the cut-out portion into the first supply air duct or the second supply air duct.

13. The laundry treating apparatus of claim 1, wherein, the processor is further configured to open a respective one of the first flow control valve, the second flow control valve, and the third flow control valve to a maximum degree when only one of the plurality of compressors is operated, and the air heated by the heating device is supplied to any one laundry treating machine among the dryer, the washing machine, and the refresher.

14. The laundry treating apparatus of claim 1, wherein, when only one of the plurality of compressors is operated and the air heated by the heating device is supplied to two or more laundry treating machines among the dryer, the washing machine, and the refresher, the processor is further configured to:

operate the heating device based on a first laundry treating machine among the two or more laundry treating machines that requires a highest temperature air, and open a respective one of the first flow control valve, the second flow control valve and the third flow control valve connected to a second laundry treating machine among the two or more laundry treating machines that requires air of a lower temperature than the highest temperature to a minimum degree.

15. The laundry treating apparatus of claim 14, wherein the processor is further configured to control the opening degree of the respective one of the first flow control valve, the second flow control valve and the third flow control valve, which is opened to the minimum degree, to gradually increase until the required temperature is reached.

16. The laundry treating apparatus of claim 1, wherein, when the air heated by the heating device is supplied to any one laundry treating machine among the dryer, the washing machine, and the refresher, the processor is further configured to:

operate at least one of the plurality of compressors based on the required temperature of the one laundry treating machine supplied with the heated air, and open a respective one of the first flow control valve, the second flow control valve and the third flow control valve connected to the one laundry treating machine supplied with the heated air in response to the required temperature.

* * * * *